US011267617B2

(12) United States Patent
Kodama et al.

(10) Patent No.: US 11,267,617 B2
(45) Date of Patent: Mar. 8, 2022

(54) SHEET MATERIAL CONTAINER

(71) Applicant: Kao Corporation, Tokyo (JP)

(72) Inventors: Daisuke Kodama, Sumida-ku (JP); Yoshinori Inagawa, Sumida-ku (JP); Mitsugu Iwatsubo, Sumida-ku (JP); Takahiro Otsuka, Sumida-ku (JP); Masahito Chiwaki, Sumida-ku (JP)

(73) Assignee: Kao Corporation, Tokyo (JP)

( * ) Notice: Subject to any disclaimer, the term of this patent is extended or adjusted under 35 U.S.C. 154(b) by 414 days.

(21) Appl. No.: 16/325,805

(22) PCT Filed: Mar. 7, 2017

(86) PCT No.: PCT/JP2017/008930
§ 371 (c)(1),
(2) Date: Feb. 15, 2019

(87) PCT Pub. No.: WO2018/163270
PCT Pub. Date: Sep. 13, 2018

(65) Prior Publication Data

US 2021/0163181 A1 Jun. 3, 2021

(51) Int. Cl.
*B65D 33/02* (2006.01)
*B65D 75/00* (2006.01)
*B65D 75/52* (2006.01)

(52) U.S. Cl.
CPC ..... *B65D 33/02* (2013.01); *B65D 75/008* (2013.01); *B65D 75/52* (2013.01)

(58) Field of Classification Search
CPC ..... B65D 33/02; B65D 75/008; B65D 75/52
(Continued)

(56) References Cited

U.S. PATENT DOCUMENTS 4,700,871 A * 10/1987 Matsuo ..... A61J 1/05 222/107
4,898,306 A * 2/1990 Pardes ..... B65D 1/0292 222/206
(Continued)

FOREIGN PATENT DOCUMENTS

CN 102387968 A 3/2012
CN 104144859 A 11/2014
(Continued)

OTHER PUBLICATIONS

Extended European Search Report dated Feb. 7, 2020 in European Patent Application No. 17899913.2, 8 pages.
(Continued)

*Primary Examiner* — Peter N Helvey
(74) *Attorney, Agent, or Firm* — Oblon, McClelland, Maier & Neustadt, L.L.P.

(57) ABSTRACT

A container body of the sheet container is composed of a sheet member given by lamination of a plurality of film layers, and has a plurality of surface-like parts; the plurality of surface-like parts include a first surface-like part and a second surface-like part that adjoin and cross each other; the sheet member has a filler enclosing part in which a filler is enclosed between the plurality of film layers; the filler enclosing part includes an intermediate extending part laid across the first surface-like part and the second surface-like part, and a first adjoining part and a second adjoining part that individually adjoin both sides of the intermediate extending part; and the intermediate extending part extending more further from the second surface-like part than the first adjoining part and the second adjoining part extend.

15 Claims, 29 Drawing Sheets

(58) Field of Classification Search
USPC ..... 220/62.11
See application file for complete search history.

(56) References Cited

U.S. PATENT DOCUMENTS

| | | | | | |
|---|---|---|---|---|---|
| 4,997,107 | A * | 3/1991 | Snyder | B65D 35/02 | 222/107 |
| 5,174,458 | A * | 12/1992 | Segati | B65D 1/0292 | 215/383 |
| 5,261,881 | A * | 11/1993 | Riner | A61M 5/282 | 128/919 |
| 5,427,830 | A * | 6/1995 | Pharo | B65D 81/052 | 428/35.2 |
| 5,622,283 | A * | 4/1997 | Morrison | B05B 11/00412 | 222/103 |
| 5,960,975 | A | 10/1999 | Lennartsson | | |
| 6,176,613 | B1 * | 1/2001 | Chen | B65D 33/00 | 206/522 |
| 6,471,402 | B1 * | 10/2002 | Burns | B65D 21/023 | 206/509 |
| 6,488,146 | B1 * | 12/2002 | Dotsikas | A61J 7/0046 | 206/217 |
| 6,607,097 | B2 * | 8/2003 | Savage | B65D 75/5877 | 220/62.12 |
| 6,673,301 | B2 * | 1/2004 | Cargile | B65D 35/08 | 264/509 |
| 8,206,033 | B2 * | 6/2012 | Sato | B29C 66/7392 | 383/104 |
| 8,336,790 | B2 * | 12/2012 | Kolins | A61L 9/12 | 239/327 |
| 8,960,183 | B2 * | 2/2015 | Husson, Jr. | B32B 37/144 | 126/624 |
| 2008/0149666 | A1 * | 6/2008 | LaFlamme | B65D 47/2056 | 222/105 |
| 2011/0290798 | A1 * | 12/2011 | Corbett | B65D 77/06 | 220/62.12 |
| 2015/0034670 | A1 | 2/2015 | Stanley et al. | | |
| 2016/0297591 | A1 | 10/2016 | You et al. | | |

FOREIGN PATENT DOCUMENTS

| | | | |
|---|---|---|---|
| CN | 104520207 | A | 4/2015 |
| CN | 105408226 | A | 3/2016 |
| DE | 20 2005 016 704 | U1 | 3/2006 |
| EP | 2 631 195 | A1 | 8/2013 |
| EP | 3 348 488 | A1 | 7/2018 |
| GB | 2 311 753 | A | 10/1997 |
| JP | 7-232744 | A | 9/1995 |
| JP | 2000-109095 | A | 4/2000 |
| JP | 2006-123931 | A | 5/2006 |
| JP | 2014-227211 | A | 12/2014 |
| JP | 2015-726 | A | 1/2015 |
| JP | 2017-141063 | A | 8/2017 |
| JP | 2018-108842 | A | 7/2018 |
| JP | 2018-108843 | A | 7/2018 |
| JP | 2018-144363 | A | 9/2018 |
| JP | 2018-144856 | A | 9/2018 |
| JP | 2018-144857 | A | 9/2018 |
| JP | 2018-144860 | A | 9/2018 |
| JP | 2018-144886 | A | 9/2018 |
| JP | 2018-144888 | A | 9/2018 |
| WO | WO 02/26567 | A2 | 4/2002 |
| WO | WO 2005/063589 | A1 | 7/2005 |

OTHER PUBLICATIONS

Combined Chinese Office Action and Search Report dated Mar. 24, 2021 in Patent Application No. 201780050049.X (with English machine translation and English translation of Category of Cited Documents), 24 pages.

International Search Report dated May 16, 2017 in PCT/JP2017/008930 filed on Mar. 7, 2017.

Japanese Office Action dated Dec. 1, 2020 in Japanese Patent Application No. 2017-148253 (with unedited computer generated English translation), 7 pages.

* cited by examiner

SHEET MATERIAL CONTAINER

CROSS REFERENCE TO RELATED APPLICATION

This application is a national phase application of PCT/JP2017/008930, filed Mar. 7, 2017, the entire content and disclosure of which is incorporated into the present application.

TECHNICAL FIELD

The present invention relates to a sheet container, a packed article in sheet container, a sheet for container and container-forming sheet.

BACKGROUND ART

As a sheet container composed of a sheet member, there has recently been proposed a type of such product having a non-attached part partially formed between layers of the sheet member, and air is enclosed in the non-attached part, for the purpose of improving shape retention property and the like (see Patent Document 1, for example).

Patent Document 1 discloses a sheet container having non-attached parts filled with air, which are disposed individually along four sides of its rectangular bottom; and a sheet container whose trunk has non-attached parts vertically and laterally arranged therein, into which air is enclosed.

RELATED ART DOCUMENT

Patent Document JP-A-7-232744

SUMMARY OF THE INVENTION

The present invention relates to a sheet container which includes a container body that surrounds an accommodating area for accommodating an article, the container body being composed of a sheet member given by lamination of a plurality of film layers, and having a plurality of surface-like parts, the plurality of surface-like parts including a first surface-like part and a second surface-like part that adjoin and cross each other, the sheet member having a film region in which the plurality of film layers are attached to each other, and a filler enclosing part in which a filler is enclosed between the plurality of film layers, the filler enclosing part including:

an intermediate extending part laid across the first surface-like part and the second surface-like part, and extend from a boundary part between the first surface-like part and the second surface-like part towards the side of an opposite end opposite to the boundary part side at the first surface-like part; and a first adjoining part and a second adjoining part that individually adjoin both sides, in the direction along the boundary part, of the intermediate extending part, and, the intermediate extending part extending more further from the second surface-like part than the first adjoining part and the second adjoining part extend, and, the film regions are individually disposed adjoining both sides of an end part of the intermediate extending part in the extending direction thereof.

Figure 21:
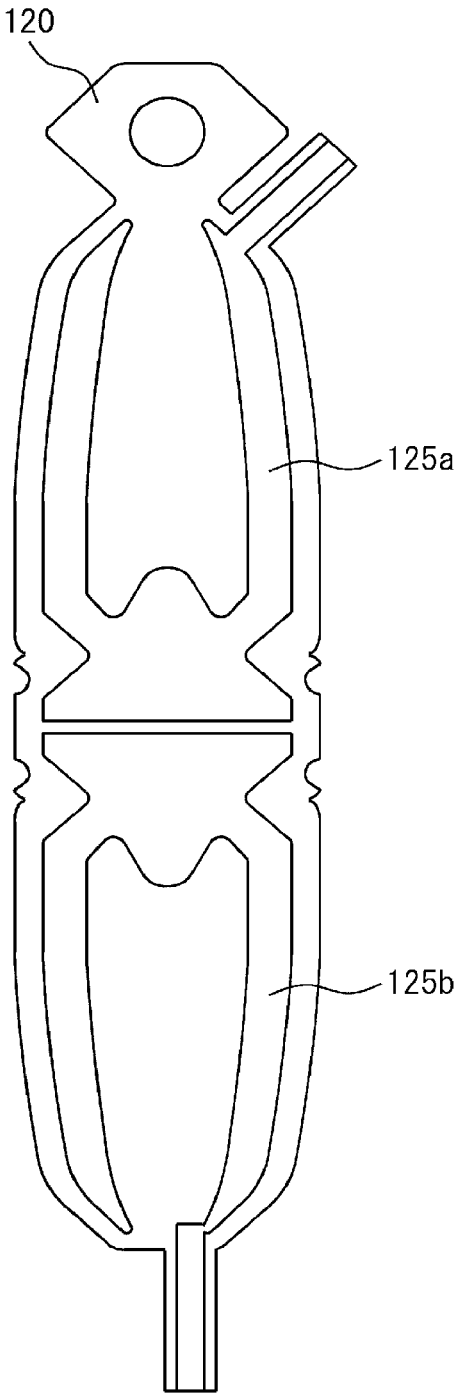
FIG. 21 is a plan view illustrating a first film layer of a container body-forming sheet member that composes the container body of the sheet container according to Modified Example 9 of the first embodiment.
Figure 28A:
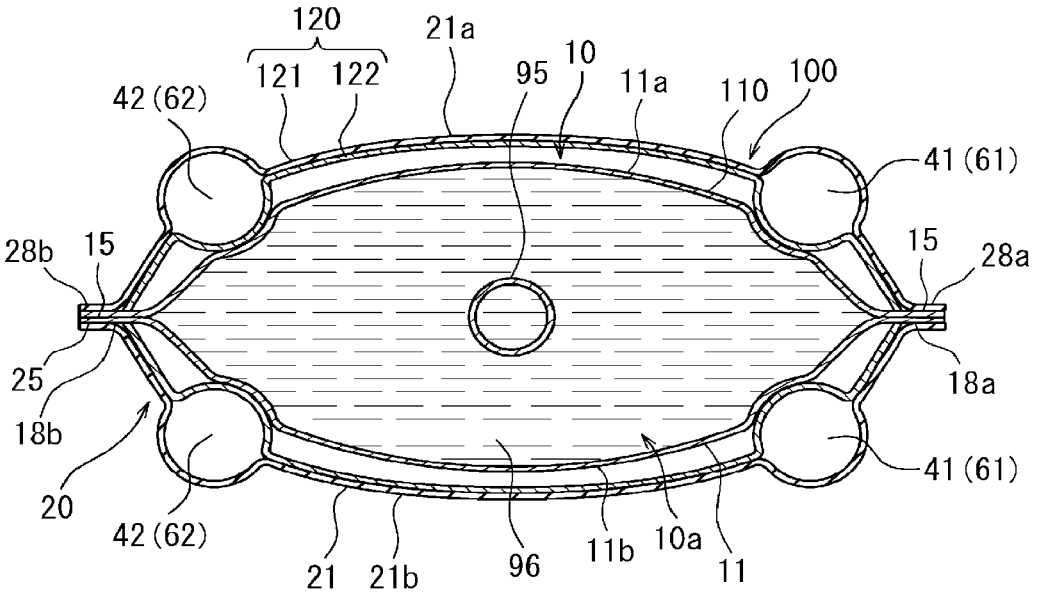
Figure 28B:
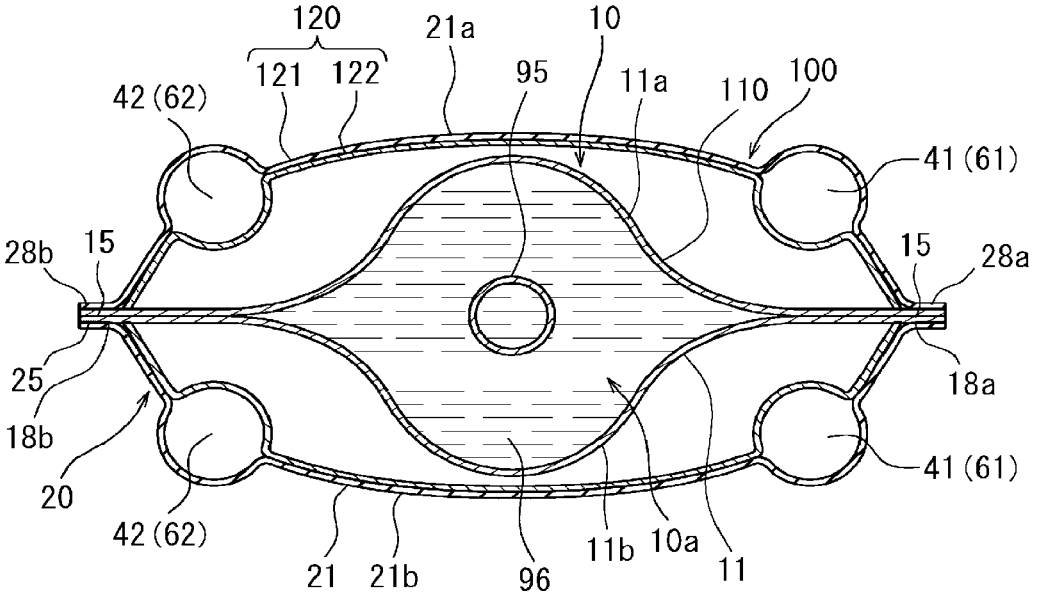

Each of FIG. 28(*a*) and FIG. 28(*b*) is a cross sectional view taken along line A-A in FIG. 21, wherein FIG. 28(*b*) illustrates a less volume of article remaining in the accommodating area, as compared with the volume illustrated in FIG. 28(*a*).

Figure 29:
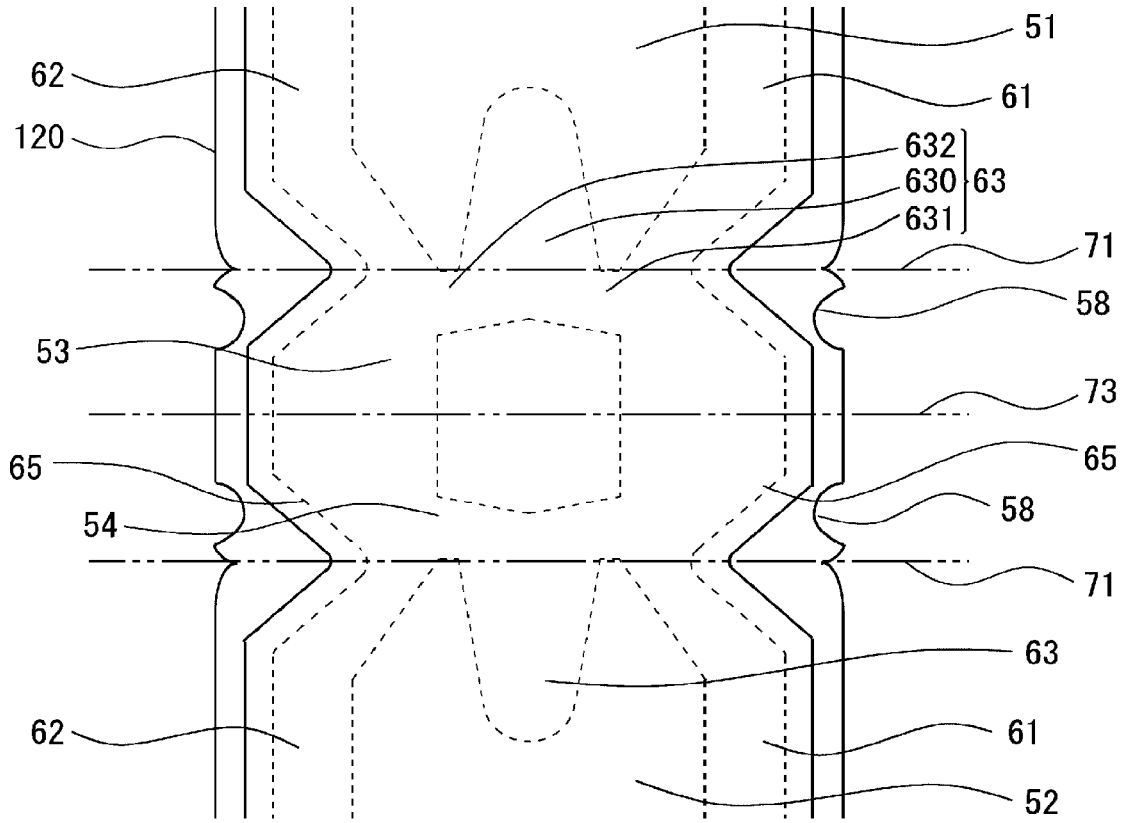

FIG. 29 is a plan view illustrating a part of the container body-forming sheet member that composes the container body of a sheet container according to Modified Example 10 of the first embodiment.

DETAILED DESCRIPTION OF THE INVENTION

According to investigations by the present inventors, the design of sheet container described in Patent Document 1 cannot always necessarily reserve a sufficient capacity of sheet container.

The present invention now relates to a sheet container, a packed article in sheet container, a sheet for container, and a container-forming sheet having a structure capable of ensuring enough capacity.

Preferred embodiments of the present invention will be explained below, referring to attached drawings. In all drawings, all similar constituents will be given the same reference numerals or symbols, so as to suitably avoid repetitive explanation.

First Embodiment

First, the first embodiment will be explained referring to FIG. 1 to FIG. 14.

Figure 12:
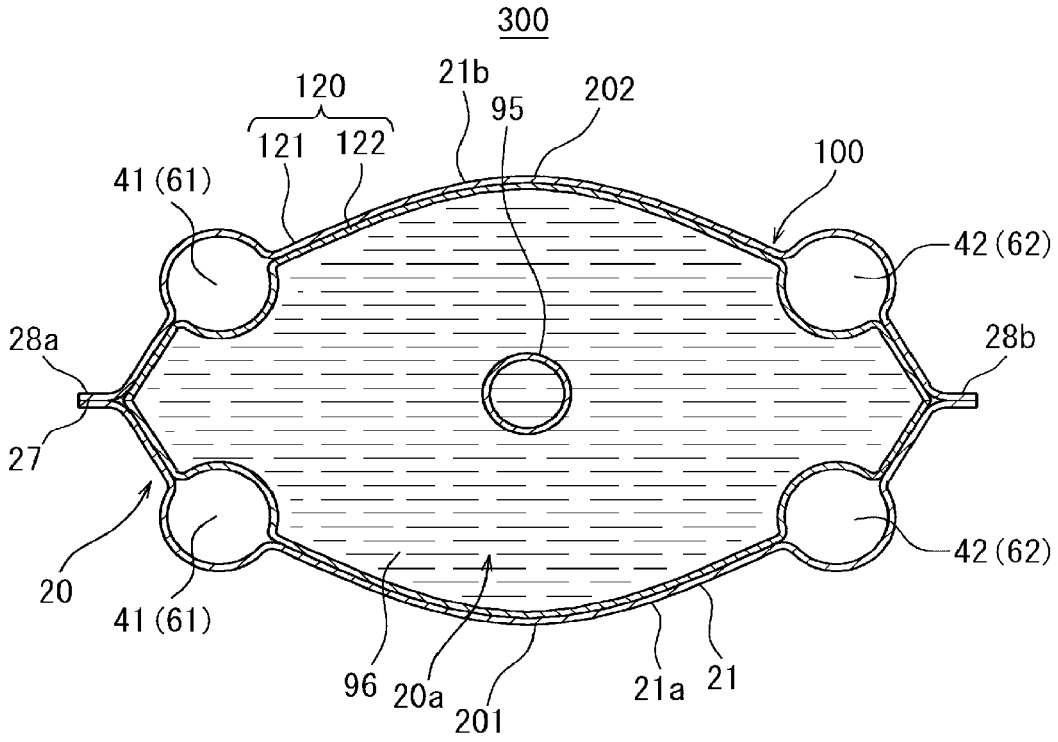
FIG. 12 is a plane cross sectional view (cross sectional view taken along line A-A in FIG. 11) illustrating a packed article in sheet container of the first embodiment.

The sheet container 100 of this embodiment has a container body 20 that surrounds an accommodating area 20*a* (FIG. 12, etc.) for accommodating an article 96 (FIG. 12, etc.). The container body 20 is composed of a sheet member (container body-forming sheet member 120) given by lamination of a plurality of film layers (for example, two film layers named a first film layer 121 and a second film layer 122), and a plurality of surface-like parts (for example, four surface-like parts including a first main surface part 21*a*, a second main surface part 21*b*, a bottom gusset 23 and a top gusset 22); the plurality of surface-like parts include a first surface-like part (for example, first main surface part 21*a*) and a second surface-like part (for example, bottom gusset 23) that adjoin and cross each other; the sheet member has a film region in which the plurality of film layers are attached to each other, and a filler enclosing part [for example, a first peripheral enclosing part 41, a second peripheral enclosing part 42, a specific enclosing part 80 (the specific enclosing part 80 includes an intermediate extending part 83, a first adjoining part 84, and a second adjoining part 85), a second specific enclosing part 800 (the second specific enclosing part 800 includes a second intermediate extending part 830, a first adjoining part 84, and a second adjoining part 85), a filler enclosing part 45, a transverse direction enclosing part 46 and a filler enclosing part 47] in which a filler is enclosed between the plurality of film layers; the filler enclosing part includes an intermediate extending part 83 laid across the first surface-like part and the second surface-like part, and extend from a boundary part 151 between the first surface-like part and the second surface-like part towards the side of an opposite end 152 opposite to the boundary part 151 side at the first surface-like part, and a first adjoining part 84 and a second adjoining part 85 that individually adjoin both sides, in the direction along the boundary part 151, of the intermediate extending part 83; and, the intermediate extending part 83 extending more further from the second surface-like part than the first adjoining part 84 and the second adjoining part 85 extend, and the film regions are individually disposed adjoining both sides (left and right sides, in the embodiment) of an end part of the intermediate extending part 83 in the extending direction thereof.

Here, the intermediate extending part 83 lies continuously over the range from the boundary part 151, towards the end in the extending direction of the intermediate extending part 83.

The "direction along the boundary part 151" means the direction, which is orthogonal to the direction from the second surface-like part across the boundary part 151 to the first surface-like part. In this embodiment, this nearly coincides the left-right direction in FIG. 2 and FIG. 3.

The intermediate extending part 83 extends from the boundary part 151 towards the opposite end 152 (upward in this embodiment), and the film region is formed along the edge on the opposite end 152 side of the intermediate extending part 83 (in this embodiment, upper edge of chevron shape). The intermediate extending part 83 is formed in a convex shape toward the opposite end 152 (convex upward, in this embodiment), and adjoining both sides of the intermediate extending part 83, there are formed film regions which are convex towards the boundary part 151 side (downward, in this embodiment).

In this embodiment, the film regions, which are individually adjoining both sides (left and right sides, in this embodiment) of the end in the extending direction of the intermediate extending part 83, are disposed in the ranges including the areas above the first adjoining part 84, and, an area above the second adjoining part 85.

According to such design of the sheet container 100, by the force of the intermediate extending part 83 disposed across the first surface-like part and the second surface-like part trying to flatten, the container body 20 is given the force which is exerted in the direction of expansion of the boundary part 151 between the first surface-like part and the second surface-like part (that is, the force which drives the first surface-like part and the second surface-like part to align in the same plane). In this way, the container body 20 will be bulged outward of the container body 20 at the central part of the first surface-like part. Hence, the container body 20 will have an increased capacity of the inner space, as compared with the container body 20 having no intermediate extending part 83.

In particular, since the intermediate extending part 83 extends more further from the second surface-like part than the first adjoining part 84 and the second adjoining part 85 extend, it is possible to sufficiently ensure the bulging of the central part of the first main surface portion 21*a*.

In addition, since the film regions are individually disposed adjoining both sides of the end part of the intermediate extending part 83 in the extending direction thereof, it is possible to sufficiently exert the force of the intermediate extending part 83 trying to flatten even at the end part of the intermediate extending part 83, and thereby the intermediate extending part 83 can more efficiently allow the first main surface part 21*a* to bulge at the central part.

Therefore, the capacity of the sheet container 100 can be sufficiently secured.

The sheet container 100 of this embodiment is, for example, used as a pump container. However, the present invention is not limited thereto, allowing the sheet container 100 to be used as a squeeze container (a container that discharge the article 96, upon being pressurized). When the sheet container 100 is a squeeze container, the force for pressing the sheet container 100 is transmitted to the container body 20 over a wider area by the intermediate extending part 83, and thereby, making it more easily to press the sheet container 100 and effectively to discharge the article 96.

In this embodiment, the container body 20 demarcates the accommodating area 20*a*. Hence, when the article 96 is accommodated in the accommodating area 20*a*, the article 96 is brought into direct contact with the inner surface of the container body 20.

However, the present invention is not limited to this design. The sheet container 100 may alternatively have an inner container 10 that is covered with the container body 20, and the accommodating area (accommodating area 10*a*) may be demarcated by the inner container 10. In this design, as described later in other embodiment, the article 96 accommodated in the accommodating area 10*a* is brought into direct contact with the inner surface of the inner container 10, but is not brought into direct contact with the inner surface of the container body 20.

In this embodiment, the sheet container 100 is designed in a self-standing form, since the container body 20 has the bottom gusset 23. However, in the present invention, the sheet container is not always necessarily be self-supporting, but may be a form (pillow type) intended for use while being laid down, rather than being stood alone.

Types of the article 96 are not specifically limited. The article 96 is exemplified by shampoo, hair rinse, body soap, detergent, softener, beverage and food.

The article 96 may be liquid (including paste), or may be solid (for example, particle (including granule), or powder). However, in this embodiment, the sheet container 100 has a pumping cap 90, and the article 96 is liquid.

When the article 96 is liquid, the article 96 preferably has a viscosity, for example at 30° C., of equal to or larger than 1 mPa·s and equal to or smaller than 120,000 mPa·s (measured using a B-type viscometer, such as Viscometer TV-10 or Viscometer TVB-10 from Toki Sangyo Co., Ltd.), which is more preferably equal to or larger than 1 mPa·s and equal to or smaller than 60,000 mPa·s.

In this embodiment, all of filler enclosing parts (for example, first peripheral enclosing part 41, second peripheral enclosing part 42, specific enclosing part 80, second specific enclosing part 800, filler enclosing part 45, transverse direction enclosing part 46 and filler enclosing part 47) of the sheet container 100 (container body-forming sheet member 120) are formed in a merged manner. However, in the present invention, the container body-forming sheet member 120 may have a plurality of filler enclosing parts independent from each other.

Besides the filler enclosing part and the film region, the sheet container 100 (container body-forming sheet member 120) may have a region where the plurality of film layers (for example, the first film layer 121 and the second film layer 122) are kept unattached and have no filler between the plurality of film layers.

Here, further adjoining the film regions that adjoin the sides of the end, in the direction of stretching, of the intermediate extending part 83, there may be disposed a region in which the plurality of film layers are kept unattached, and therefore have no filler between such plurality of film layers.

Figure 2:
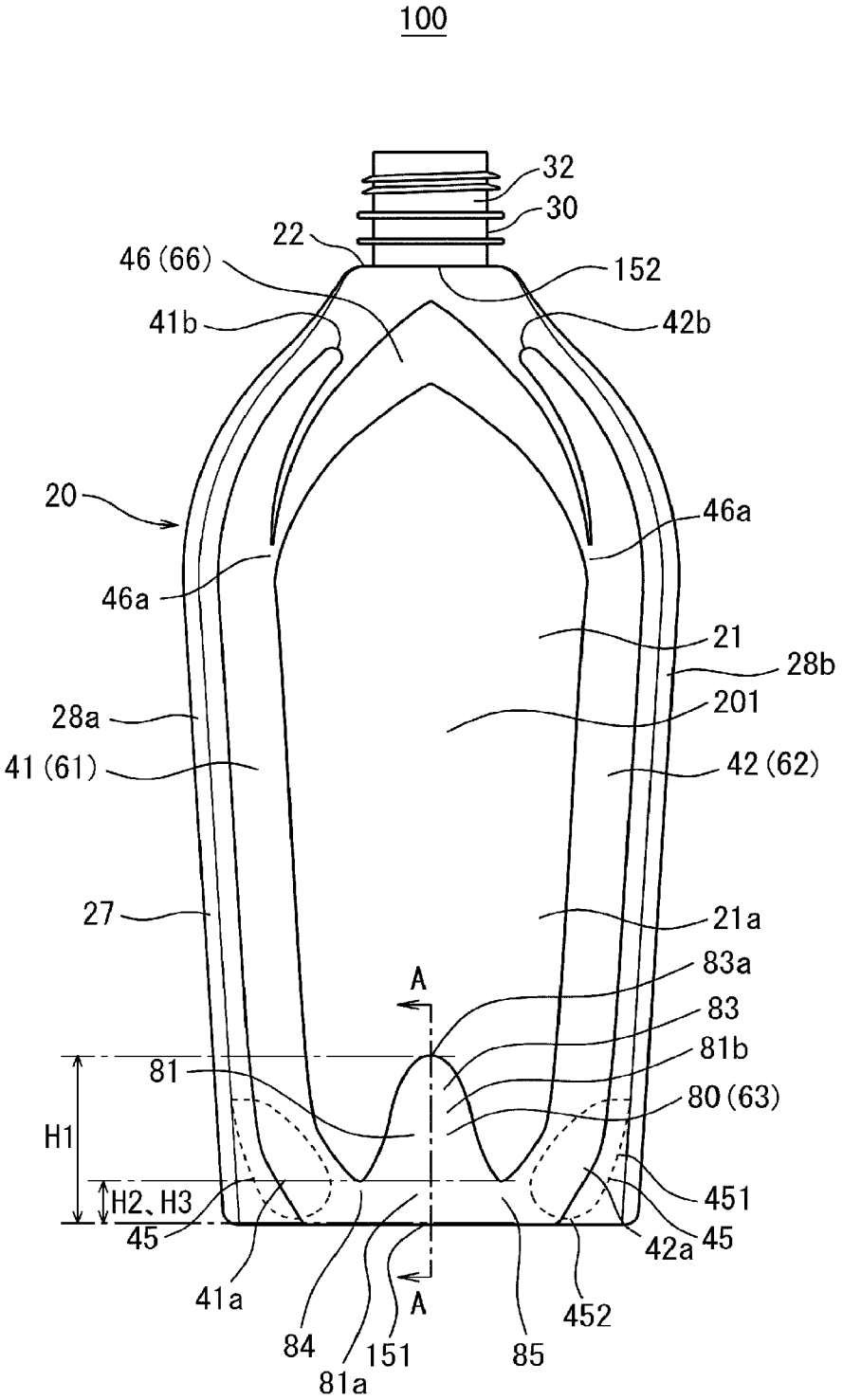
FIG. 2 is a front elevation illustrating the sheet container of the first embodiment.
Figure 3:
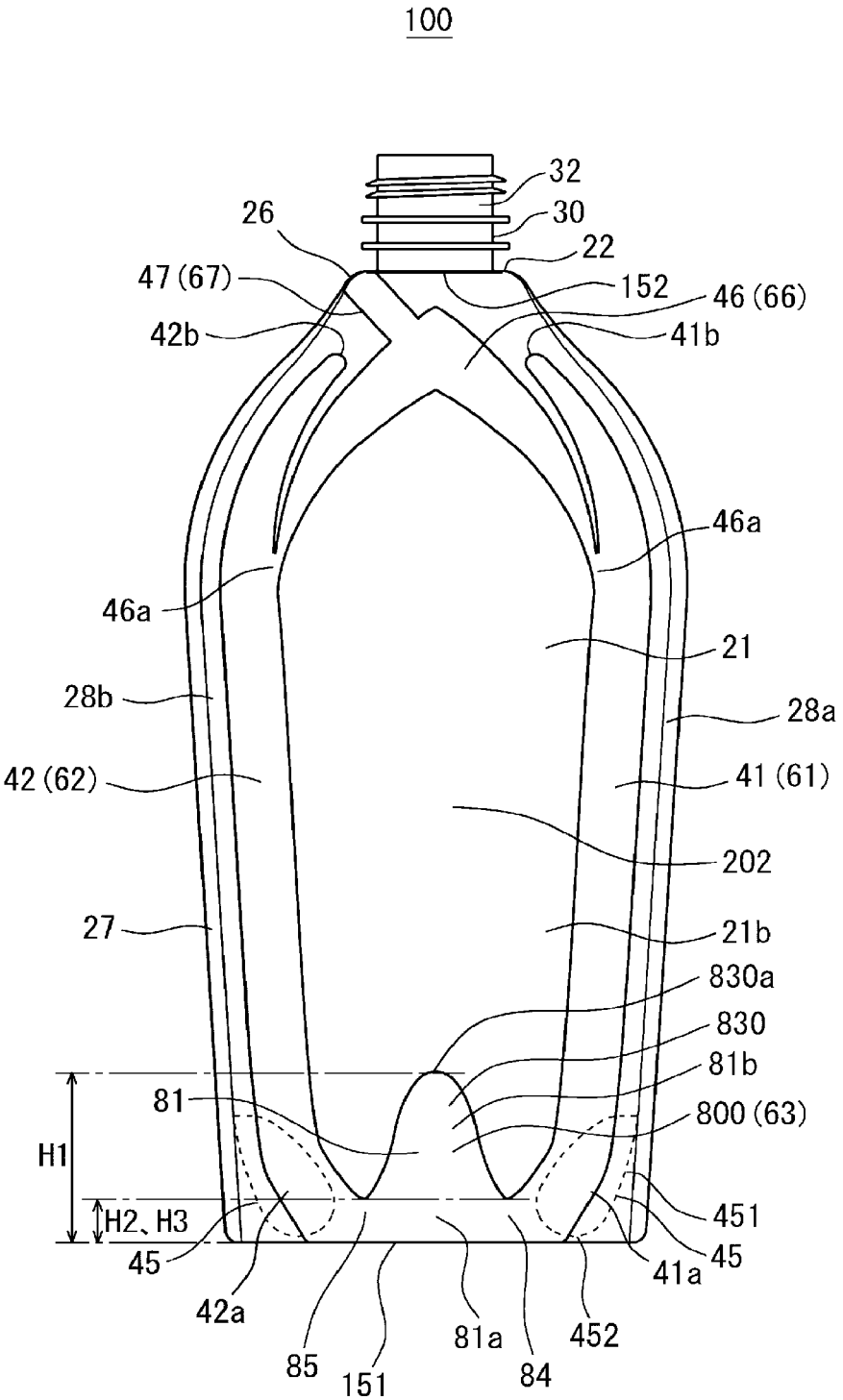
FIG. 3 is a rear view illustrating the sheet container of the first embodiment.
Figure 11:
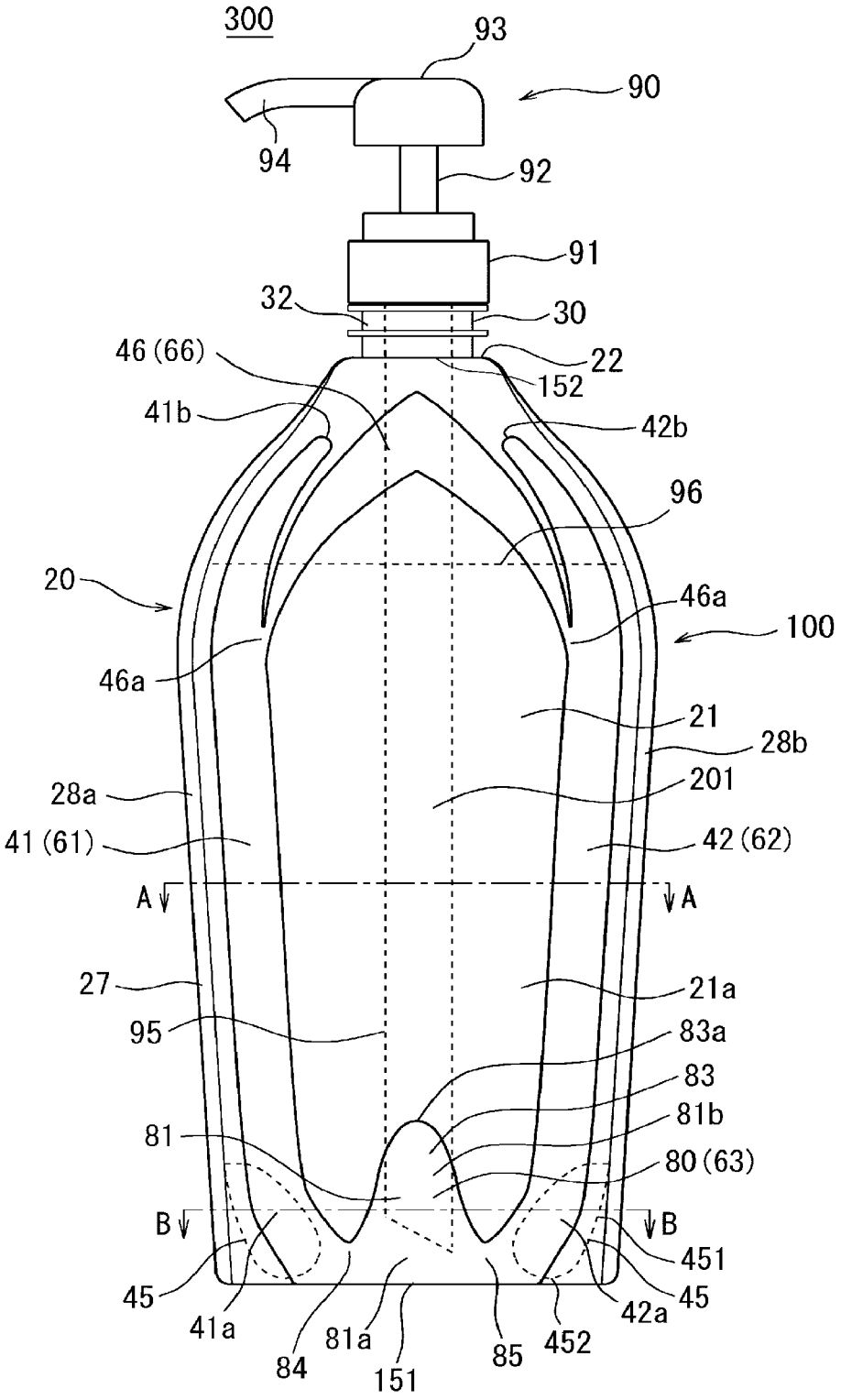
FIG. 11 is a front elevation illustrating a packed article in sheet container of the first embodiment, with a pumping cap attached thereto.

This embodiment will further be detailed below. All explanations on positional relations (vertical relation, etc.) of the individual constituents of the sheet container 100 and a packed article in sheet container 300 (FIG. 11) will be made assuming that the sheet container 100 is kept stand as illustrated in FIG. 2 and FIG. 3, and that the packed article in sheet container 300 is kept stand as illustrated in FIG. 11, unless otherwise specifically stated. However, the positional relations explained here not always coincide with the positional relations when the sheet container 100 and the packed article in sheet container 300 are used or manufactured.

The front face side of the sheet container 100 and the packed article in sheet container 300 will be referred to as "front", the rear face side of the sheet container 100 and the packed article in sheet container 300 will be referred to as "rear", the right side of the sheet container 100 and the packed article in sheet container 300 when viewed from the front face (the right hand side in FIG. 2 and FIG. 11) will be referred to as "right", and the left side of the sheet container 100 and the packed article in sheet container 300 when viewed from the front face (the left hand side in FIG. 2 and FIG. 11) will be referred to as "left".

The positional relations of the individual constituents of the sheet container 100 and the packed article in sheet container 300 will occasionally be explained based on the positional relations in the individual drawings.

Figure 7B:
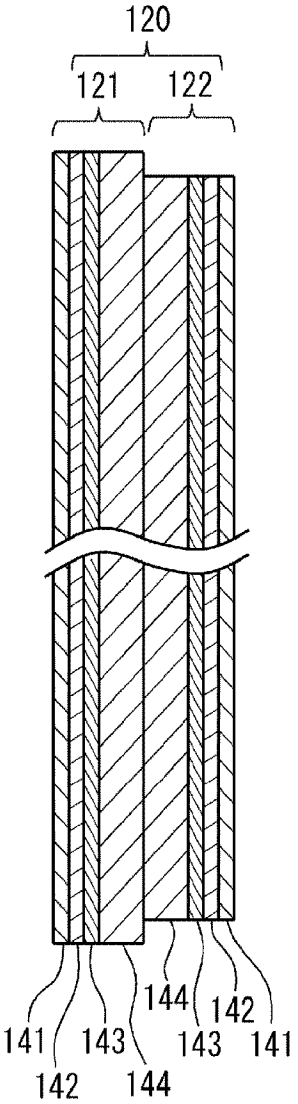
FIG. 7(*a*) is a plan view illustrating the container body-forming sheet member that composes the container body of the sheet container of the first embodiment, and FIG. 7(*b*) is a cross sectional view illustrating the container body-forming sheet member that composes the container body of the sheet container of the first embodiment.
Figure 7A:
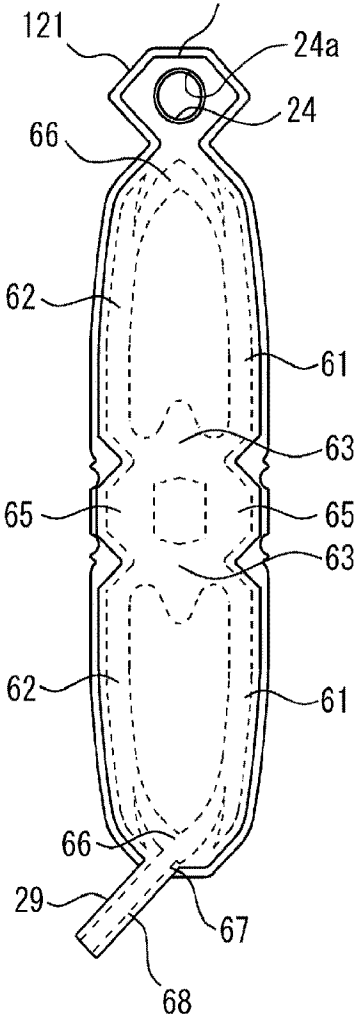
Figure 8:
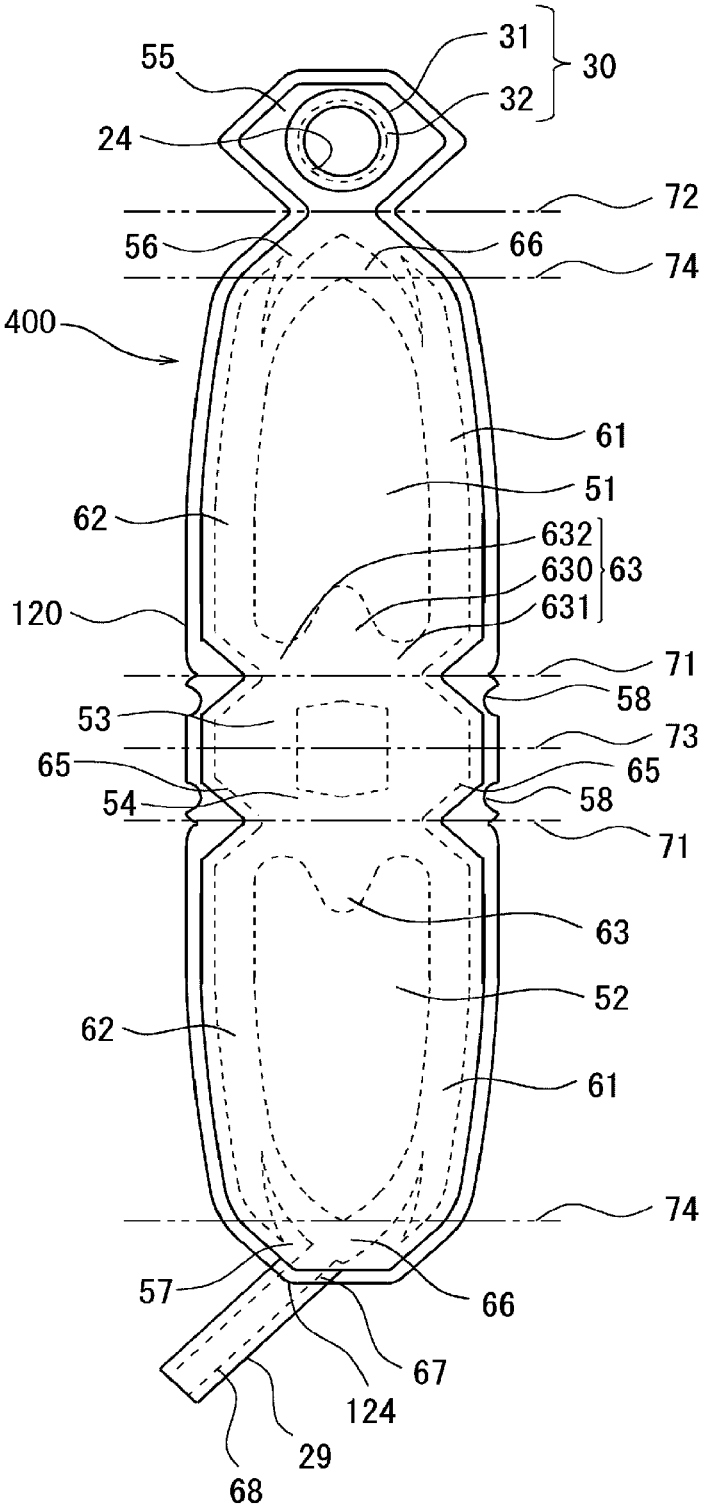
FIG. 8 is a plan view illustrating a container-forming sheet that composes the sheet container of the first embodiment, with a portion later formed into an accommodating area for accommodating an article, directed to the top.

The container body 20 is formed into the shape as illustrated in FIG. 1 to FIG. 5(*b*), by folding the container body-forming sheet member 120 shown in FIG. 7(*a*) and FIG. 8, by attaching the peripheral parts of the container body-forming sheet member 120 to each other, and by enclosing the filler such as air into the non-attached parts 61 to 67 of the container body-forming sheet member 120.

The mutual attaching of the parts of the container body-forming sheet member 120 is achieved, for example, by heat sealing. Such attached region of the peripheral parts of the container body-forming sheet member 120 will be referred to as "sealed part 27".

As shown in any one of FIG. 1 to FIG. 5(*b*), the container body 20 has a top gusset 22 which is a gusset formed at the upper end part of the container body 20, a bottom gusset 23 (second surface-like part) which is a gusset formed at the bottom of the container body 20, and a trunk 21 which is a section of the container body 20 located between the top gusset 22 and the bottom gusset 23.

The top gusset 22 has an opening 24 (FIG. 1) through which the article 96 in the accommodating area 20*a* may be discharged. As described later, in the top gusset 22, for example, there is provided a cylinder part 32 of a spout 30 so as to extend through the opening 24. Hence, in more details, the article 96 in the accommodating area 20*a* of the container body 20 may be discharged through the spout 30 that extends through the opening 24 of the top gusset 22.

The container body 20 has an inner space tightly closed except for the opening 24.

The trunk 21 has a first main surface part 21*a* (first surface-like part) and a second main surface part 21*b* (third surface-like part) opposed to each other while placing the accommodating area 20*a* in between.

The trunk 21 has a first peripheral part 28*a* and a second peripheral part 28*b*, each extending from the top gusset 22 side towards the bottom gusset 23 side, and are arranged side by side. That is, the first peripheral part 28*a* is a left peripheral part of the trunk 21 (left side marginal part), and the second peripheral part 28*b* is a right peripheral part of the trunk 21 (right side marginal part).

The lower marginal part of the first main surface part 21*a* and the front marginal part of the bottom gusset 23 are mutually connected at the lower end part on the front face side of the container body 20. Similarly, the lower marginal part of the second main surface part 21*b* and the rear marginal part of the bottom gusset 23 are mutually connected at the lower end part on the rear face side of the container body 20.

The first main surface part 21*a* and the second main surface part 21*b* are mutually connected at the first peripheral part 28*a*, and also connected at the second peripheral part 28*b*.

In the top gusset 22, for example, the level of height of the central part (in this embodiment, a part where the later-described spout 30 is provided) in the transverse direction of the container body 20 is relatively high, and parts on both sides thereof are inclined downward toward the left and right ends of the container body 20. Hence, the container body 20 has a shape of sloping shoulders.

The sheet container 100 is capable of self-standing, when the bottom gusset 23 is placed on a horizontal placement face.

Figure 1:
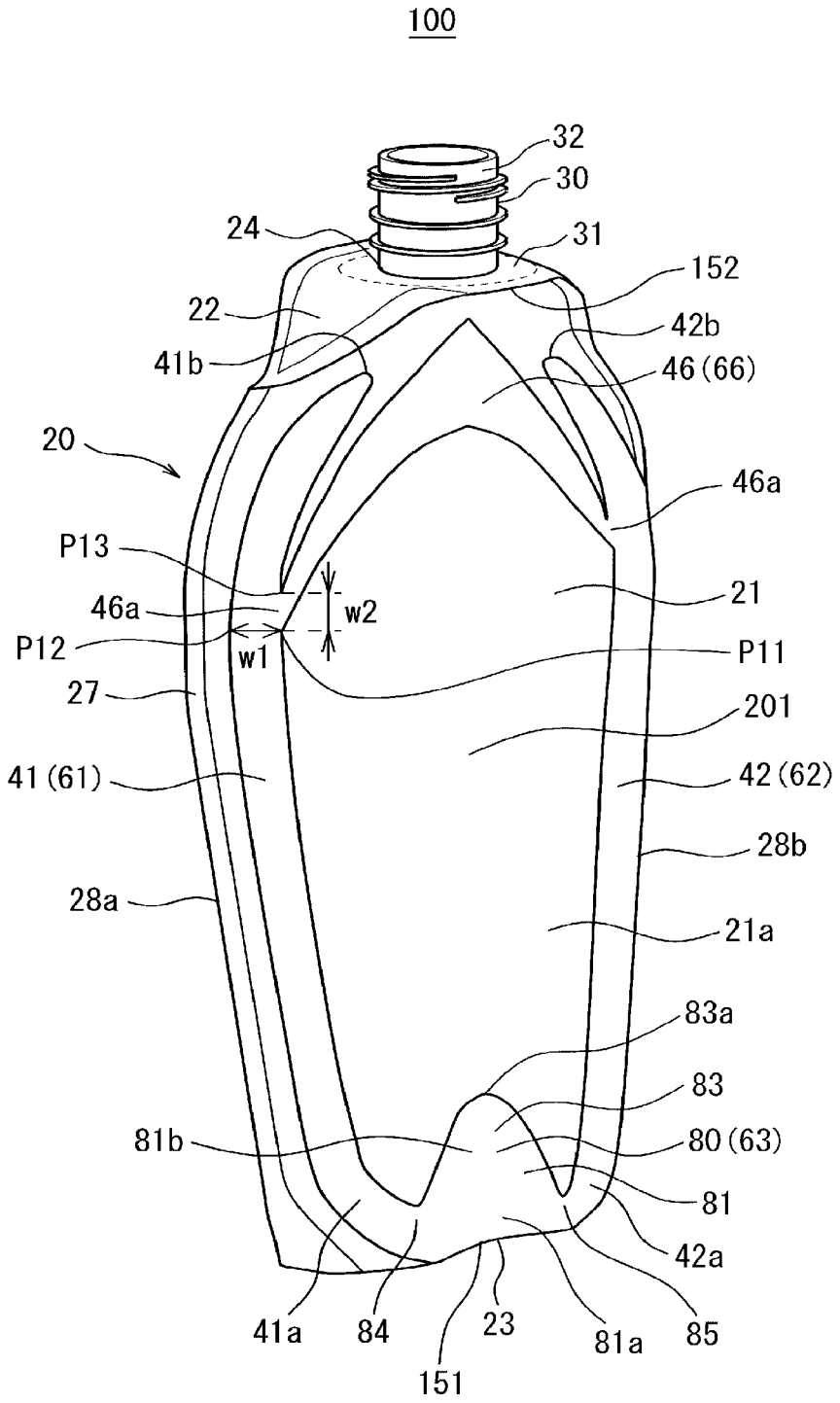
FIG. 1 is a perspective view illustrating a sheet container of a first embodiment.

In this embodiment, before the container body 20 is formed, the container body-forming sheet member 120 is preliminarily provided with the spout 30 (FIG. 8), and the cylinder part 32 of the spout 30 is projected out from the opening 24 of the container body 20 (FIG. 1, etc.).

The spout 30 is configured to include a base part 31 with flat plate-like shape attached to the inner surface side of the container body 20, and the cylinder part 32 that projects in one direction out from the base part 31. The base part 31 has a through-hole formed at the center thereof, and the inner space of the cylinder part 32 communicates with the through-hole of the base part 31. The cylinder part 32 has a cylindrical form. The outer peripheral surface of the cylinder part 32 is threaded, hence the cylinder part 32 constitutes a male thread.

The accommodating area 20*a* of the container body 20 can communicate with the outside of the sheet container 100, through the through-hole of the base part 31 of the spout 30, and through the inner space of the cylinder part 32. In this embodiment, the article 96 in the accommodating area 20*a* is discharged to the outside, through the spout 30.

In this embodiment, the base part 31 of the spout 30 is fixed by adhesion to the container body-forming sheet member 120 on the surface thereof that composes the inner surface of the container body 20. However, the present invention is not limited to such example. The base part 31 may alternatively be disposed between the first film layer 121 and the second film layer 122 that compose the container body 20, and may be fixed by adhesion to at least one of the first film layer 121 and the second film layer 122.

In more details, the spout 30 of the sheet container 100 has attached thereto the pumping cap 90 illustrated in FIG. 11.

The pumping cap 90 has, for example, a cap part 91 that screws with the cylinder part 32 of the spout 30, an upright cylinder 92 that projects upward from the cap part 91, a depressable part 93 that is provided at the top end of the upright cylinder 92 and accepts press down operation by the user, a nozzle 94 that projects nearly horizontally from the depressable part 93, and a liquid feeding tube 95 that communicates with the upright cylinder 92 and projects downward from the cap part 91.

With the pumping cap 90 being mounted on the cylinder part 32 of the spout 30, when the depressable part 93 is pressed down, the article 96 is discharged to the outside through the upright cylinder 92 and the nozzle 94.

As described above, the container body 20 has an opening 24 through which the article 96 can be discharged, the sheet container 100 has the pumping cap 90 that is attached to the marginal part of the opening 24 of the container body 20, the pumping cap 90 has an operation part (depressable part 93) which accepts the pushing operation, and can discharges the article 96 to the outside by the pushing operation on the operation part.

When the depressable part 93 is released from the press down operation and elevates, the article 96 inside the accommodating area 20*a* is sucked up through the liquid feeding tube 95.

The pumping cap 90 is attachable to and detachable from the cylinder part 32. After the article 96 in the sheet container 100 was fully consumed, the pumping cap 90 maybe attached to a new sheet container 100 that contains the article 96 (packed article in sheet container 300), and may be used just like before. That is, while the sheet container 100 that contains the article 96 (packed article in sheet container 300) might be disposable, the pumping cap 90 may be recycled.

In this embodiment, the container body 20 has, for example, filler enclosing parts individually described below, that is, the first peripheral enclosing part 41, the second peripheral enclosing part 42, the specific enclosing part 80 (the specific enclosing part 80 includes the intermediate extending part 83, the first adjoining part 84, and the second adjoining part 85), the second specific enclosing part 800 (the second specific enclosing part 800 includes the second intermediate extending part 830, the first adjoining part 84, and the second adjoining part 85), the filler enclosing part 45, the transverse direction enclosing part 46, and the filler enclosing part 47.

The first peripheral enclosing part 41 extends vertically along the left peripheral part of the trunk 21, that is, the first peripheral part 28*a*. The container body 20 has a pair of front and rear, first peripheral enclosing parts 41. That is, the first peripheral enclosing parts 41 are individually formed in each of the first main surface part 21*a* and the second main surface part 21*b*.

The second peripheral enclosing part 42 extends vertically along the right peripheral part of the trunk 21, that is, the second peripheral part 28*b*. The container body 20 has a pair of front and rear, second peripheral enclosing parts 42. That is, the second peripheral enclosing parts 42 are individually formed in each of the first main surface part 21*a* and the second main surface part 21*b*.

As shown in FIG. 2, a lower part 41*a* of the front first peripheral enclosing part 41 is arranged in an inclined posture so that, for example, it shifts rightward as it goes down. Meanwhile, a lower part 42*a* of the front second peripheral enclosing part 42 is arranged in an inclined posture so that, for example, it shifts leftward as it goes down.

As shown in FIG. 3, a lower part 41*a* of the rear first peripheral enclosing part 41 is arranged in an inclined posture so that, for example, it shifts rightward as it goes down, meanwhile, a lower part 42*a* of the rear second peripheral enclosing part 42 is arranged in an inclined posture so that, for example, it shifts leftward as it goes down (FIG. 3 is a rear view, and is therefore the right and left are reversed from FIG. 2).

The specific enclosing part 80 includes the intermediate extending part 83, the first adjoining part 84 and the second adjoining part 85.

The intermediate extending part 83 is disposed across the first main surface part 21*a* and the bottom gusset 23.

In this embodiment, also each of the first adjoining part 84 and the second adjoining part 85 is disposed across the first main surface part 21*a* and the bottom gusset 23.

The specific enclosing part 80 is formed, for example, laterally symmetrical.

In this embodiment, the second specific enclosing part 800 is formed symmetrically about the specific enclosing part 80 in the front-rear direction.

The second specific enclosing part 800 has the second intermediate extending part 830 that is symmetrical about the intermediate extending part 83 in the front-rear direction, and a first adjoining part 84 and a second adjoining part 85 that are symmetrical about the first adjoining part 84 and the second adjoining part 85 of the specific enclosing part 80 in the front-rear direction.

That is, the second intermediate extending part 830 is disposed across the second main surface part 21*b* and the bottom gusset 23.

In this embodiment, also each of the first adjoining part 84 and the second adjoining part 85 of the second intermediate extending part 830 is disposed across the second main surface part 21*b* and the bottom gusset 23.

The second specific enclosing part 800 is formed, for example, laterally symmetrical.

As shown in FIG. 2, the intermediate extending part 83 of the specific enclosing part 80 extends more further from the bottom gusset 23 than the first adjoining part 84 and the second adjoining part 85 of the specific enclosing part 80 extend. That is, height H1 given in FIG. 2 is larger than heights H2, H3.

Height H1 given in FIG. 2 represents the height from the bottom gusset 23 to the end 83*a* (i.e., upper end part) on the opposite end 152 side of the intermediate extending part 83. In other words, this is the height from a placement face to the end 83*a* when the sheet container 100 stands alone.

Heights H2, H3 given in FIG. 2 represent the heights from the bottom gusset 23 to the upper end parts of the first adjoining part 84 and the second adjoining part 85 of the specific enclosing part 80.

As shown in FIG. 3, the second intermediate extending part 830 of the second specific enclosing part 800 extends more further from the bottom gusset 23 than the first adjoining part 84 and the second adjoining part 85 of the second specific enclosing part 800 extends. That is, the height H1 given in FIG. 3 is larger than heights H2, H3.

Height H1 given in FIG. 3 represents the height from the bottom gusset 23 to the end 830*a* (i.e., upper end part) on the opposite end 152 side of the second intermediate extending part 830. In other words, this is the height from the placement face to the end 830*a* when the sheet container 100 stands alone.

Heights H2, H3 given in FIG. 3 represent the heights from the bottom gusset 23 to the upper end parts of the first adjoining part 84 and the second adjoining part 85 of the second specific enclosing part 800.

A part of the specific enclosing part 80, which is disposed in the first main surface part 21*a*, will be referred to as a first part 81, meanwhile a part of the specific enclosing part 80, which is disposed in the bottom gusset 23, will be referred to as a second part 82.

Similarly, a part of the second specific enclosing part 800, which is disposed in the second main surface part 21*b*, will be referred to as the first part 81, meanwhile a part of the second specific enclosing part 800, which is disposed in the bottom gusset 23, will be referred to as the second part 82.

The first part 81 of the specific enclosing part 80 includes a base part 81*a* that is horizontally disposed along the boundary part 151 between the first main surface part 21*a* and the bottom gusset 23, and laid across the first adjoining part 84, the intermediate extending part 83 and the second adjoining part 85; and a projection part 81*b* which is a part of the intermediate extending part 83, and protrudes out from the base part 81*a* and away from the bottom gusset 23 (that is, projects upward out from the base part 81*a*).

The left end of the base part 81*a* of the specific enclosing part 80 (left end of the first adjoining part 84) is connected to the lower end part of the first peripheral enclosing part 41 on the front side, meanwhile the right end of the base part 81*a* of the specific enclosing part 80 (right end of the second adjoining part 85) is connected to the lower end part of the second peripheral enclosing part 42 on the front side. Hence, the first peripheral enclosing part 41 on the front side and the second peripheral enclosing part 42 on the front side communicate with each other, while placing the base part 81*a* of the first part 81 of the specific enclosing part 80 in between.

Similarly, the first part 81 of the second specific enclosing part 800 includes a base part 81*a* that is horizontally disposed along the boundary part 151 between the second main surface part 21*b* and the bottom gusset 23, and laid across the first adjoining part 84, the intermediate extending part 830 and the second adjoining part 85; and a projection part 81*b* which is a part of the second intermediate extending part 830, and protrudes out from the base part 81*a* and away from the bottom gusset 23 (that is, projects upward out from the base part 81*a*).

The left end of the base part 81*a* of the second specific enclosing part 800 (left end of the first adjoining part 84) is connected to the lower end part of the first peripheral enclosing part 41 on the rear side, meanwhile the right end of the base part 81*a* of the second specific enclosing part 800 (right end of the second adjoining part 85) is connected to the lower end part of the second peripheral enclosing part 42 on the rear side. Hence, the first peripheral enclosing part 41 on the rear side and the second peripheral enclosing part 42 on the rear side communicate with each other, while placing the base part 81*a* of the first part 81 of the second specific enclosing part 800 in between.

Since the container body 20 is designed to have the intermediate extending part 83 laid across the first surface-like part and the second surface-like part, the container body 20 is given the force which is exerted in the direction of expansion of the boundary part 151 between the first surface-like part and the second surface-like part (that is, the force which drives the first surface-like part and the second surface-like part to align in the same plane), by the force of the intermediate extending part 83 trying to flatten. In this way, the container body 20 will be bulged outward of the container body 20 at the central part of the first surface-like part. Hence, the container body 20 will have an increased capacity of the inner space, as compared with the container body 20 having no intermediate extending part 83.

In particular, since the intermediate extending part 83 extends more further from the second surface-like part than the first adjoining part 84 and the second adjoining part 85 extend, it is possible to sufficiently ensure the bulging of the central part of the first main surface portion 21*a*.

In addition, since the film regions are individually disposed adjoining both sides of the end part of the intermediate extending part 83 in the extending direction thereof, the intermediate extending part 83 can more efficiently allow the first main surface part 21*a* to bulge at the central part.

Therefore, the capacity of the sheet container 100 can be sufficiently secured.

Similarly, since the container body 20 is designed to have the second intermediate extending part 830 laid across the first surface-like part and the third surface-like part, the container body 20 is given the force which is exerted in the direction of expansion of the boundary part 151 between the third surface-like part and the second surface-like part (that is, the force which drives the third surface-like part and the second surface-like part to align in the same plane), by the force of the second intermediate extending part 830 trying to flatten. In this way, the container body 20 will be bulged outward of the container body 20 at the central part of the third surface-like part. Hence, the container body 20 will have an increased capacity of the inner space, as compared with the container body 20 having no second intermediate extending part 830.

In particular, since the second intermediate extending part 830 extends more further from the second surface-like part than the first adjoining part 84 and the second adjoining part 85 extend, it is possible to sufficiently ensure the bulging of the central part of the second main surface portion 21*b*.

In addition, since the film regions are individually disposed adjoining both sides of the end part of the second intermediate extending part 830 in the extending direction thereof, the second intermediate extending part 830 can more efficiently allow the second main surface part 21*b* to bulge at the central part.

Therefore, the capacity of the sheet container 100 can be sufficiently secured.

As described above, the plurality of surface-like parts include the third surface-like part (second main surface part 21*b*) which is opposed to the first surface-like part (first main surface part 21*a*) while placing the accommodating area 20*a* in between; the container body 20 has a trunk 21 that includes the first surface-like part and the third surface-like part, and the bottom (bottom gusset part 23) composed of the second surface-like part; the trunk 21 has the first peripheral part 28*a* and the second peripheral part 28*b,* each extending from the boundary part 151 side towards the opposite end 152 side, and being arranged side by side; the first surface-like part and the third surface-like part are mutually connected at each of the first peripheral part 28*a* and the second peripheral part 28*b;* a portion of the filler enclosing part, located in the first surface-like part, is preferably formed symmetrically (in this embodiment, symmetrically in the front-rear direction) about a portion of the filler enclosing part located in the third surface-like part; a portion of the filler enclosing part, located in a half area on the first surface-like part side of the bottom (bottom gusset part 23), is preferably formed symmetrically (in this embodiment, symmetrically in the front-rear direction) about a portion of the filler enclosing part, located in a half area on the third surface-like part side; and, a central part 201 (FIG. 12) of the first surface-like part, which falls between the first peripheral part 28*a* and the second peripheral part 28*b,* and a central part 202 (FIG. 12) of the third surface-like part, which falls between the first peripheral part 28*a* and the second peripheral part 28*b,* are bulged in opposite directions to each other.

Therefore, the capacity of the sheet container 100 can be sufficiently secured.

The first peripheral enclosing part 41 and the second peripheral enclosing part 42 on the front side extend towards the opposite end 152 side, more further than the intermediate extending part 83 extends.

That is, the first surface-like part (first main surface part 21*a*) has the first peripheral part 28*a* and the second peripheral part 28*b,* each extending from the boundary part 151 side towards the opposite end 152 side, and being arranged side by side; the first adjoining part 84 is disposed between the intermediate extending part 83 and the first peripheral part 28*a;* the second adjoining part 85 is disposed between the intermediate stretched 83 part and the second peripheral part 28*b;* the filler enclosing part comprises: a first peripheral enclosing part 41 that extends from one end on the first peripheral part 28*a* side of the first adjoining part 84 towards the opposite end 152, along the first peripheral part 28*a;* and a second peripheral enclosing part 42 that extends from one end on the second peripheral part 28*b* side of the second adjoining part 85 towards the opposite end 152, along the second peripheral part 28*b;* and, the shortest distance from the opposite end 152 to the end 83*a* of the intermediate extending part 83 on the opposite end 152 side is longer than the shortest distance from the opposite end 152 to the ends 41*b,* 42*b* of the first peripheral enclosing part 41 and the second peripheral enclosing part 42 on the opposite end 152 side.

Similarly, also the first peripheral enclosing part 41 and the second peripheral enclosing part 42 on the rear side extend towards the opposite end 152 side, more further than the second intermediate extending part 830 extends.

In this embodiment, the transverse width of the projection part 81*b* is maximized at the lower end part of the projection part 81*b*.

That is, a portion (first part 81) of the filler enclosing part, which falls on the first surface-like part (first main surface part 21*a*), has a base part 81*a* that is disposed along the boundary part 151, and laid across the first adjoining part 84, the intermediate extending part 83 and the second adjoining part 85; and a projection part 81*b,* which is a part of the intermediate extending part 83, and protrudes out from the base part 81*a* and away from the boundary part 151; and, the width dimension of the projection part 81*b* in the direction parallel to the boundary part 151 is maximized at the end part on the base part 81*a* side of the projection part 81*b*.

In this embodiment, the projection part 81*b* is formed into a chevron shape with the transverse width made narrower as being farther from the base part 81*a*.

That is, the projection part 81*b* is formed into a chevron shape in which the width dimension of the projection part 81*b* in the direction parallel to the boundary part 151 becomes narrower as being farther from the base part 81*a*.

In this embodiment, the upper end part of the projection part 81*b* is rounded, for example.

In this embodiment, the distance, from the bottom gusset 23 to the end 83*a* of the intermediate extending part 83 in the extending direction of the intermediate extending part 83, is equal to or less than a half of the distance from the bottom gusset 23 to the opposite end 152. That is, the height of the first part 81 is equal to or less than a half of the height of the first main surface part 21*a*.

Similarly, the distance, from the bottom gusset 23 to the end 830*a* of the second intermediate extending part 830 in the extending direction of the second intermediate extending part 830, is equal to or less than a half of the distance from the bottom gusset 23 to the opposite end 152.

The transverse direction enclosing part 46 is disposed at the central part of the trunk 21 in the transverse direction, in an upper part of the trunk 21.

The container body 20 has a pair of front and rear transverse direction enclosing parts 46. That is, the transverse direction enclosing part 46 are individually formed in each of the first main surface part 21*a* and the second main surface part 21*b*.

The front transverse direction enclosing part 46 is disposed in a region of the first main surface part 21*a* on the opposite end 152 side thereof (that is, an upper part of the first main surface part 21*a*), and extends from the first peripheral part 28*a* towards the second peripheral part 28*b* (that is, in the transverse direction).

Similarly, the rear transverse direction enclosing part 46 is disposed in a region of the second main surface part 21*b* on the opposite end 152 side thereof (that is, an upper part of the second main surface part 21*b*), and extends from the first peripheral part 28*a* towards the second peripheral part 28*b*.

The left end of each transverse direction enclosing part 46 is connected to the upper part of the first peripheral enclosing part 41, and the right end of each transverse direction enclosing part 46 is connected to the upper part of the second peripheral enclosing part 42.

That is, the front first peripheral enclosing part 41 communicates with the front second peripheral enclosing part 42 through the front transverse direction enclosing part 46, and, the rear first peripheral enclosing part 41 communicates with the rear second peripheral enclosing part 42 through the rear transverse direction enclosing part 46.

In the connection part 46*a* (crossing part) of the first peripheral enclosing part 41 and the transverse direction enclosing part 46, the transverse direction enclosing part 46 is thinner than the first peripheral enclosing part 41. That is, width w2 given in FIG. 1 is smaller than width w2.

Here, point P11 given in FIG. 1 represents a corner on the inner lane side of the connection part 46*a* (crossing part) between the first peripheral enclosing part 41 and the transverse direction enclosing part 46. Width w1 represents a minimum width (distance between point P11 and point P12) of the first peripheral enclosing part 41 originated from point P11, and, width w2 is a minimum width (distance between point P11 and point P13) of the transverse direction enclosing part 46 originated from point P11.

When the corner on the inner lane side of the connection part 46*a* (crossing part) between the first peripheral enclosing part 41 and the transverse direction enclosing part 46 is rounded, the point P11 will be ambiguous. In such a case, width w1 is given by a minimum width of the first peripheral enclosing part 41 in the vicinity of the connection part 46*a*, meanwhile width w2 is given by a minimum width of the transverse direction enclosing part 46 in the vicinity of the connection part 46*a*.

Similarly, in the connection part 46*a* (crossing part) of the second peripheral enclosing part 42 and the transverse direction enclosing part 46, the transverse direction enclosing part 46 is thinner than the second peripheral enclosing part 42.

As described above, the first surface-like part (first main surface part 21*a*) has the first peripheral part 28*a* and the second peripheral part 28*b*, each extending from the boundary part 151 side towards the opposite end 152 side, and being arranged side by side; the first adjoining part 84 is disposed between the intermediate extending part 83 and the first peripheral part 28*a*; the second adjoining part 85 is disposed between the intermediate extending part 83 part and the second peripheral part 28*b*; the filler enclosing part comprises: a first peripheral enclosing part 41 that extends from one end on the first peripheral part 28*a* side of the first adjoining part 84 towards the opposite end 152, along the first peripheral part 28*a*; and a second peripheral enclosing part 42 that extends from one end on the second peripheral part 28*b* side of the second adjoining part 85 towards the opposite end 152, along the second peripheral part 28*b*; and the transverse direction enclosing part 46 that extends, in a region of the first surface-like part on the opposite end 152 side, from the first peripheral part 28*a* towards the second peripheral part 28*b*, so as to mutually connect the first peripheral enclosing part 41 and the second peripheral enclosing part 42; and, the transverse direction enclosing part 46 is thinner than the first peripheral enclosing part 41, in the connection part 46*a* of the first peripheral enclosing part 41 and the transverse direction enclosing part 46.

Similarly, in the first surface-like part (first main surface part 21*a*), the transverse direction enclosing part 46 is thinner than the second peripheral enclosing part 42, in the connection part 46*a* between the second peripheral enclosing part 42 and the transverse direction enclosing part 46.

Also in the third surface-like part (second main surface part 21*b*), the transverse direction enclosing part 46 is thinner than the first peripheral enclosing part 41, in the connection part 46*a* between the first peripheral enclosing part 41 and the transverse direction enclosing part 46; and, the transverse direction enclosing part 46 is thinner than the second peripheral enclosing part 42, in the connection part 46*a* between the second peripheral enclosing part 42 and the transverse direction enclosing part 46.

The transverse direction enclosing part 46 is, for example, formed into an inverted V-shape whose height position is highest at the central part thereof in the transverse direction, and is lower at both lateral ends thereof. In short, each of the upper edge and the lower edge of the transverse direction enclosing part 46 is convex upward.

As described above, an edge part on the opposite end 152 side of the projection part 81*b* has a convex shape toward the opposite end 152 side, and the transverse direction enclosing part 46 has a convex curved shape toward the opposite end 152 side.

With such design, sufficient bulging of the trunk 21 in the front-rear direction of the sheet container 100 can be realized, and the capacity of the container body 20 can be sufficiently secured.

Each of the first peripheral enclosing part 41 and the second peripheral enclosing part 42 extends, for example, above the connection part 46*a* of the first peripheral enclosing part 41 or the second peripheral enclosing part 42, with the transverse direction enclosing part 46.

Also the filler enclosing part 45 is disposed across the bottom gusset 23 and the trunk 21.

A part of the filler enclosing part 45, disposed on the trunk 21 side, will be referred to as a first part 451, meanwhile a part thereof disposed on the bottom gusset 23 will be referred to as a second part 452.

The container body 20 has a pair of left and right filler enclosing parts 45.

The left filler enclosing part 45 is disposed between the lower part 41*a* of the front first peripheral enclosing part 41, and lower part 41*a* of the rear first peripheral enclosing part 41.

Figure 4:
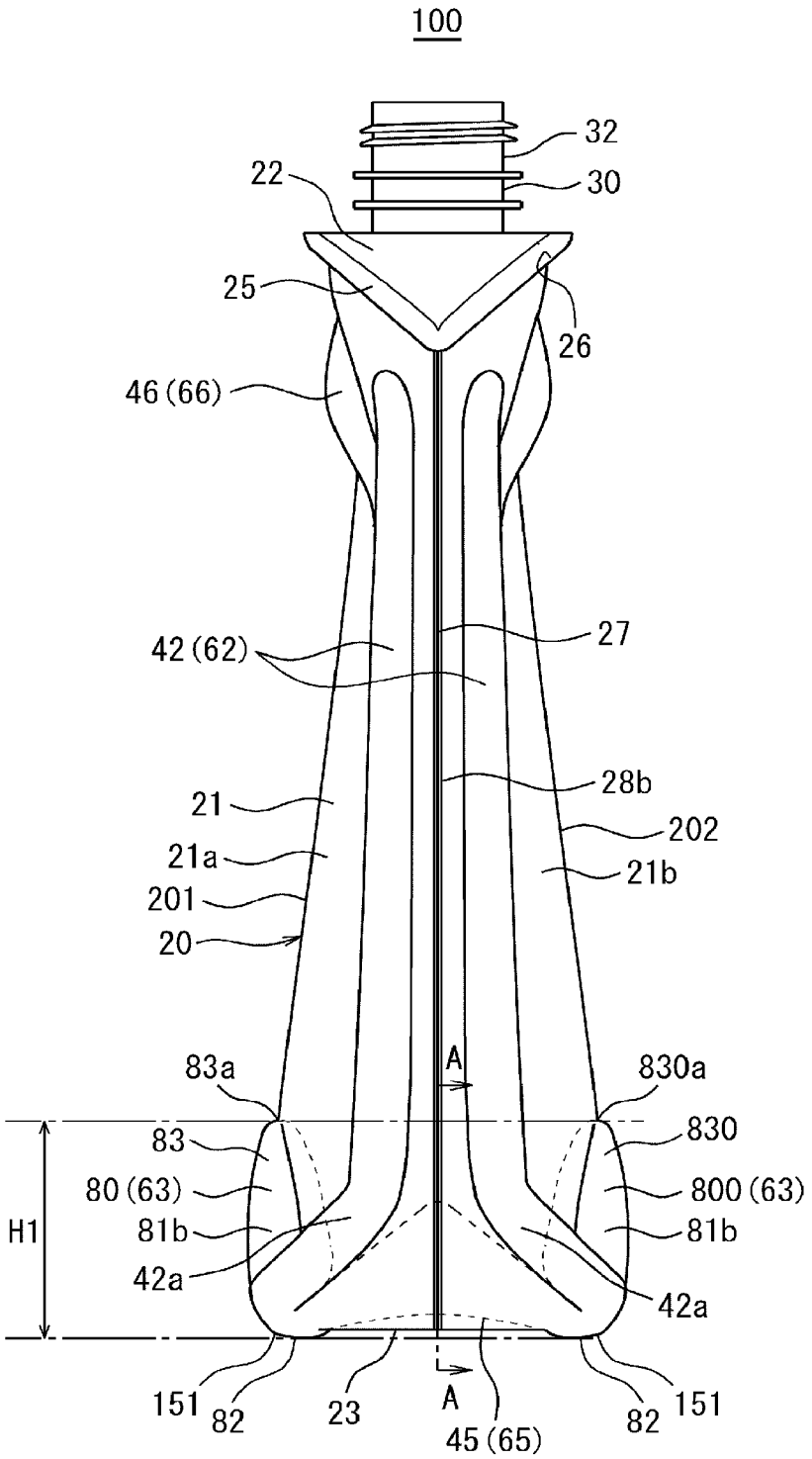
FIG. 4 is a right side elevation illustrating the sheet container of the first embodiment.

The right filler enclosing part 45 is disposed between the lower part 42*a* of the front second peripheral enclosing part 42, and the lower part 42*a* of the rear second peripheral enclosing part 42 (FIG. 4).

Each filler enclosing part 45 has, for example, a chevron shape whose degree of protrusion becomes larger towards the center in the front-rear direction.

The lower end part of the left filler enclosing part 45 is connected to each of the left end of the lower end part of the specific enclosing part 80, and the left end of the lower end part of the second specific enclosing part 800.

Similarly, the lower end part of the right filler enclosing part 45 is connected to each of the right end of the lower end part of the specific enclosing part 80, and the right end of the lower end part of the second specific enclosing part 800.

Hence, the specific enclosing part 80 communicates with the second specific enclosing part 800, through the left filler enclosing part 45, and also through the right filler enclosing part 45.

Figure 5A:
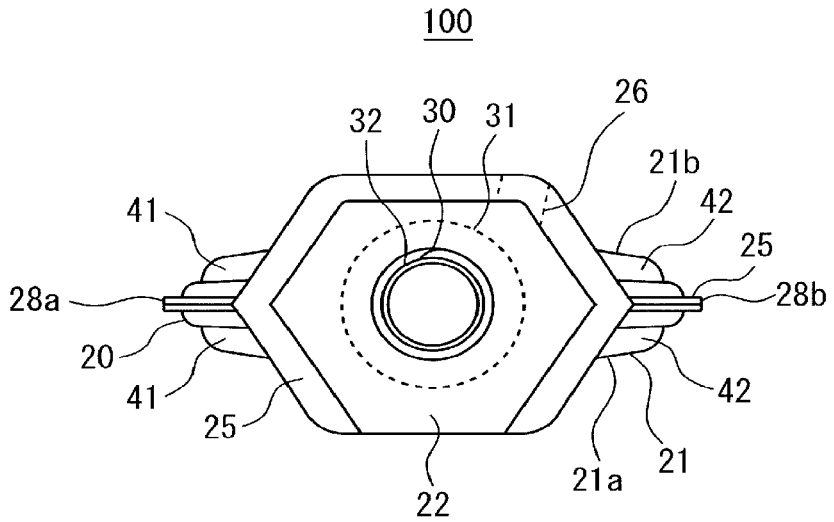
FIG. 5(*a*) is a plan view illustrating the sheet container of the first embodiment, and FIG. 5(*b*) is a bottom view illustrating the sheet container of the first embodiment.
Figure 5B:
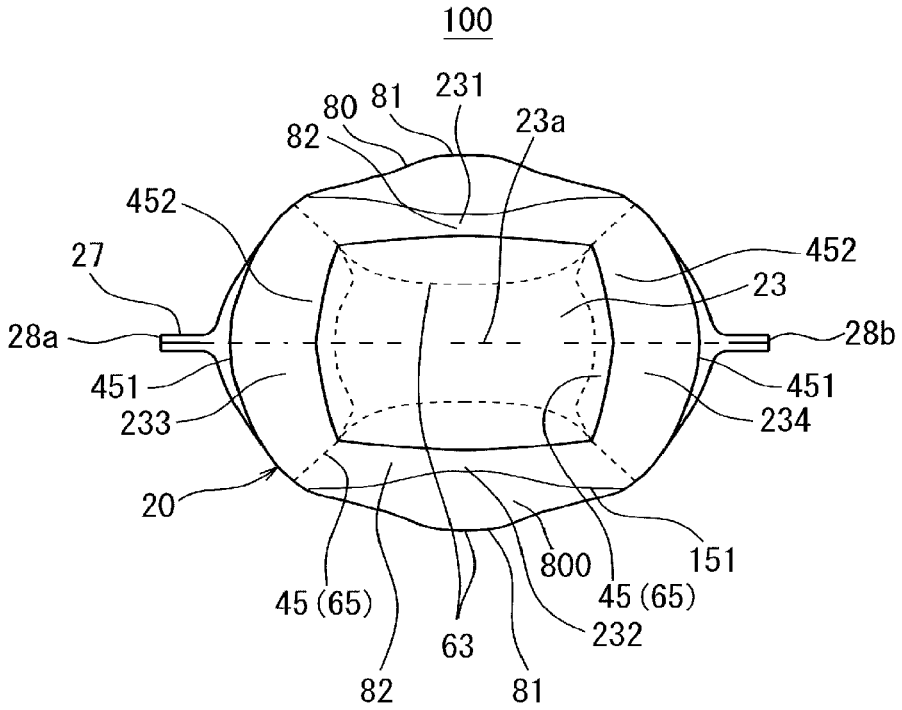

Here, as illustrated in FIG. 5(*b*), the bottom gusset 23 is formed into a shape (for example, near rectangular shape) having a first bottom peripheral part 231, a second bottom peripheral part 232 opposed to the first bottom peripheral part 231, a third bottom peripheral part 233 disposed between one end of the first bottom peripheral part 231 and one end of the second bottom peripheral part 232, and a fourth bottom peripheral part 234 opposed to the third bottom peripheral part 233.

The intermediate extending part 83 is disposed across the first bottom peripheral part 231 and the trunk 21, the second intermediate extending part 830 is disposed across the second bottom peripheral part 232 and the trunk 21, the one filler enclosing part 45 is disposed across the third bottom peripheral part 233 and the trunk 21, and the other filler enclosing part 45 is disposed across the fourth bottom peripheral part 234 and the trunk 21.

The pair of left and right filler enclosing parts 45 are opposed to each other while placing the lower end part of the accommodating area 20*a* in between.

The bottom gusset 23 includes a bulge 23*a* (see FIG. 5(*b*)) having a raised shape convex upward.

As described above, the plurality of surface-like parts of the container body 20 include the third surface-like part (second main surface part 21*b*) which is opposed to the first surface-like part (first main surface part 21*a*) while placing the accommodating area 20*a* in between; the container body 20 has the trunk 21 that includes the first surface-like part and the third surface-like part, and the bottom (bottom gusset part 23) composed of the second surface-like part; the trunk 21 has the first peripheral part 28*a* and the second peripheral part 28*b*, each extending from the boundary part 151 side towards the opposite end 152 side, and being arranged side by side; the first surface-like part and the third surface-like part are mutually connected at each of the first peripheral part 28*a* and the second peripheral part 28*b*; the bottom is formed into the shape having the first bottom peripheral part 231, the second bottom peripheral part 232 opposed to the first bottom peripheral part 231, the third bottom peripheral part 233 disposed between one end of the first bottom peripheral part 231 and one end of the second bottom peripheral part 232, and the fourth bottom peripheral part 234 opposed to the third bottom peripheral part 233; the filler enclosing part includes: the intermediate extending part 83 laid across the first bottom peripheral part 231 and the first surface-like part; the second intermediate extending part 830 that is disposed symmetrically (in this embodiment, symmetrically in the front-rear direction) to the intermediate extending part 83, and laid across the second bottom peripheral part 232 and the third surface-like part; the first side bottom enclosing part (one filler enclosing part 45) laid across the third bottom peripheral part 233 and the trunk 21; and the second side bottom enclosing part (the other filler enclosing part 45) laid across the fourth bottom peripheral part 234 and the trunk 21, and is opposed to the first side bottom enclosing part.

Figure 13:
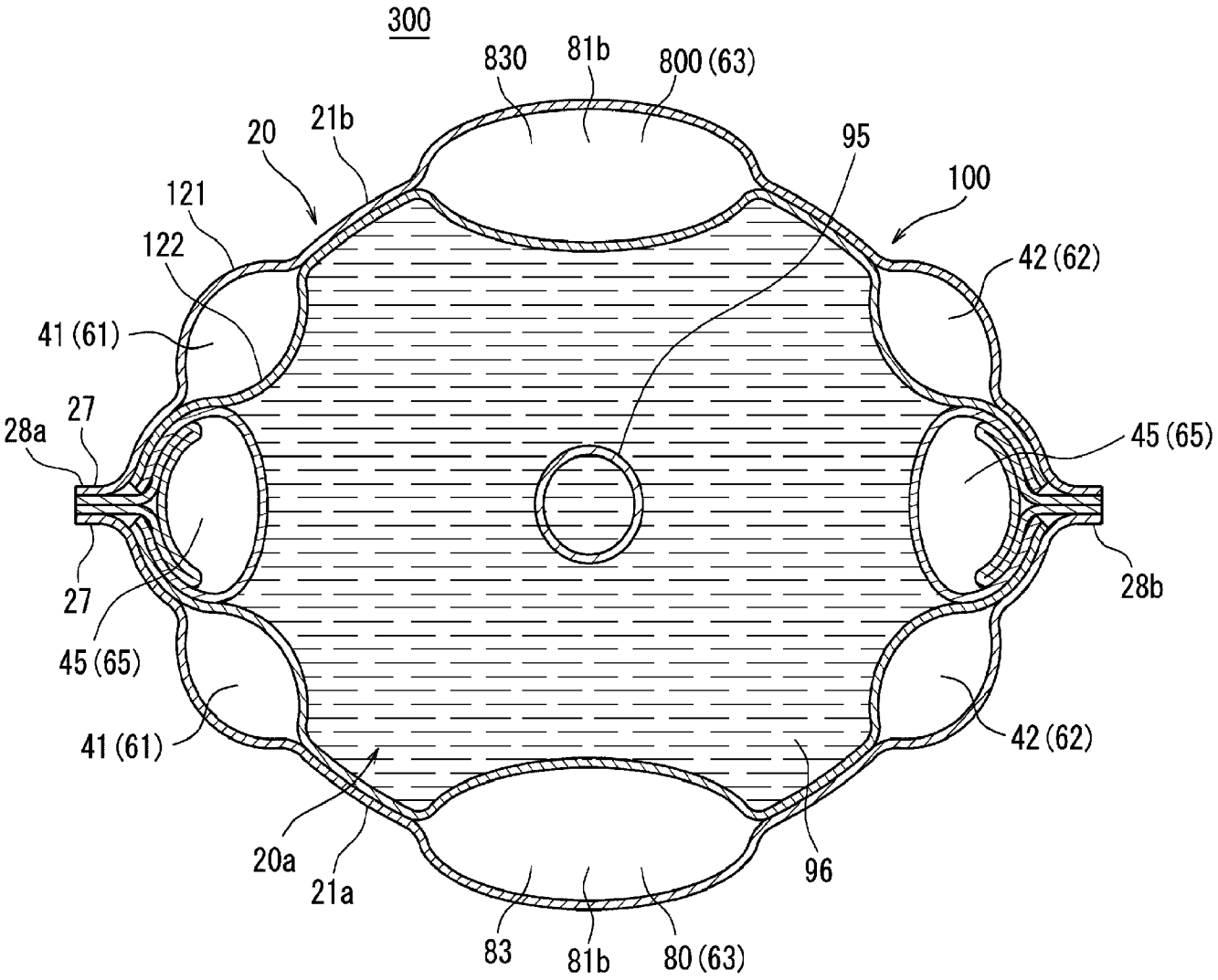
FIG. 13 is a plane cross sectional view (cross sectional view taken along line B-B in FIG. 11) illustrating a packed article in sheet container of the first embodiment.
Figure 14:
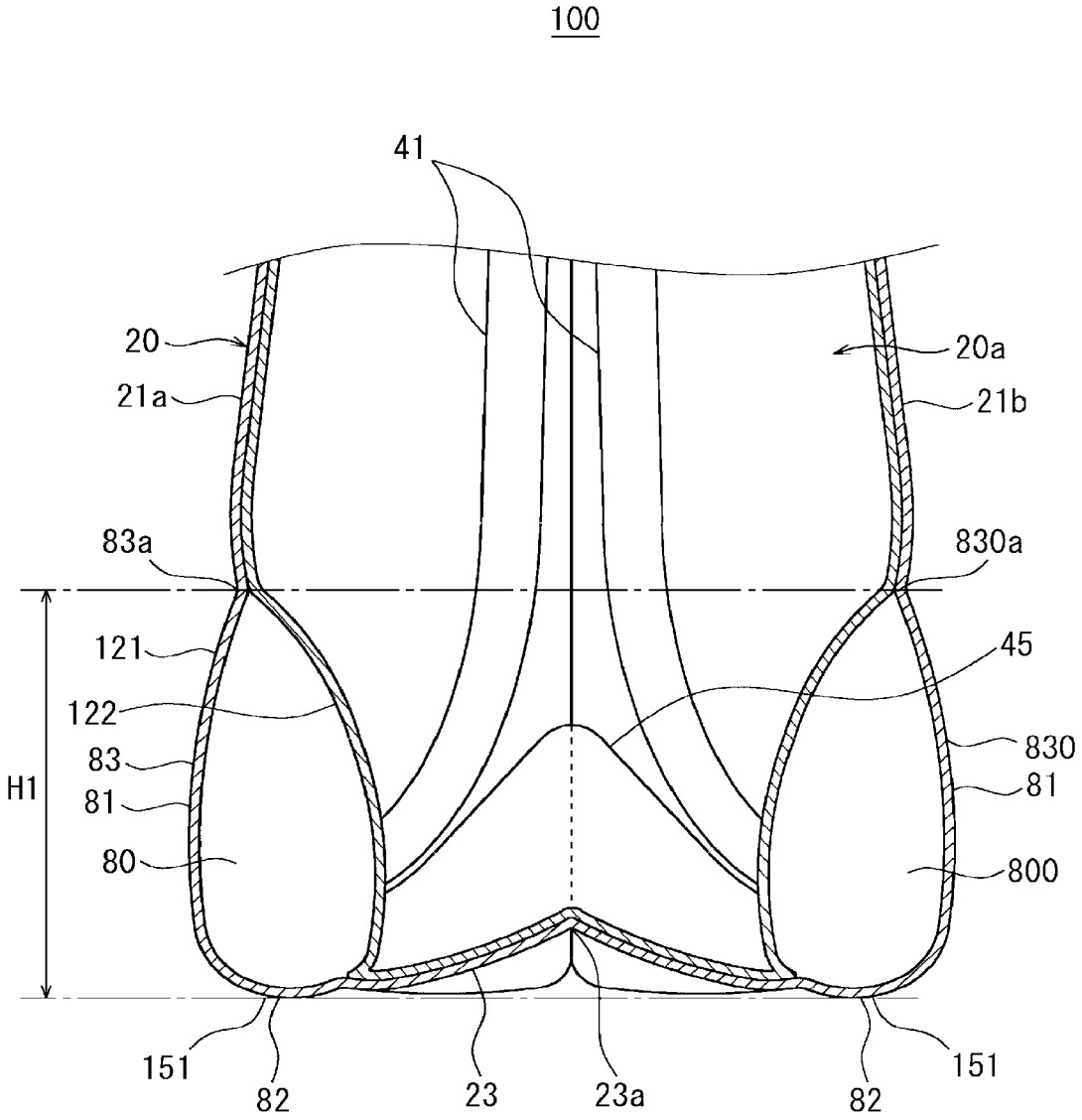
FIG. 14 is a side cross sectional view (cross sectional view taken along line B-B in FIG. 2) illustrating a lower part of the sheet container of the first embodiment.
Figure 15:
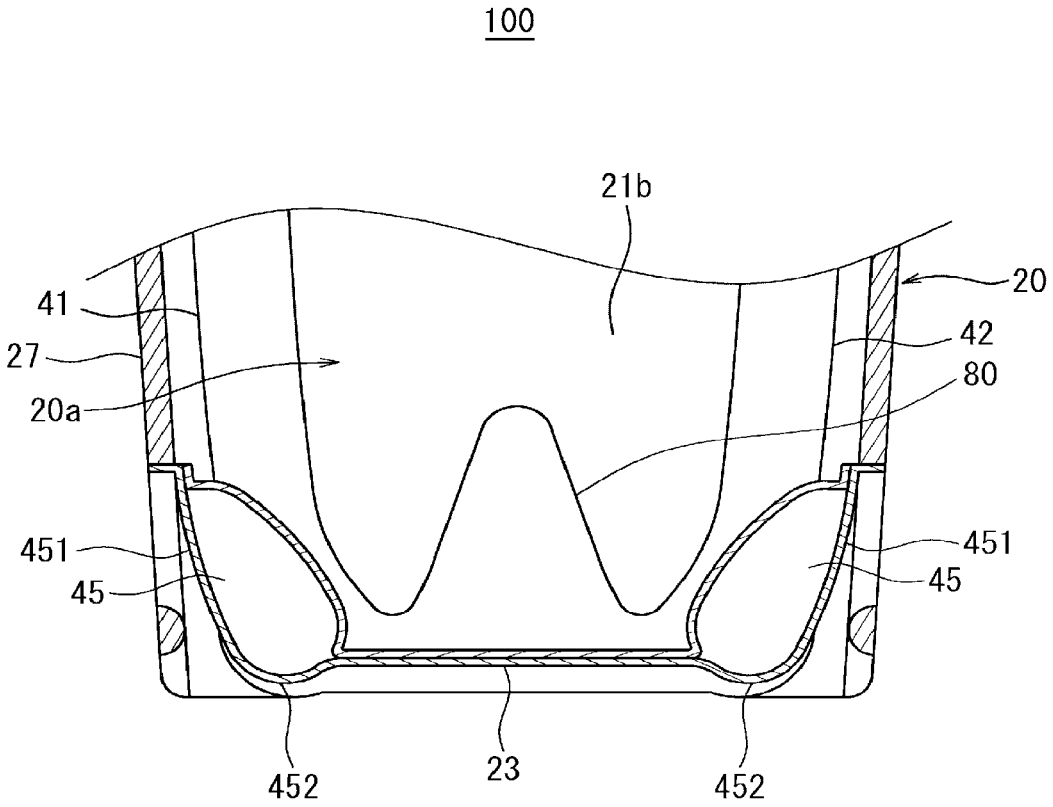
FIG. 15 is a frontal cross sectional view (cross sectional view taken along line A-A in FIG. 4) illustrating the lower part of the sheet container of the first embodiment.

Hence, the force is applied to four portions, adjoining the bottom (bottom gusset 23), of the trunk 21 so as to expand each portion outwardly, and thereby the capacity of the container body 20 can be more sufficiently secured (see FIG. 13, FIG. 14 and FIG. 15).

An aggregate of the second part 82 of the specific enclosing part 80 falling on the bottom gusset 23, the second part 82 of the second specific enclosing part 800 falling on the bottom gusset 23, and the second parts 452 of the left and right filler enclosing parts 45 falling on the bottom gusset 23, are arranged annularly, as illustrated in FIG. 5(*b*), along the circumference the bottom gusset 23.

As shown in FIG. 3, the filler enclosing part 47 is, for example, connected to the upper part of the rear transverse direction enclosing part 46, and extends from the transverse direction enclosing part 46 towards the outer edge of the second main surface part 21*b*.

In this embodiment, all filler enclosing parts owned by the sheet container 100 communicate with each other.

The filler enclosing part is sealed at a closure part 26 (FIG. 5(*a*)) that adjoins the end part of the filler enclosing part 47.

The filler may be fluid (gas or liquid), solid (for example, particulate, resin pellet, etc.) or semi-solid (for example, foam material, etc.), and is preferably a gas such as air.

Next, an exemplary layer structure of each of the first film layer 121 and the second film layer 122 that compose the container body-forming sheet member 120 will be explained.

Figure 6B:
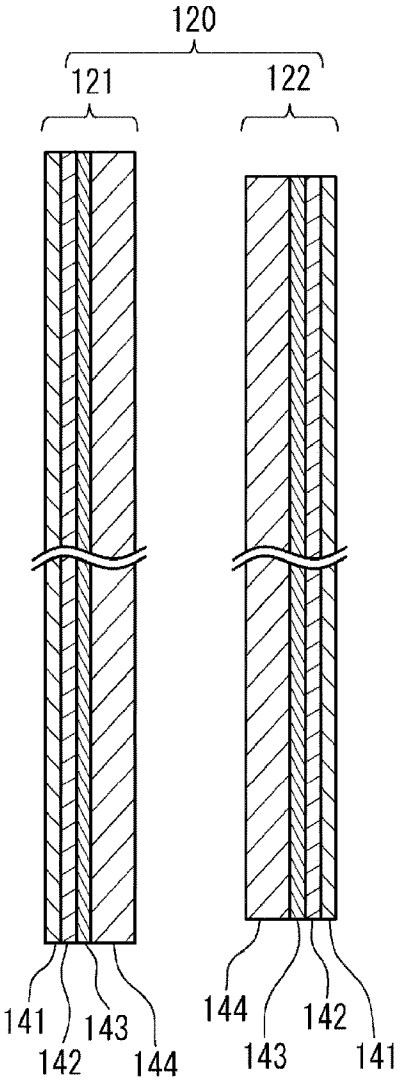
FIG. 6(*a*) is an exploded view (plan view) illustrating a container body-forming sheet member that composes the container body of the sheet container of the first embodiment, and FIG. 6(*b*) is an exploded view (cross sectional view) illustrating the container body-forming sheet member that composes the container body of the sheet container of the first embodiment.
Figure 6A:
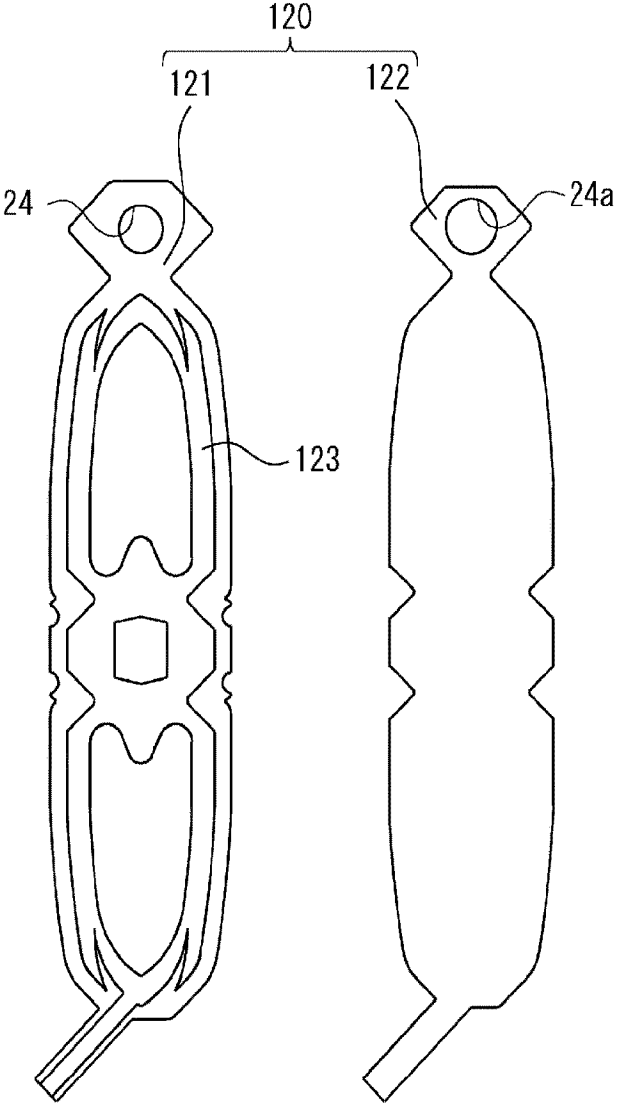

The first film layer 121 is a film layer that composes the outer surface side of the container body 20. As illustrated in FIG. 6(*b*), the first film layer 121 is formed by laminating, for example, a first layer 141, a second layer 142, a third layer 143 and a fourth layer 144 in this order.

The first layer 141 is made, for example, of polyethylene terephthalate (PET) or oriented nylon (ONy).

The second layer 142 is, for example, a transparent evaporated PET layer made of polyethylene terephthalate, with silica and alumina vapor-deposited on one surface thereof (the surface on the side of the first layer 141).

The third layer 143 is, for example, made of oriented nylon.

The fourth layer 144 is, for example, made of linear low-density polyethylene (LLDPE).

Although the thickness of these layers is not specifically limited, the first layer 141 may be 12 μm thick, the second layer 142 may be 12 μm thick, the third layer 143 may be 15 μm thick, and the fourth layer 144 may be 40 μm, for example.

Major function of the first layer 141 is exemplified by provision of glossiness and printability of the container body 20, as well as provision of rigidity of the container body 20.

Major function of the second layer 142 is exemplified by provision of gas barrier performance.

Major function of the third layer 143 is exemplified by provision of pinhole resistance.

Major function of the fourth layer 144 is exemplified by provision of heat sealability with the second film layer 122, and heat sealability between the parts of the first film layers 121.

The second film layer 122 is a film layer that composes the inner surface side of the container body 20.

The layer structure employable in the second film layer 122 may be same as that in the first film layer 121.

However, materials for composing the first film layer 121 and the second film layer 122 are not limited to those exemplified above.

The second film layer 122 may have a layer structure different from that in the first film layer 121.

For example, a linear low-density polyethylene (LLDPE) layer, same as that composing the fourth layer 144, may be provided as the outermost first layer 141. With such layer structure, the parts of the second film layers 122 may be heat-sealed at the sealed part 27.

A container body-forming sheet member 120 is formed by stacking the first film layer 121 and the second film layer 122, and then attaching them to each other (for example, by heat sealing).

That is, the first film layer 121 and the second film layer 122 are stacked, so that the fourth layer 144 of the first film layer 121 is faced to the fourth layer 144 of the second film layer 122. While keeping this arrangement, the first film layer 121 and the second film layer 122 are mutually pressurized and heated, whereby the fourth layer 144 of the first film layer 121 and the fourth layer 144 of the second film layer 122 are heat-sealed to each other. The container body-forming sheet member 120 is formed in this way (see FIG. 7(*a*), FIG. 7(*b*)).

For example, in at least one or both of the first film layer 121 and the second film layer 122, a non-attaching part 123 (FIG. 6(*a*)) having been subjected to non-attaching treatment is formed on the surface(s) facing the other, so as to the first film layer 121 and the second film layer 122 (the fourth layer 144 of the first film layer 121 and the fourth layer 144 of the second film layer 122) will left partially unattached to each other, and thereby, the non-attached parts 61, 62, 63, 65, 66, 67, and 68 will be formed as illustrated in FIG. 7(*a*). The non-attaching part 123 may easily be formed by coating a non-attaching agent (adhesion inhibitor) to a corresponded part and setting it in an adhesion inhibited state. The adhesion inhibitor may freely be selectable from those capable of inhibiting attaching between the first film layer 121 and the second film layer 122. As the adhesion inhibitor, suitably employable are printing inks used for offset printing, flexographic printing and letterpress printing; medium ink; and dedicated adhesion inhibition ink. Also thermosetting or UV-curable ink may suitably be used.

Area of formation of the non-attaching part 123 will be the non-attached parts (non-attached parts 61, 62, 63, 65, 66, 67, 68).

Of the non-attached parts, each non-attached part 61 corresponds to the each first peripheral enclosing part 41, each non-attached part 62 corresponds to each second peripheral enclosing part 42, one non-attached part 63 corresponds to the specific enclosing part 80, the other non-attached part 63 corresponds to the second specific enclosing part 800, each non-attached part 65 corresponds to each filler enclosing part 45, each non-attached part 66 corresponds to each transverse direction enclosing part 46, and the non-attached part 67 corresponds to the filler enclosing part 47. The non-attached part 68 will serve as an introducing part through which the filler is introduced into each of the non-attached parts.

As illustrated in FIG. 8, the one non-attached part 63 has an intermediate extending part-forming part 630 that corresponds to the intermediate extending part 83, a first adjoining part-forming part 631 that corresponds to the first adjoining part 84, and a second adjoining part-forming part 632 that corresponds to the second adjoining part 85. Also the other non-attached part 63 is composed in the same way as the one non-attached part 63, and has an intermediate extending part-forming part that corresponds to the second intermediate extending part 830, a first adjoining part-forming part that corresponds to the first adjoining part 84, and a second adjoining part-forming part that corresponds to the second adjoining part 85.

With the filler introduced through the non-attached part 68 and enclosed in the non-attached parts 61, 62, 63, 65, 66, 67, the first film layer 121 and the second film layer 122 are then attached at the boundary part between the non-attached part 68 and the non-attached part 67, thereby, the closure part 26, as well as each of the filler enclosing parts (first peripheral enclosing part 41, second peripheral enclosing part 42, specific enclosing part 80, second specific enclosing part 800, filler enclosing part 45, transverse direction enclosing part 46, filler enclosing part 47) are formed.

Method for forming the non-attached parts 61, 62, 63, 65, 66, 67, 68 between the first film layer 121 and the second film layer 122 is not limited to the method exemplified above. For example, a die used for heat sealing of the first film layer 121 and the second film layer 122 may have formed therein a recess (groove) in an area corresponded to the non-attached parts 61, 62, 63, 65, 66, 67, 68. Alternatively, the first film layer 121 and the second film layer 122 may be heat-sealed, while placing therebetween a spacer layer composed of a non-heat sealable material (for example, resin layer such as PET layer).

As illustrated in FIG. 7(*a*), the first film layer 121 is formed slightly larger than the second film layer 122, and protrudes around the periphery of the second film layer 122. In other words, as illustrated in FIG. 7(*b*), in the peripheral part of the container body-forming sheet member 120, the fourth layer 144 of the first film layer 121 exposes.

In a part of the first film layer 121 used for composing the top gusset 22, there is formed the opening 24 through which the cylinder part 32 of the spout 30 is inserted (FIG. 6(*a*)). Meanwhile, in a part of the second film layer 122 used for composing the top gusset 22, there is formed the opening 24*a* which is slightly larger than the opening 24 (FIG. 6(*a*)). Hence, the fourth layer 144 of the first film layer 121 exposes around the circumference of the opening 24, and, inside of the opening 24*a* (see FIG. 7(*a*)).

As illustrated in FIG. 8, a container-forming sheet 400 is formed by providing the spout 30 to the container body-forming sheet member 120.

Here, the base part 31 of the spout 30 is fixed to the fourth layer 144 of the first film layer 121 of the container body-forming sheet member 120, at around the opening 24 and to the inner part of the opening 24*a*.

As illustrated in FIG. 8, the container-forming sheet 400 includes a first main surface sheet part 51, a second main surface sheet part 52, a first bottom gusset sheet part 53, a second bottom gusset sheet part 54 and a top gusset sheet part 55, which will be explained in turn below.

The first main surface sheet part 51 composes the first main surface part 21*a*. The first main surface sheet part 51 includes a top gusset attaching part 56.

The second main surface sheet part 52 composes the second main surface part 21*b*. The second main surface sheet part 52 includes a top gusset attaching part 57.

The first bottom gusset sheet part 53 and the second bottom gusset sheet part 54 compose the bottom gusset 23 of the container body 20.

The top gusset sheet part 55 composes the bottom gusset 23 of the container body 20.

Among these, the top gusset sheet part 55 is formed, for example, into a hexagonal shape (in more detail, a laterally oblong hexagonal shape).

The first main surface sheet part 51 shares one side with the top gusset sheet part 55, and is connected to the lower side of the top gusset sheet part 55 in FIG. 8.

A part of the first main surface sheet part 51, located above an area along a folding line 74 illustrated in FIG. 8, is the top gusset attaching part 56. The top gusset attaching part 56 is formed, for example, into a trapezoidal shape with the upper base shorter than the lower base. Meanwhile, a part of the first main surface sheet part 51, located below an area along the folding line 74, is formed for example in a vertically oblong rectangular shape.

The first bottom gusset sheet part 53 is a part which composes the bottom gusset 23, together with the second bottom gusset sheet part 54. The first bottom gusset sheet part 53 and the second bottom gusset sheet part 54 have the same shape. Each of the first bottom gusset sheet part 53 and the second bottom gusset sheet part 54 has, for example, a laterally oblong rectangular shape. The transverse width of the first bottom gusset sheet part 53 and the second bottom gusset sheet part 54 is set equivalent to the transverse width of the lower end part of the first main surface sheet part 51.

In FIG. 8, the first bottom gusset sheet part 53 is connected to the lower side of the first main surface sheet part 51, meanwhile the second bottom gusset sheet part 54 is connected to the lower side of the first bottom gusset sheet part 53.

In FIG. 8, the second main surface sheet part 52 is connected to the lower side of the second bottom gusset sheet part 54.

A part of the second main surface sheet part 52, located blow an area along the folding line 74 shown in FIG. 8, is the top gusset attaching part 57.

The second main surface sheet part 52 is formed into a shape same as the first main surface sheet part 51.

However, for example, the second main surface sheet part 52 is provided integrally with a filler introducing part 29. The filler introducing part 29 has formed therein the non-attached part 68 that reaches the outer edge of the filler introducing part 29. The non-attached part 68 communicates with the non-attached part 67.

In the filler introducing part 29, the first film layer 121 and the second film layer 122 have the same size, so that the first film layer 121 is not protruded around the periphery of the second film layer 122. In other words, in the filler introducing part 29, the fourth layer 144 of the first film layer 121 is not exposed.

In FIG. 8, the base part 31 of the spout 30 is located on this side of the top gusset sheet part 55, and the cylinder part 32 projects through the top gusset sheet part 55 and comes out therefrom, towards the far side. The base part 31 may alternatively be disposed between the first film layer 121 and the second film layer 122.

Figure 9:
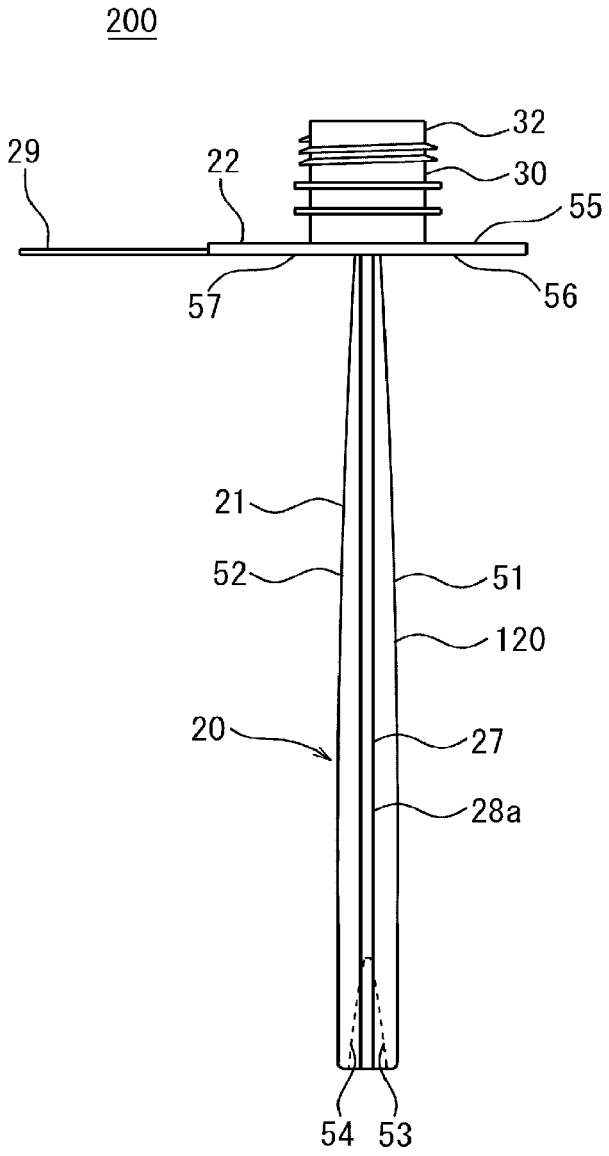
FIG. 9 is a side elevation illustrating a sheet for container of the first embodiment.
Figure 10B:
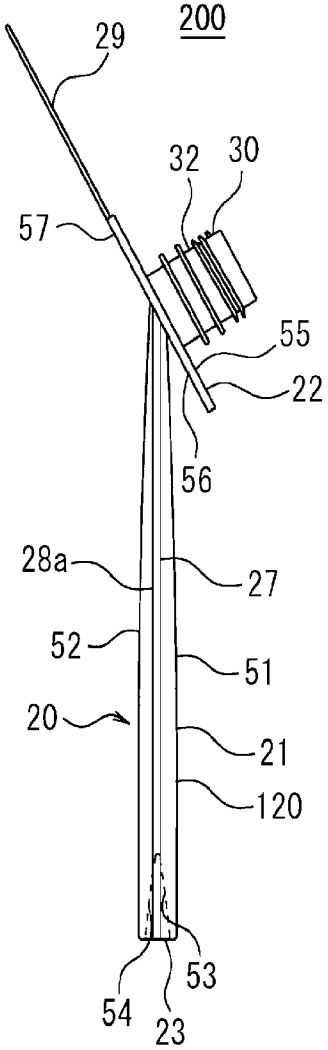
FIG. 10(*a*) is a front elevation illustrating a folded state of the sheet for container of the first embodiment, and FIG. 10(*b*) is a side elevation illustrating the folded state of the sheet for container of the first embodiment.
Figure 10A:
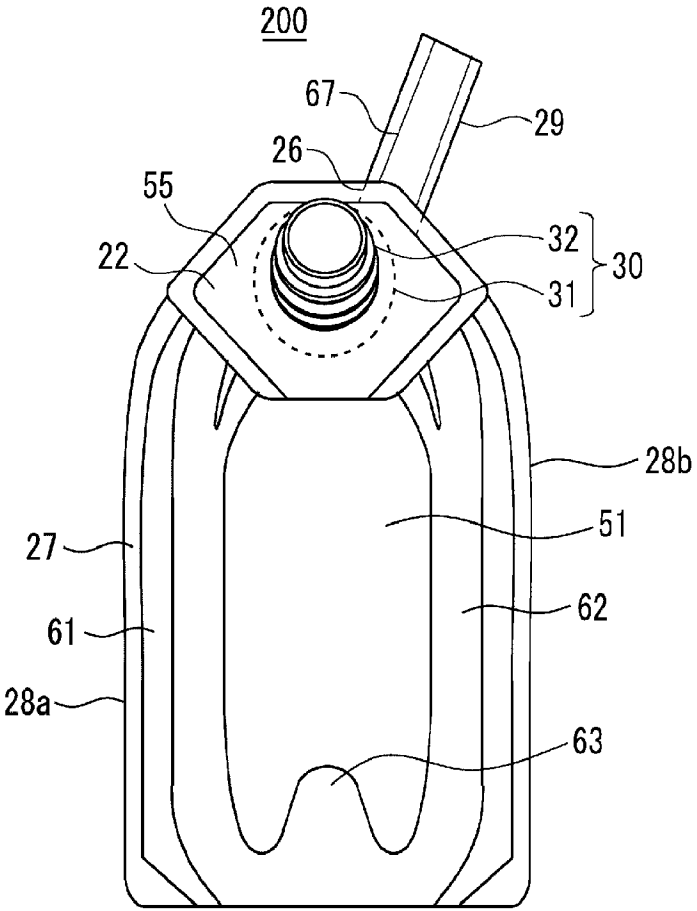

The sheet for container 200 (FIG. 9, FIG. 10(*a*), FIG. 10(*b*)) is formed by folding the container-forming sheet 400, and by attaching (by heat-sealing, for example) the peripheral parts of the container body-forming sheet member 120 to each other.

More specifically, the container-forming sheet 400 is heat sealed to form the sheet for container 200, while being valley-folded along two folding lines 71 and one folding line 72 illustrated in FIG. 8, and mountain-folded at a folding line 73 and two folding lines 74.

The valley folding means a way of folding making the sheet convex towards the far side in FIG. 8, whereas the mountain folding means a way of folding making the sheet convex towards this side in FIG. 8.

One of the two folding lines 71 lies on the boundary between the first main surface sheet part 51 and the first bottom gusset sheet part 53, and the other lies on the boundary between the second main surface sheet part 52 and the second bottom gusset sheet part 54.

The folding line 72 lies on the boundary between the top gusset sheet part 55 and the first main surface sheet part 51 (the boundary between the top gusset sheet part 55 and the top gusset attaching part 56).

The folding line 73 lies on the boundary between the first bottom gusset sheet part 53 and the second bottom gusset sheet part 54.

One of the two folding lines 74 lies on the boundary between the top gusset attaching part 56 of the first main surface sheet part 51 and the other part of the first main surface sheet part 51, meanwhile, the other one lies on the boundary between the top gusset attaching part 57 of the second main surface sheet part 52 and the other part of the second main surface sheet part 52.

In the state that the container-forming sheet 400 is folded in this way, a half part of the top gusset sheet part 55 (the lower half As shown in FIG. 8) and the top gusset attaching part 56 overlap with each other; the other part of the top gusset sheet part 55 (the upper half As shown in FIG. 8) and the top gusset attaching part 57 overlap with each other; the first bottom gusset sheet part 53 and the second bottom gusset sheet part 54 overlap with each other; the first bottom gusset sheet part 53 and the lower end part of the first main surface sheet part 51 overlap with each other; the second bottom gusset sheet part 54 and the lower end part of the second main surface sheet part 52 overlap with each other; and, a part of the first main surface sheet part 51 excluding the top gusset attaching part 56, and a part of the second main surface sheet part 52 excluding the top gusset attaching part 57 overlap with each other.

When the container-forming sheet 400, kept folded in this way, is heat-sealed, the half part of the top gusset sheet part 55 (the lower half as shown in FIG. 8) and the top gusset attaching part 56 are attached to each other; the other part of the top gusset sheet part 55 (the upper half as shown in FIG. 8) and the top gusset attaching part 57 are attached to each other; the first bottom gusset sheet part 53 and the lower end part of the first main surface sheet part 51 are attached to each other; the second bottom gusset sheet part 54 and the lower end part of the second main surface sheet part 52 are attached to each other; and, the first main surface sheet part 51 and the second main surface sheet part 52 are attached to each other.

Here, the part attached to the second main surface sheet part 52 in the first main surface sheet part 51 is, the part excluding the top gusset attaching part 56 and apart of the first main surface sheet part 51 which overlaps the first bottom gusset sheet part 53.

Similarly, the part attached to the first main surface sheet part 51 in the second main surface sheet part 52 is, the part excluding the top gusset attaching part 57 and a part of the second main surface sheet part 52 which overlaps the second bottom gusset sheet part 54.

Here, as illustrated in FIG. 8, each of first bottom gusset sheet part 53 and the second bottom gusset sheet part 54 has notched parts 58 formed on the left and right ends thereof.

Hence, in the state that the container-forming sheet 400 folded as described above, parts of the first main surface sheet part 51 (second main surface sheet part 52) opposed to the individual notched parts 58 are opposed directly to the second main surface sheet part 52 (first main surface sheet part 51), without placing the first bottom gusset sheet part 53 and the second bottom gusset sheet part 54 therebetween. Therefore, by heat-sealing the container-forming sheet 400 as described above, the lower end part of the first main surface sheet part 51 and the lower end part of the second main surface sheet part 52 are locally heat sealed through the notched parts 58.

By heat-sealing the container-forming sheet 400 in this way, the sealed part 27 is formed, and concurrently the container body 20 is formed. The sheet for container 200 illustrated in FIG. 9, FIG. 10(*a*) and FIG. 10(*b*) is thus formed.

The sheet for container 200 has the tubular filler introducing part 29 that projects out from the container body 20. The non-attached part 68 of the filler introducing part 29 serves as an introducing part through which the filler is introduced into spaces within each of the non-attached parts 61, 62, 63, 65, 66 and 67. Location of the filler introducing part 29 is not specifically limited. In this embodiment, for example, the filler introducing part 29 is disposed so that the filler introducing part 29 protrudes from one end of the non-attached part 67.

FIG. 9 illustrates the top gusset 22 (and the top gusset 12, not illustrated) laid orthogonally to the trunk 21 (and the trunk 11, not illustrated). When the container-forming sheet 400 is heat-sealed, the sheet will be held as illustrated in FIG. 9, with the half part of the top gusset sheet part 55 and the top gusset attaching part 56 held by dies (not illustrated), with the other part of the top gusset sheet part 55 and the top gusset attaching part 57 held by the dies, and, also with the first main surface sheet part 51, the second main surface sheet part 52, the first bottom gusset sheet part 53 and the second bottom gusset sheet part 54 held by the dies.

FIG. 10(*a*) and FIG. 10(*b*) illustrate a state in which the sheet for container 200 is bent so that the top gusset attaching part 56 is overlapped with the other part of the first main surface sheet part 51. In this embodiment, the sheet for container 200 kept in the thus-bent state is fed from a process for manufacturing the sheet for container 200, to a process for enclosing the article 96 into the accommodating area 20*a* of the container body 20.

After the sheet for container 200 is formed by heat-sealing the container-forming sheet 400 as described above, the filler (air, for example) is introduced through the non-attached part 68 of the filler introducing part 29, into each of the non-attached parts 61, 62, 63, 65, 66 and 67. As a consequence, each of the non-attached parts 61, 62, 63, 65, 66 and 67 is expanded to form the first peripheral enclosing part 41, the second peripheral enclosing part 42, the specific enclosing part 80, the second specific enclosing part 800, the filler enclosing part 45, the transverse direction enclosing part 46, and the filler enclosing part 47, thereby adding rigidity to the container body 20.

That is, the filler is enclosed between the first film layer 121 and the second film layer 122 in each of the non-attached parts 61, 62, 63, 65, 66 and 67, and thereby the first peripheral enclosing part 41, the second peripheral enclosing part 42, the specific enclosing part 80, the second specific enclosing part 800, the filler enclosing part 45, the transverse direction enclosing part 46, and the filler enclosing part 47 are formed.

As a result of expansion of each of the non-attached parts 61, 62, 63, 65, 66 and 67, for example, the trunk 21 bulges also in the front-rear direction.

After each of the filler enclosing parts (the first peripheral enclosing part 41, the second peripheral enclosing part 42, the specific enclosing part 80, the second specific enclosing part 800, the filler enclosing part 45, the transverse direction enclosing part 46, the filler enclosing part 47) are formed, for example, a part of the filler enclosing part 47 adjoining the non-attached part 68 is suitably sealed (that is, the first peripheral enclosing part 41, the second peripheral enclosing part 42, the specific enclosing part 80, the second specific enclosing part 800, the filler enclosing part 45, the transverse direction enclosing part 46, and the filler enclosing part 47 are sealed, and the filler is enclosed in each of the first peripheral enclosing part 41, the second peripheral enclosing part 42, the specific enclosing part 80, the second specific enclosing part 800, the filler enclosing part 45, the transverse direction enclosing part 46, and the filler enclosing part 47). In this way, the filler is prevented from leaking from each of the first peripheral enclosing part 41, the second peripheral enclosing part 42, the specific enclosing part 80, the second specific enclosing part 800, the filler enclosing part 45, the transverse direction enclosing part 46, and the filler enclosing part 47.

The filler introducing part 29 is cut off at the base part.

The sheet container 100 is thus manufactured.

As described above, the sheet for container 200 includes the container body 20 that surrounds the accommodating area 20*a* for accommodating the article 96; the container body is composed of the sheet member given by lamination of the plurality of film layers (container body-forming sheet member 120); the sheet member has the film region in which the plurality of film layers are attached to each other, and the non-attached region (non-attached parts 61 to 67) in which the plurality of film layers are left unattached to each other; when the filler is enclosed between the plurality of film layers in the non-attached region of the sheet member to form the filler enclosing part (the first peripheral enclosing part 41, the second peripheral enclosing part 42, the specific enclosing part 80, the second specific enclosing part 800, the filler enclosing part 45, the transverse direction enclosing part 46, the filler enclosing part 47), the container body 20 will be the shape with the plurality of surface-like parts; the plurality of surface-like parts include the first surface-like part (first main surface part 21*a*) and the second surface-like part (bottom gusset 23) that adjoin and cross each other; the filler enclosing part includes: the intermediate extending part 83 laid across the first surface-like part and the second surface-like part, and extend from the boundary part 151 between the first surface-like part and the second surface-like part towards the side of the opposite end 152 opposite to the boundary part 151 side at the first surface-like part; and, the first adjoining part 84 and the second adjoining part 85 that individually adjoin both sides, in the direction along the boundary part 151, of the intermediate extending part 83; and, the intermediate extending part 83 extends more further from the second surface-like part than the first adjoining part 84 and the second adjoining part 85 extend, and, the film regions are individually disposed adjoining both sides of the end part of the intermediate extending part 83 in the extending direction thereof.

The first surface-like part (first main surface part 21*a*) has the first peripheral part 28*a* and the second peripheral part 28*b*, each extending from the boundary part 151 side towards the opposite end 152 side, and being arranged side by side; when the filler is enclosed between the plurality of film layers in the non-attached region of the sheet member (container body-forming sheet member 120) to form the filler enclosing part, the first adjoining part 84 is disposed between the intermediate extending part 83 and the first peripheral part 28*a;* the second adjoining part 85 is disposed between the intermediate extending part 83 and the second peripheral part 28*b;* the filler enclosing part includes: the first peripheral enclosing part 41 that extends from one end on the first peripheral part 28*a* side of the first adjoining part 84 towards the opposite end 152, along the first peripheral part 28*a;* the second peripheral enclosing part 42 that extends from one end on the second peripheral part 28*b* side of the second adjoining part 85 towards the opposite end 152, along the second peripheral part 28*b;* and the transverse direction enclosing part 46 that extends, in the region of the first surface-like part on the opposite end 152 side, from the first peripheral part 28*a* towards the second peripheral part 28*b*, so as to mutually connect the first peripheral enclosing part 41 and the second peripheral enclosing part 42; and the transverse direction enclosing part 46 is thinner than the first peripheral enclosing part 41, in the connection part 46*a* of the first peripheral enclosing part 41 and the transverse direction enclosing part 46.

When a filler is enclosed between the plurality of film layers in the non-attached region of the sheet member (container body-forming sheet member 120) to form the filler enclosing part, the distance, from the second surface-like part to the end 83*a* of the intermediate extending part 83 in the extending direction of the intermediate extending part 83, is equal to or less than the half of the distance from the second surface-like part to the opposite end 152.

When the filler is enclosed between the plurality of film layers in the non-attached region of the sheet member (container body-forming sheet member 120) to form the filler enclosing part, a portion of the filler enclosing part, which falls on the first surface-like part (first main surface part 21*a*), includes: the base part 81*a* that is disposed along the boundary part 151, and laid across the first adjoining part 84, the intermediate extending part 83 and the second adjoining part 85; and, the projection part 81*b*, which is a part of the intermediate extending part 83, and protrudes out from the base part 81*a* and away from the boundary part 151; and, the width dimension of the projection part 81*b* in the direction parallel to the boundary part 151 is maximized at the end part on the base part 81*a* side of the projection part 81*b*.

When the filler is enclosed between the plurality of film layers in the non-attached region of the sheet member (container body-forming sheet member 120) to form the filler enclosing part, the projection part 81*b* is formed into the chevron shape in which the width dimension of the projection part 81*b* in the direction parallel to the boundary part 151 becomes narrower as being farther from the base part 81*a*.

The first surface-like part (first main surface part 21*a*) has the first peripheral part 28*a* and the second peripheral part 28*b*, each extending from the boundary part 151 side towards the opposite end 152 side, and being arranged side by side; when the filler is enclosed between the plurality of film layers in the non-attached region of the sheet member (container body-forming sheet member 120) to form the filler enclosing part, the first adjoining part 84 is disposed between the intermediate extending part 83 and the first peripheral part 28*a*, the second adjoining part 85 is disposed between the intermediate extending part 83 and the second peripheral part 28*b;* the filler enclosing part includes: the first peripheral enclosing part 41 that extends from one end on the first peripheral part 28*a* side of the first adjoining part 84 towards the opposite end 152, along the first peripheral part 28*a;* and the second peripheral enclosing part 42 that extends from one end on the second peripheral part 28*b* side of the second adjoining part 85 towards the opposite end 152, along the second peripheral part 28*b;* and, the shortest distance from the opposite end 152 to the end 83*a* of the intermediate extending part 83 on the opposite end 152 side is longer than the shortest distance from the opposite end 152 to the ends 41*b*, 42*b* of the first peripheral enclosing part 41 and the second peripheral enclosing part 42 on the opposite end 152 side.

When the filler is enclosed between the plurality of film layers in the non-attached region of the sheet member (container body-forming sheet member 120) to form the filler enclosing part, the plurality of surface-like parts include the third surface-like part (second main surface part 21*b*) which is opposed to the first surface-like part (first main surface part 21*a*) while placing the accommodating area 20*a* in between; the container body 20 has the trunk 21 that includes the first surface-like part and the third surface-like part, and the bottom (bottom gusset 23) composed of the second surface-like part; the trunk 21 has the first peripheral part 28*a* and the second peripheral part 28*b*, each extending from the boundary part 151 side towards the opposite end 152 side, and being arranged side by side; the first surface-like part and the third surface-like part are mutually connected at each of the first peripheral part 28*a* and the second peripheral part 28*b;* a portion of the filler enclosing part, located in the first surface-like part, is preferably formed symmetrically (symmetrically in the front-rear direction, in this embodiment) about the portion of the filler enclosing part located in the third surface-like part; a portion of the filler enclosing part, located in the half area on the first surface-like part side of the bottom (bottom gusset 23), is preferably formed symmetrically (symmetrically in the front-rear direction, in this embodiment) about the portion of the filler enclosing part, located in the half area on the third surface-like part side; and, a central part 201 (FIG. 12) of the first surface-like part, which falls between the first peripheral part 28*a* and the second peripheral part 28*b*, and the central part 202 (FIG. 12) of the third surface-like part, which falls between the first peripheral part 28*a* and the second peripheral part 28*b*, are bulged in opposite directions to each other.

When the filler is enclosed between the plurality of film layers in the non-attached region of the sheet member (container body-forming sheet member 120) to form the filler enclosing part, the plurality of surface-like parts of the container body 20 include the third surface-like part (second main surface part 21*b*) which is opposed to the first surface-like part (first main surface part 21*a*) while placing the accommodating area 20*a* in between; the container body 20 has the trunk 21 that includes the first surface-like part and the third surface-like part, and the bottom (bottom gusset 23) composed of the second surface-like part; the trunk 21 has the first peripheral part 28*a* and the second peripheral part 28*b,* each extending from the boundary part 151 side towards the opposite end 152 side, and being arranged side by side; the first surface-like part and the third surface-like part are mutually connected at each of the first peripheral part 28*a* and the second peripheral part 28*b;* the bottom is formed into the shape having the first bottom peripheral part 231, the second bottom peripheral part 232 opposed to the first bottom peripheral part 231, the third bottom peripheral part 233 disposed between one end of the first bottom peripheral part 231 and one end of the second bottom peripheral part 232, and the fourth bottom peripheral part 234 opposed to the third bottom peripheral part 233; the filler enclosing part includes: the intermediate extending part 83 laid across the first bottom peripheral part 231 and the first surface-like part; the second intermediate extending part 830 that is disposed symmetrically (symmetrically in the front-rear direction, in this embodiment) to the intermediate extending part 83, and laid across the second bottom peripheral part 232 and the third surface-like part; and the first side bottom enclosing part (one filler enclosing part 45) laid across the third bottom peripheral part and the trunk; and the second side bottom enclosing part (the other filler enclosing part 45) laid across the fourth bottom peripheral part 234 and the trunk 21, and is opposed to the first side bottom enclosing part.

The container-forming sheet 400 of this embodiment (FIG. 8) includes the sheet member (container body-forming sheet member 120) that composes the container body 20, given by lamination of the plurality of film layers; the sheet member has the film region in which the plurality of film layers are attached to each other, and the non-attached region (non-attached parts 61 to 67) in which the plurality of film layers are left unattached to each other; when the container body 20 is formed by folding the sheet member, and by enclosing the filler between the plurality of film layers in the non-attached region to form the filler enclosing part, the container body 20 will be the shape with the plurality of surface-like parts;

the plurality of surface-like parts will include the first surface-like part (first main surface part 21*a*) and the second surface-like part (bottom gusset 23) that adjoin and cross each other; the filler enclosing part includes: an intermediate extending part 83 that will be disposed across the first surface-like part and the second surface-like part, and extend from the boundary part 151 between the first surface-like part and the second surface-like part, towards the side of the opposite end 152 opposite to the boundary part 151 side at the first surface-like part; and the first adjoining part 84 and the second adjoining part 85 that will individually adjoin both sides, in the direction along the boundary part 151, of the intermediate extending part 83; and, the intermediate extending part 83 extending more further from the second surface-like part than the first adjoining part 84 and the second adjoining part 85, and, the film regions are individually disposed adjoining both sides of an end part of the intermediate extending part 83 in the extending direction thereof.

Here, each of the filler enclosing parts (the first peripheral enclosing part 41, the second peripheral enclosing part 42, the specific enclosing part 80, the second specific enclosing part 800, the filler enclosing part 45, the transverse direction enclosing part 46, the filler enclosing part 47) are preferably, but not limitatively, kept at a pressure higher than the atmospheric pressure, and for example at equal to or higher than 10 kPa and at equal to or lower than 500 kPa in terms of gauge pressure.

As a method of sealing the filler enclosing part, for example, there is a method that the non-attaching treatment is not performed at the part of the filler enclosing part 47 adjoining the non-attached part 68 so that the first film layer 121 and the second film layer 122 can be heat-sealed to each other; and heat-seal is not performed on that part in the process of manufacturing the container-forming sheet 400 and in the process of manufacturing the sheet for container 200; and heat-seal is performed on that part after the filler is enclosed.

The article 96 is then enclosed through the cylinder part 32 of the spout 30 into the accommodating area 20*a,* thereby the sheet container 100 filled with the article 96, that is, the packed article in sheet container 300, may be obtained.

As described above, the packed article in sheet container 300 according to this embodiment has the sheet container 100 of this embodiment, and the article 96 accommodated in the accommodating area 20*a.*

There is no particular limitation on the temporal order between the timing of filling of the filler into each of the filler enclosing parts (the first peripheral enclosing part 41, the second peripheral enclosing part 42, the specific enclosing part 80, the second specific enclosing part 800, the filler enclosing part 45, the transverse direction enclosing part 46, the filler enclosing part 47), and the timing of accommodating of the article 96 into the accommodating area 20*a.* The article 96 may be accommodated in the accommodating area 20*a* after enclosing the filler into each of the filler enclosing parts; the filler may be enclosed in the individual filled parts after accommodating the article 96 into the accommodating area 20*a;* or, enclosure of the filler into each of the filler enclosing parts and accommodating of the article 96 into the accommodating area 20*a* may take place at the same time (in parallel).

According to the first embodiment described above, the filler enclosing part includes: the intermediate extending part 83 laid across the first surface-like part and the second surface-like part, and extend from the boundary part 151 between the first surface-like part and the second surface-like part, towards the side of the opposite end 152 opposite to the the boundary part 151 side at the first surface-like part; and, the first adjoining part 84 and the second adjoining part 85 that individually adjoin both sides, in the direction along the boundary part 151, of the intermediate extending part 83; and, the intermediate extending part 83 extending more further from the second surface-like part than the first adjoining part 84 and the second adjoining part 85 extend, and, the film regions are individually disposed adjoining both sides of the end part of the intermediate extending part 83 in the extending direction thereof As a result of existence of the intermediate extending part 83, the container body 20 will have a shape that bulges at the central part of the first surface-like part towards the outside of the container body 20. Hence, the container body 20 will have an increased capacity of the inner space, as compared with the container body 20 having no intermediate extending part 83, and thereby the sheet container 100 will successfully have a sufficient capacity. In particular, since the film regions are individually disposed adjoining both sides of the end part of the intermediate extending part 83 in the extending direction thereof, it is possible to sufficiently exert the force of the intermediate extending part 83 trying to flatten even at the end part of the intermediate extending part 83, and thereby the intermediate extending part 83 can more efficiently allow the first main surface part 21*a* to bulge at the central part.

The transverse direction enclosing part 46 is thinner than the first peripheral enclosing part 41, in the connection part 46*a* of the first peripheral enclosing part 41 and the transverse direction enclosing part 46. The transverse direction enclosing part 46 is also thinner than the second peripheral enclosing part 42, in the connection part 46*a* of the second peripheral enclosing part 42 and the transverse direction enclosing part 46. With such design, sufficient bulging of the trunk 21 in the front-rear direction of the sheet container 100 can be realized, and the capacity of the container body 20 can be sufficiently secured.

The filler enclosing part includes the first peripheral enclosing part 41 that extends from one end on the first peripheral part 28*a* side of the first adjoining part 84 towards the opposite end 152, along the first peripheral part 28*a;* and, the second peripheral enclosing part 42 that extends from one end on the second peripheral part 28*b* side of the second adjoining part 85 towards the opposite end 152, along the second peripheral part 28*b;* and the transverse direction enclosing part 46 mutually connects the first peripheral enclosing part 41 and the second peripheral enclosing part 42.

Hence, the first main surface part 21*a* may be reinforced by a continuous annular region participated by the intermediate extending part 83, the first adjoining part 84, the second adjoining part 85, the first peripheral enclosing part 41, the second peripheral enclosing part 42 and the transverse direction enclosing part 46.

The same will apply to reinforcement of the second main surface part 21*b*.

Also since the distance, from the bottom gusset 23 to the end 83*a* of the intermediate extending part 83 in the extending direction of the intermediate extending part 83, is set equal to or less than a half of the distance from the bottom gusset 23 to the opposite end 152, so that the sufficient bulging of the trunk 21 in the front-rear direction of the sheet container 100 can be realized, and the capacity of the container body 20 can be sufficiently secured. It also becomes possible to reserve a sufficiently wide area on the first main surface part 21*a,* which is allowed for presenting information or package design.

Similarly, also since the distance, from the bottom gusset 23 to the end 830*a* of the second intermediate extending part 830 in the extending direction of the second intermediate extending part 830, is set equal to or less than a half of the distance from the bottom gusset 23 to the opposite end 152, so that the sufficient bulging of the trunk 21 in the front-rear direction of the sheet container 100 can be realized, and the capacity of the container body 20 can be sufficiently secured. It also becomes possible to reserve a sufficiently wide area on the second main surface part 21*b,* which is allowed for presenting information or package design.

Also since the shortest distance from the opposite end 152 to the end 83*a* of the intermediate extending part 83 on the opposite end 152 side is longer than the shortest distance from the opposite end 152 to the ends 41*b,* 42*b* of the first peripheral enclosing part 41 and the second peripheral enclosing part 42 on the opposite end 152 side, so that the sufficient bulging of the trunk 21 in the front-rear direction of the sheet container 100 can be realized, and the capacity of the container body 20 can be sufficiently secured, and can reserve a sufficiently wide area on the first main surface part 21*a,* which is allowed for presenting information or package design.

Similarly, also since the shortest distance from the opposite end 152 to the end 830*a* of the intermediate extending part 830 on the opposite end 152 side is longer than the shortest distance from the opposite end 152 to the ends 41*b,* 42*b* of the first peripheral enclosing part 41 and the second peripheral enclosing part 42 on the opposite end 152 side, so that the sufficient bulging of the trunk 21 in the front-rear direction of the sheet container 100 can be realized, and the capacity of the container body 20 can be sufficiently secured, and can reserve a sufficiently wide area on the first main surface part 21*b,* which is allowed for presenting information or package design.

Also since width dimension of the projection part 81*b* in the direction parallel to the boundary part 151 is maximized at the end part on the base part 81*a* side of the projection part 81*b,* it now becomes possible to fully obtain an effect of reinforcing the first main surface part 21*a* with the intermediate extending part 83, and an effect of reinforcing the second main surface part 21*b* with the second intermediate extending part 830.

Also since the projection part 81*b* is formed into a chevron shape with the transverse width made narrower as being farther from the base part 81*a,* so that rigidity of the first main surface part 21*a* and second main surface part 21*b* may be suppressed from discontinuously varying in the height direction, and thereby the first main surface part 21*a* and second main surface part 21*b* may be suppressed from buckling deformation.

MODIFIED EXAMPLE OF FIRST EMBODIMENT

Modified Examples of the first embodiment will now be explained below, referring to FIG. 16 to FIG. 21. The following sheet container 100 according to each of Modified Examples 1 to 9 of the first embodiment is different from the above-described sheet container 100 of the first embodiment, in the following points, and the other points are the same as the above-described sheet container 100 of the first embodiment.

Figure 17B:
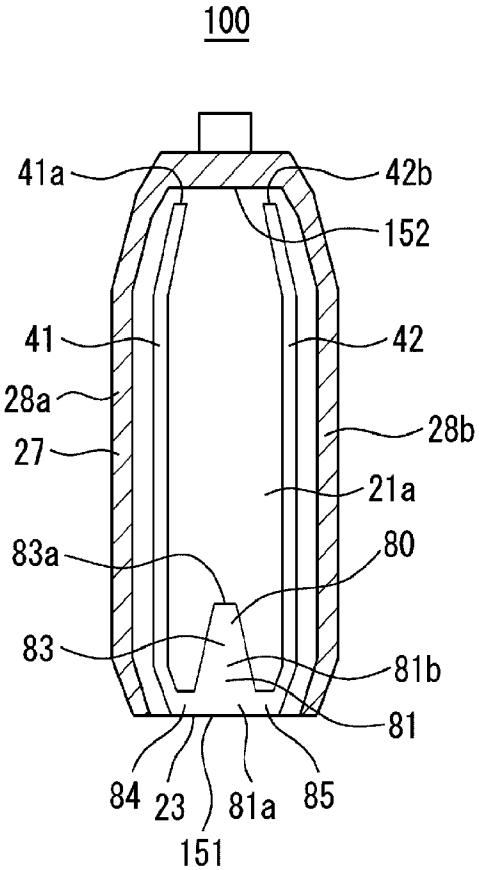
FIG. 17(*a*) is a front elevation illustrating a sheet container according to Modified Example 2 of the first embodiment, and FIG. 17(*b*) is a front elevation illustrating a sheet container according to Modified Example 3 of the first embodiment.
Figure 17A:
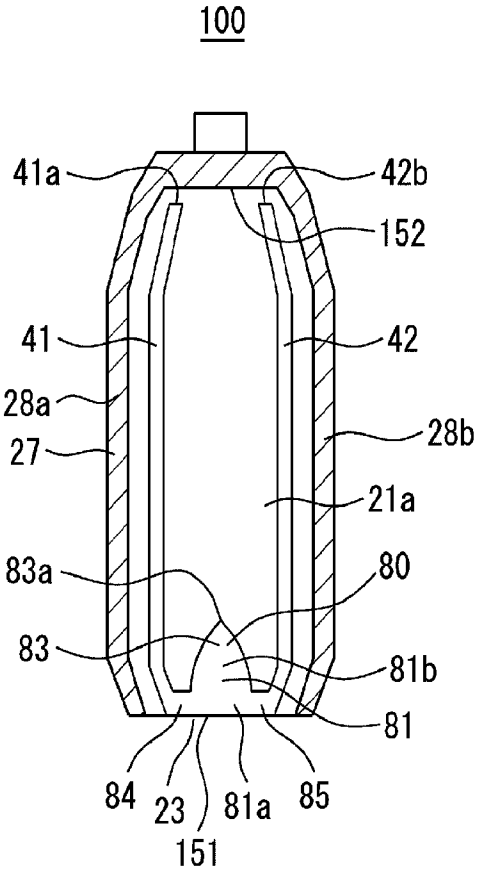
Figure 19A:
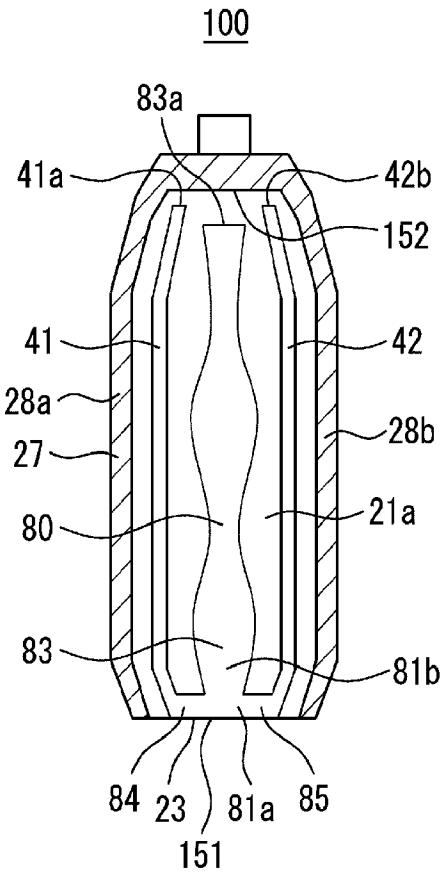
FIG. 19(*a*) is a front elevation illustrating a sheet container according to Modified Example 6 of the first embodiment, FIG. 19(*b*) is a front elevation illustrating a sheet container according to Modified Example 7 of the first embodiment, and FIG. 19(*c*) is a front elevation illustrating a sheet container according to Modified Example 8 of the first embodiment.
Figure 19B:
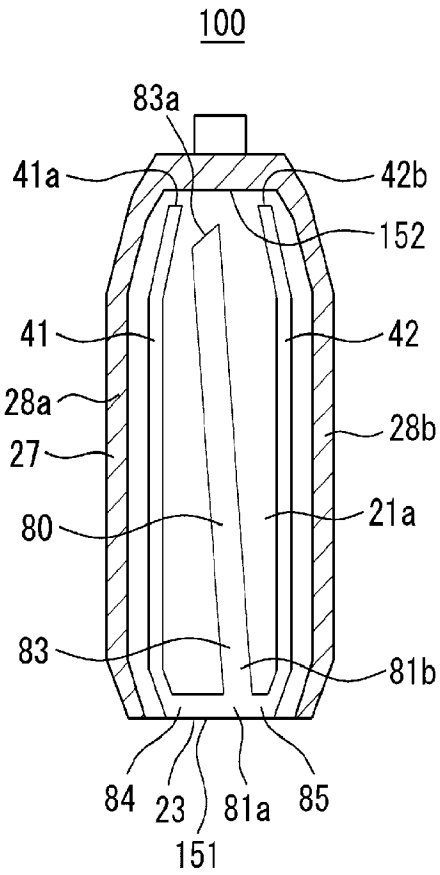
Figure 19C:
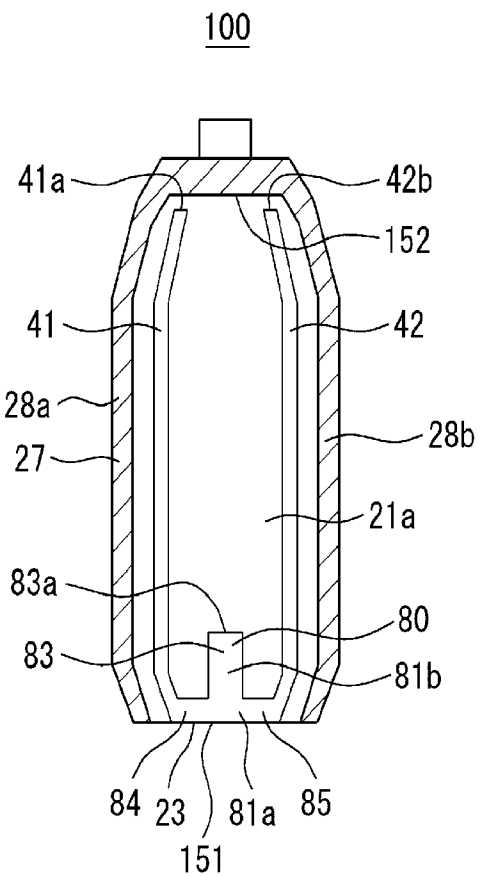
Figure 22:
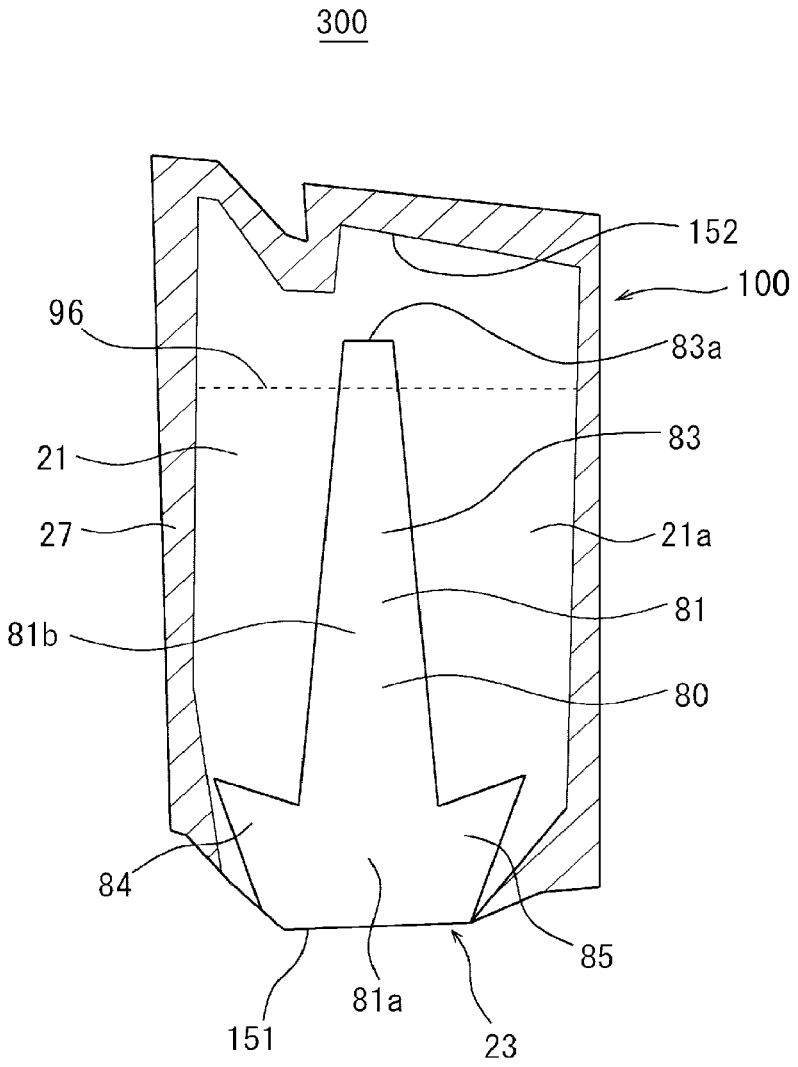
FIG. 22 is a drawing illustrating a front side of a packed article in sheet container of a second embodiment.
Figure 23:
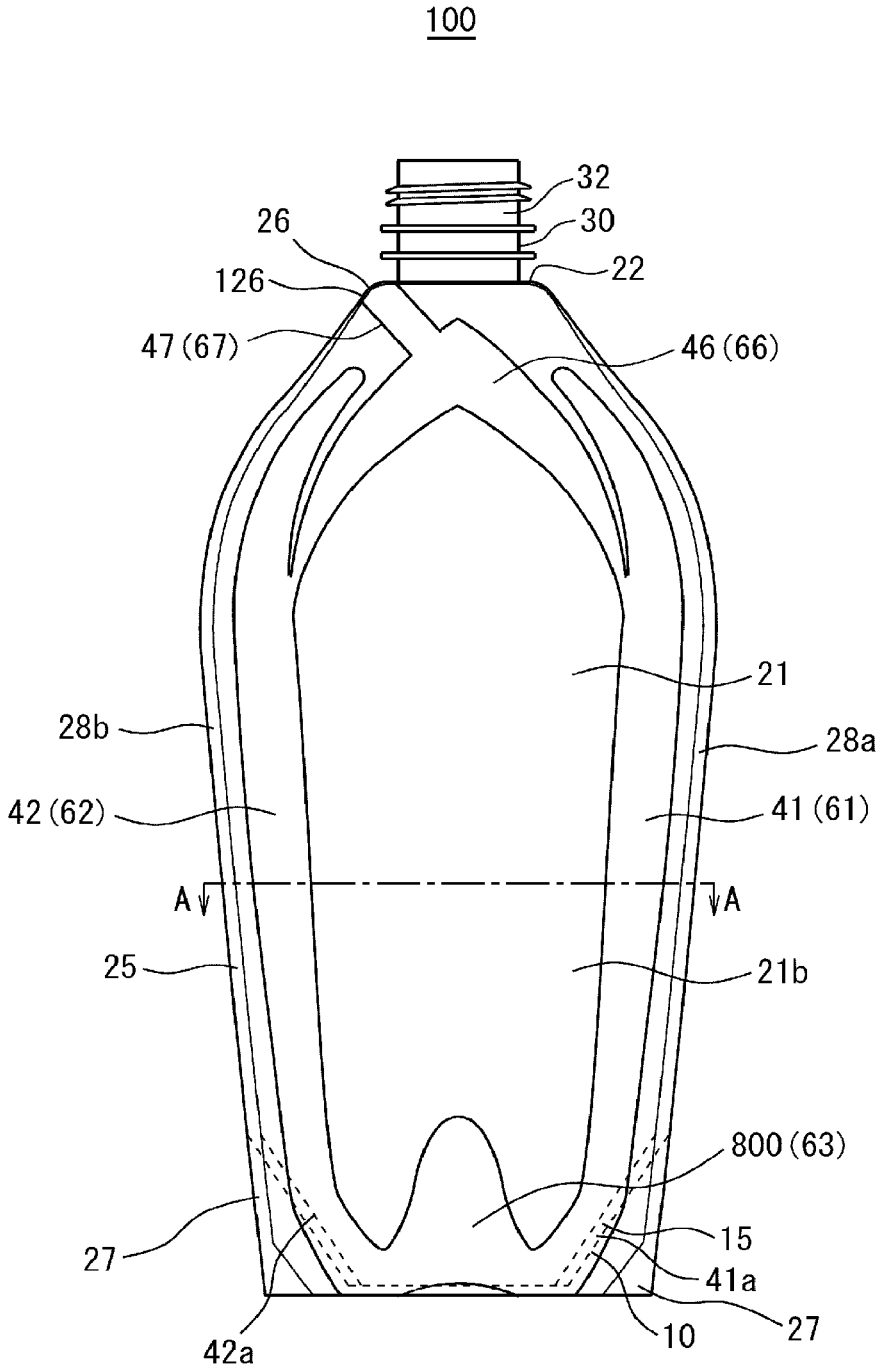
FIG. 23 is a rearview illustrating a sheet container of a third embodiment.

In all drawings from FIG. 17(*a*) to FIG. 19(*c*), and FIG. 22, forming ranges for the sealed part 27 are hatched.

The packed article in sheet container according to each of Modified Examples 1 to 9 of the first embodiment is configured same as the packed article in sheet container 300 according to the first embodiment except that the configuration of the sheet container 100 is different from that of the packed article in sheet container 300 according to the first embodiment.

All drawings illustrating Modified Examples 1 to 8 of the first embodiment show the first main surface part 21*a* side of the container body 20. Also the second main surface part 21*b* side, although not shown, has the filler enclosing part formed therein, same as the first main surface part 21*a*. The filler enclosing part on the second main surface part 21*b* side is different from the filler enclosing part on the first main surface part 21*a* side, in that it contains the filler enclosing part 47 disposed anywhere in the second main surface part 21*b*.

Modified Example 1 of First Embodiment

Figure 16:
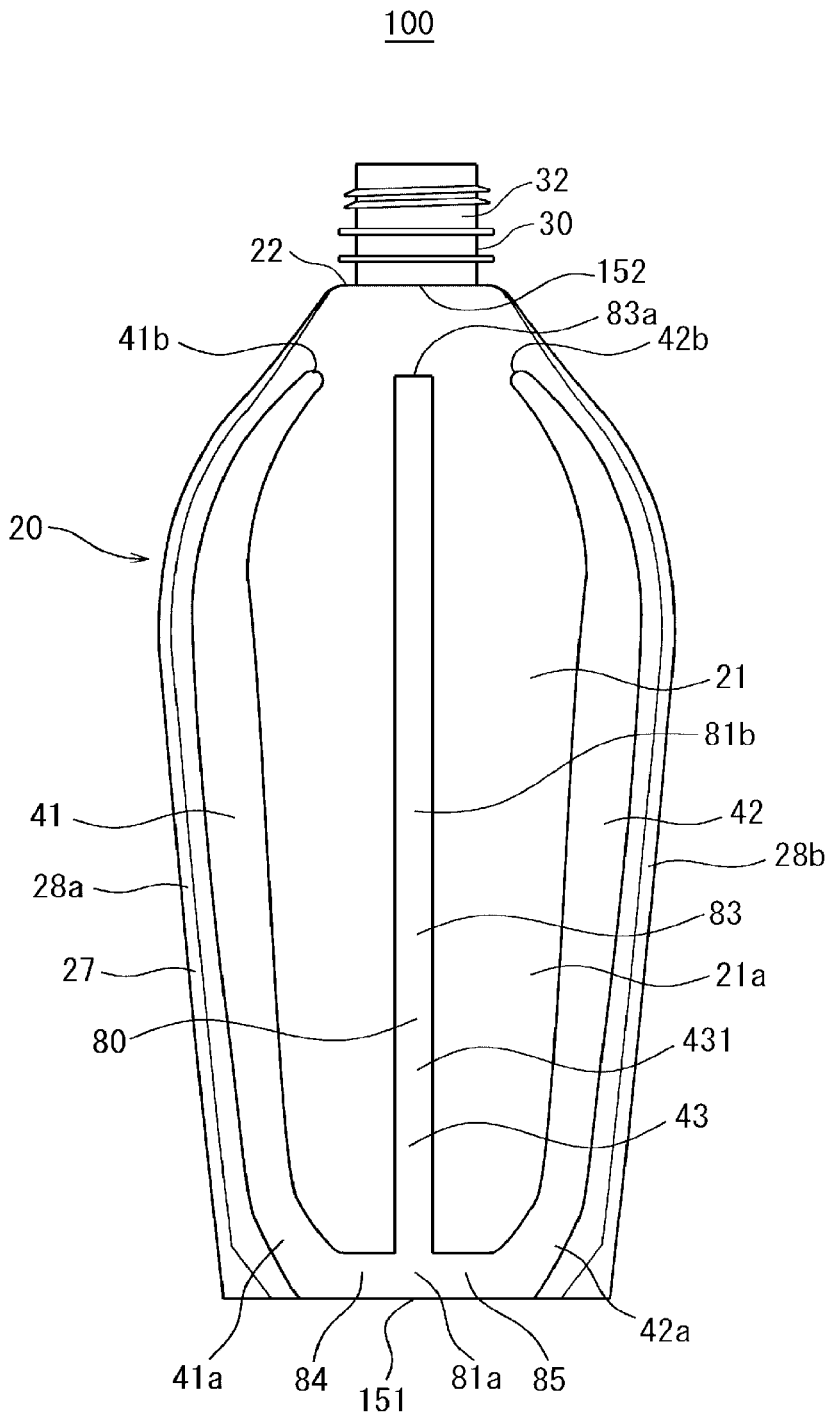
FIG. 16 is a front elevation illustrating a sheet container according to Modified Example 1 of the first embodiment.

First, the sheet container 100 according to Modified Example 1 of the first embodiment will be explained referring to FIG. 16.

In this Modified Example, the sheet container 100 neither has the transverse direction enclosing part 46 nor the non-attached part 66.

The level of height (height in the vertical direction) of the end 83*a* (upper end part) of the intermediate extending part 83 is set nearly equal to the level of height of the end 41*b* (upper end part) of the first peripheral enclosing part 41 in the same direction, and to the level of height of the end 42*b* (upper end part) of the second peripheral enclosing part 42 in the same direction.

The projection part 81*b* is formed into a rod shape (band shape), rather than the chevron shape, with a constant transverse width irrespective of the level of height in the vertical direction.

In addition, in the first surface-like part (first main surface part 21*a*), there is no filler enclosing part formed in a region between the end 83*a,* in the extending direction, of the intermediate extending part 83, and the opposite end 152.

In other words, even after the filler enclosing part is formed by enclosing the filler between a plurality of film layers in the non-attached region of the sheet member (container body-forming sheet member 120) of the sheet for container, there will not be formed the filler enclosing part in the first surface-like part, in the region between the end 83*a* in the extending direction of the intermediate extending part 83 and the opposite end 152.

Modified Example 2 of First Embodiment

Next, the sheet container 100 according to Modified Example 2 of the first embodiment will be explained referring to FIG. 17(*a*).

In this Modified Example, the container body 20 has no transverse direction enclosing part 46 (as well as no non-attached part 66) formed therein.

In the first main surface part 21*a,* any of the filler enclosing parts is not arranged in a region between the upper end part (end 83*a*) of the intermediate extending part 83 and the opposite end 152.

That is, in the first surface-like part (first main surface part 21*a*), there is no filler enclosing part formed in a region thereof which falls between the end 83*a* in the extending direction of the intermediate extending part 83 and the opposite end 152.

With such design, sufficient bulging of the trunk 21 in the front-rear direction of the sheet container 100 can be realized, and the capacity of the container body 20 can be sufficiently secured.

The end 83*a* (upper end part) of the intermediate extending part 83 in the extending direction of the intermediate extending part 83 has a sharp pointed shape.

Modified Example 3 of First Embodiment

Next, the sheet container 100 according to Modified Example 3 of the first embodiment will be explained referring to FIG. 17(*b*).

In this Modified Example, the container body 20 has no transverse direction enclosing part 46 (as well as no non-attached part 66) formed therein.

In addition, in the first surface-like part (first main surface part 21*a*), there is no filler enclosing part formed in a region thereof which falls between the end 83*a* in the extending direction of the intermediate extending part 83 and the opposite end 152.

With such design, sufficient bulging of the trunk 21 in the front-rear direction of the sheet container 100 can be realized, and the capacity of the container body 20 can be sufficiently secured.

The projection part 81*b* is formed into a trapezoidal shape with the upper base shorter than the lower base, and the end 83*a* (upper end part), in the extending direction, of the intermediate extending part 83 lies horizontally.

Modified Example 4 of First Embodiment

Next, the sheet container 100 according to Modified Example 4 of the first embodiment will be explained referring to FIG. 18(*a*).

In this Modified Example, the level of height (height in the vertical direction), in the extending direction, of the end 83*a* (upper end part) of the intermediate extending part 83 is set nearly equal to the level of height of the end 41*b* (upper end part) of the first peripheral enclosing part 41 in the same direction, and to the level of height of the end 42*b* (upper end part) of the second peripheral enclosing part 42 in the same direction.

Figure 18B:
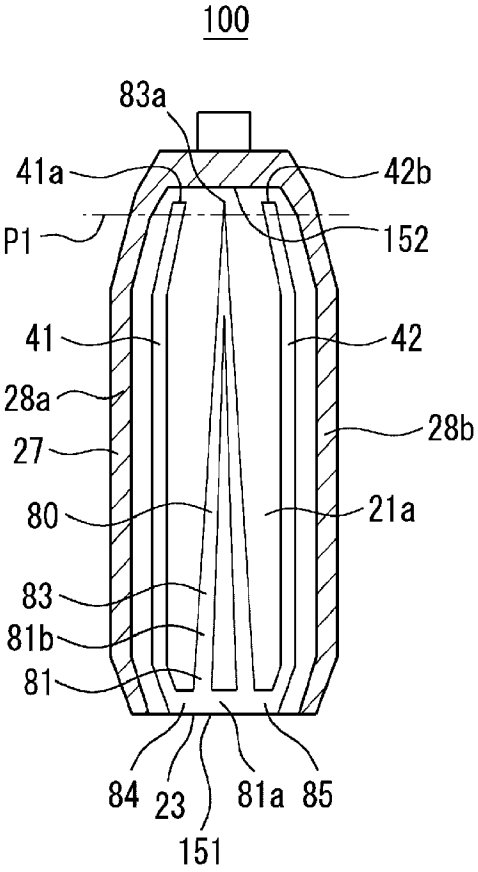
FIG. 18(*a*) is a front elevation illustrating a sheet container according to Modified Example 4 of the first embodiment, and FIG. 18(*b*) is a front elevation illustrating a sheet container according to Modified Example 5 of the first embodiment.
Figure 18A:
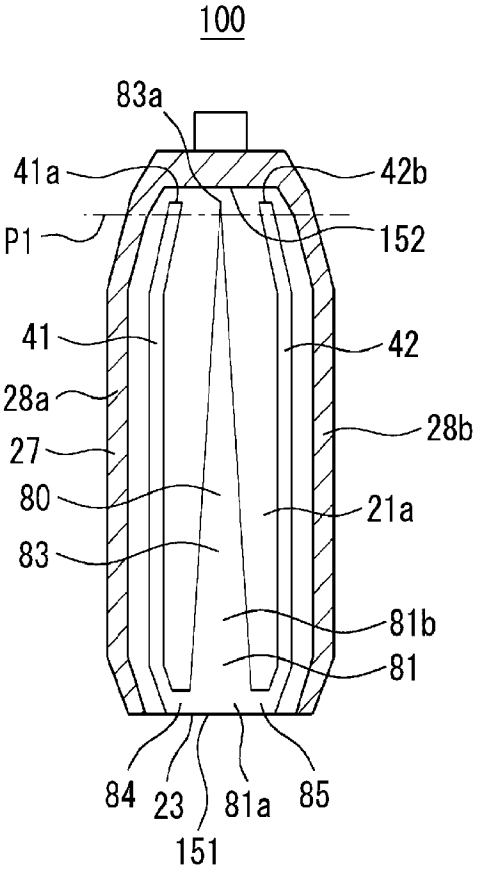

When viewed in a cross-section taken along horizontal plane P1 illustrated in FIG. 18(*a*), the cross sectional area of the intermediate extending part 83 is smaller than the cross sectional areas of the first peripheral enclosing part 41 and the second peripheral enclosing part 42.

That is, the first surface-like part (first main surface part 21*a*) has the first peripheral part 28*a* and the second peripheral part 28*b,* each extending from the boundary part 151 side towards the opposite end 152 side, and being arranged side by side; the first adjoining part 84 is disposed between the intermediate extending part 83 and the first peripheral part 28*a;* the second adjoining part 85 is disposed between the intermediate extending part 83 and the second peripheral part 28*b;* the filler enclosing part includes: the first peripheral enclosing part 41 that extends from one end on the first peripheral part 28*a* side of the first adjoining part 84 towards the opposite end 152, along the first peripheral part 28*a;* and the second peripheral enclosing part 42 that extends from one end on the second peripheral part 28*b* side of the second adjoining part 85 towards the opposite end 152, along the second peripheral part 28*b;* and, when viewed in a cross section (cross section taken along the plane P1) which lies parallel to the second surface-like part (bottom gusset 23), and is taken across the ends on the opposite end 152 side of the first peripheral enclosing part 41, the second peripheral enclosing part 42 and the intermediate extending part 83, the intermediate extending part 83 has a cross sectional area smaller than the cross sectional areas of the first peripheral enclosing part 41 and the second peripheral enclosing part 42.

With such design, sufficient bulging of the trunk 21 in the front-rear direction of the sheet container 100 can be realized, and the capacity of the container body 20 can be sufficiently secured.

The first surface-like part of the sheet for container includes the first peripheral part 28*a* and the second peripheral part 28*b,* each extending from the boundary part 151 side towards the opposite end 152 side, and being arranged side by side; when the filler is enclosed between the plurality of film layers in the non-attached region of the sheet member (container body-forming sheet member 120) to form the filler enclosing part, the first adjoining part 84 is disposed between the intermediate extending part 83 and the first peripheral part 28*a;* the second adjoining part 85 is disposed between the intermediate extending part 83 and the second peripheral part 28*b;* the filler enclosing part includes: the first peripheral enclosing part 41 that extends from one end on the first peripheral part 28*a* side of the first adjoining part 84 towards the opposite 152 end, along the first peripheral part 28*a;* and the second peripheral enclosing part 42 that extends from one end on the second peripheral part 28*b* side of the second adjoining part 85 towards the opposite end 152, along the second peripheral part 28*b;* when viewed in a cross section (cross section taken along the plane P1) which lies parallel to the second surface-like part (bottom gusset 23), and is taken across the ends on the opposite end 152 side of the first peripheral enclosing part 41, the second peripheral enclosing part 42 and the intermediate extending part 83, the intermediate extending part 83 has a cross sectional area smaller than the cross sectional areas of the first peripheral enclosing part 41 and the second peripheral enclosing part 42.

The projection part 81*b* is formed, for example, into an isosceles triangle shape.

The distal end parts of the first peripheral enclosing part 41 and the second peripheral enclosing part 42 may alternatively be tapered.

Modified Example 5 of First Embodiment

Next, the sheet container 100 according to Modified Example 5 of the first embodiment will be explained referring to FIG. 18(*b*).

The sheet container 100 of this Modified Example is configured same as the above-described sheet container 100 of Modified Example 4 (FIG. 18(*a*)), except that the projection part 81*b* has formed at the central part thereof a film region that is similar in shape to the projection part 81*b*.

Also in this Modified Example, the effect same as that in the above-described Modified Example 4 may be obtained.

Modified Example 6 of First Embodiment

Next, the sheet container 100 according to Modified Example 6 of the first embodiment will be explained referring to FIG. 19(*a*).

In this Modified Example, the transverse width of the intermediate extending part 83 repetitively varies in the vertical direction. The part of the intermediate extending part 83 having the maximum transverse width is not the lower end of the projection part 81*b* but the intermediate part between the lower end of the projection part 81*b* and the end 83*a*.

The end 83*a* (upper end part), in the extending direction of the intermediate extending part 83 lies horizontally.

In addition, in the first surface-like part (first main surface part 21*a*), there is no filler enclosing part formed in a region thereof which falls between the end 83*a* in the extending direction of the intermediate extending part 83 and the opposite end 152.

Modified Example 7 of First Embodiment

Next, the sheet container 100 according to Modified Example 7 of the first embodiment will be explained referring to FIG. 19(*b*).

In this Modified Example, the projection part 81*b* is formed into a rod shape (band shape), rather than the chevron shape.

The extending direction of the projection part 81*b* from the boundary part 151 toward the opposite end 152 is not a direction orthogonal to the boundary part 151 but a direction inclined with respect to the boundary part 151.

In addition, in the first surface-like part (first main surface part 21*a*), there is no filler enclosing part formed in a region thereof which falls between an end 83*a* in the extending direction of the intermediate extending part 83 and the opposite end 152.

Modified Example 8 of First Embodiment

Next, the sheet container 100 according to Modified Example 8 of the first embodiment will be explained referring to FIG. 19(*c*).

In this Modified Example, the projection part 81*b* is formed into a rectangular shape.

In addition, in the first surface-like part (first main surface part 21*a*), there is no filler enclosing part formed in a region thereof which falls between an end 83*a* in the extending direction of the intermediate extending part 83 and the opposite end 152.

With such design, sufficient bulging of the trunk 21 in the front-rear direction of the sheet container 100 can be realized, and the capacity of the container body 20 can be sufficiently secured.

Modified Example 9 of First Embodiment

Figure 20:
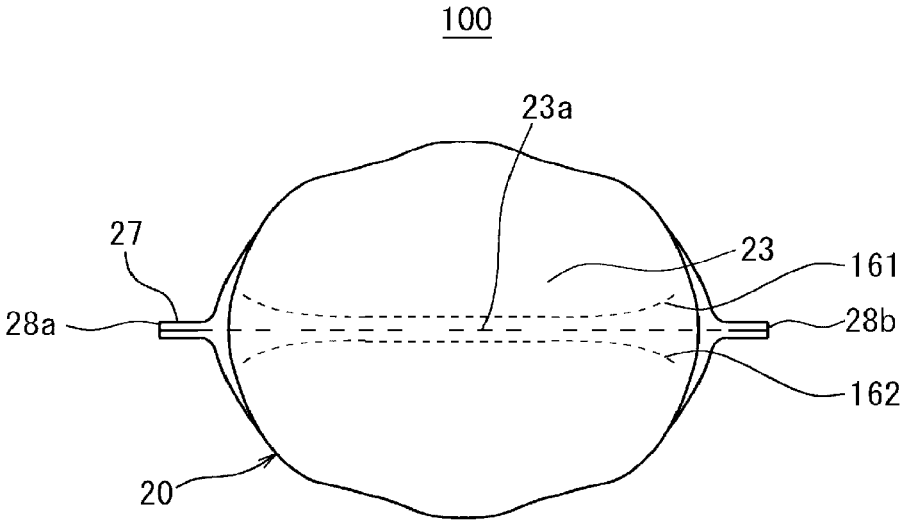
FIG. 20 is a bottom view illustrating a sheet container according to Modified Example 9 of the first embodiment.

Next, the sheet container 100 according to Modified Example 9 of the first embodiment will be explained referring to FIG. 20 and FIG. 21.

Although the first embodiment has described the case where all filler enclosing parts owned by the container body 20 are formed in a merged manner, the filler enclosing parts in this Modified Example are composed of a plurality of portions independent of each other. As illustrated in FIG. 20, for example, the filler enclosing part of the container body 20 is composed of two portions, namely, the first filler enclosing part 161 and the second filler enclosing part 162.

In order to materialize such structure, for example, as illustrated in FIG. 21, the container body-forming sheet member 120 has formed therein a plurality of non-attached parts (for example, two non-attached parts, namely, the first non-attached part 125*a* and the second non-attached part 125*b*) independent of each other.

Second Embodiment

Next, the packed article in sheet container 300 of the second embodiment will be explained referring to FIG. 22.

In this Modified Example, the container body 20 of the sheet container 100 has no top gusset 22. The sheet container 100 is a so-called standing pouch.

The projection part 81*b* is formed, for example, into a trapezoidal shape with the upper base shorter than the lower base, and with the end 83*a* (upper end part) of the intermediate extending part 83 laid horizontally.

Although FIG. 22 has illustrated the case where the container body 20 has no first peripheral enclosing part 41 and no second peripheral enclosing part 42, the container body 20 may alternatively have the first peripheral enclosing part 41 and the second peripheral enclosing part 42.

Third Embodiment

Next, the sheet container 100 and the packed article in sheet container 300 of the third embodiment will be explained referring to FIG. 23 to FIG. 28.

In this embodiment, the sheet container 100 has an inner container 10 (FIG. 24) disposed inside the container body 20. That is, the container body 20 covers the circumference of the inner container 10. The container body 20 surrounds the accommodating area 10*a*.

In this embodiment, the first surface-like part (first main surface part 21*a*) of the container body 20 is opposed to the third surface-like part (second main surface part 21*b*), while placing the accommodating area 10*a* (described later) of the inner container 10 in between.

Figure 24:
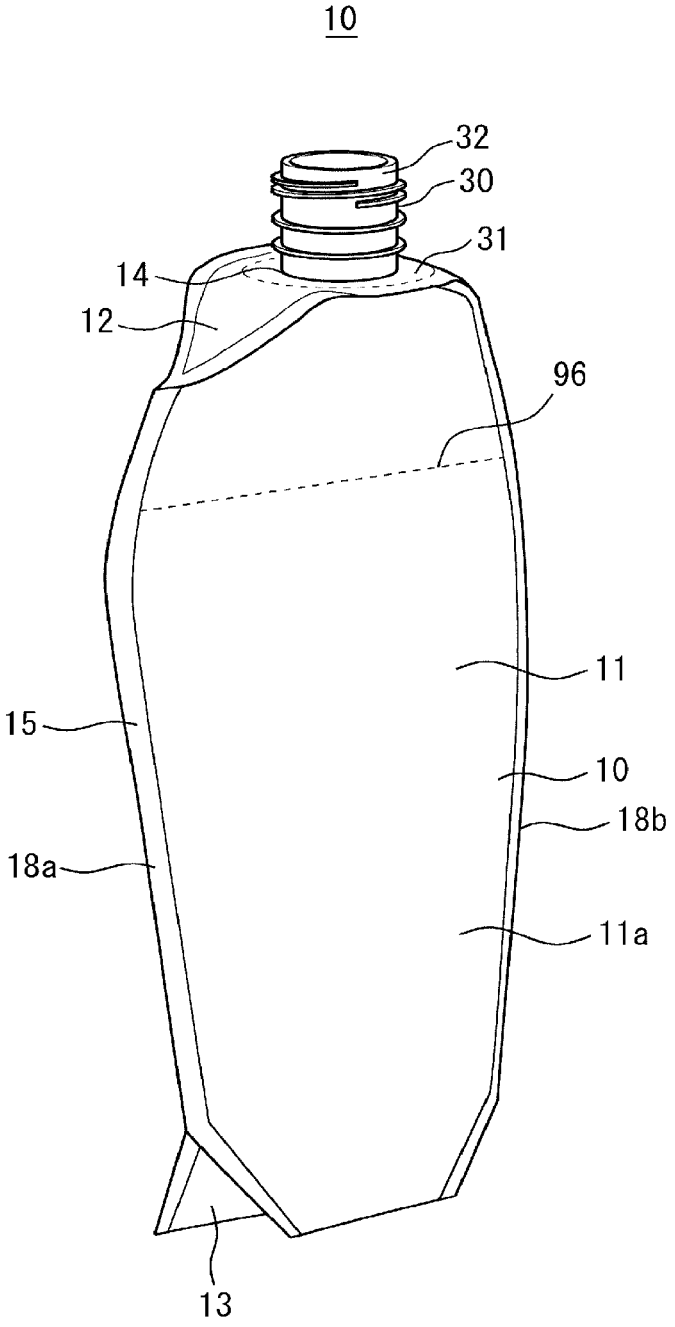
FIG. 24 is a perspective view illustrating an inner container of the sheet container of the third embodiment.

FIG. 24 is a perspective view illustrating the inner container 10 of the sheet container 100 according to the third embodiment. In other words, FIG. 24 is a perspective view illustrating the sheet container 100, leaving the container body 20 unillustrated.

As shown in FIG. 24, the inner container 10 has the top gusset 12 which is a gusset formed at the upper end part of the inner container 10, a bottom gusset 13 which is a gusset formed at the bottom of the inner container 10, and the trunk 11 which is a section of the inner container 10 located between the top gusset 12 and the bottom gusset 13.

The trunk 11 has a first main surface part 11*a* and a second main surface part 11*b* (FIG. 28(*a*), FIG. 28(*b*)) which are opposed while placing the later-described accommodating area 10*a* in between.

The first main surface part 11*a* and the bottom gusset 13 are mutually connected at the lower end part of the inner container 10. Similarly, the second main surface part 11*b* and the bottom gusset 13 are mutually connected at the lower end part of the inner container 10.

The trunk 11 has a pair of left and right inner container peripheral parts 18*a*, 18*b* each extending from the top gusset 12 side towards the bottom gusset 13 side, and being arranged side by side.

The first main surface part 11*a* and the second main surface part 11*b* are mutually connected in the inner container peripheral part 18*a*, and also in the inner container peripheral part 18*b*.

The top gusset 12 has, for example, a central part where the level of height is relatively large in the transverse direction of the inner container 10, and parts on both sides thereof which slope down towards the left and right ends of the inner container 10. Hence, the inner container 10 has a shape of sloping shoulder.

The inner space of the inner container 10 forms the accommodating area 10*a* (FIG. 28(*a*), FIG. 28(*b*)) for accommodating the article 96.

That is, in this embodiment, the accommodating area 10*a* (FIG. 28(*a*)) for accommodating the article 96 is demarcated by the inner container 10. The article 96 enclosed in the accommodating area 10*a* is brought into direct contact with the inner surface of the inner container 10, but is not brought into direct contact with the inner surface of the container body 20.

The top gusset 12 has an opening 14 through which the article 96 in the accommodating area 10*a* may be discharged. As described later, in the top gusset 12, for example, there is provided the cylinder part 32 of the spout 30 so as to extend through the opening 14. Hence, in more details, the article 96 in the accommodating area 10*a* of the inner container 10 may be discharged through the spout 30 that extends through the opening 14.

Figure 25A:
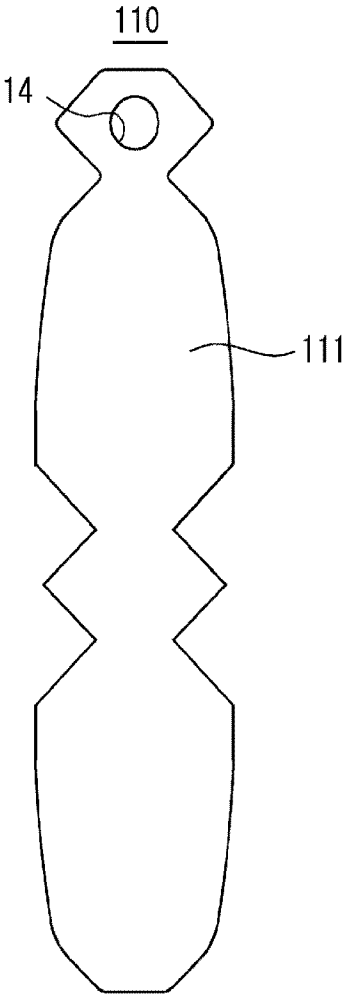
FIG. 25(*a*) is a plan view (inner surface side) illustrating an inner container-forming sheet that composes an inner container of the sheet container of the third embodiment, FIG. 25(*b*) is a plan view (outer surface side) illustrating the inner container-forming sheet that composes the inner container of the sheet container of the third embodiment, and FIG. 25(*c*) is a cross sectional view illustrating the inner container-forming sheet that composes the inner container of the sheet container of the third embodiment.
Figure 25B:
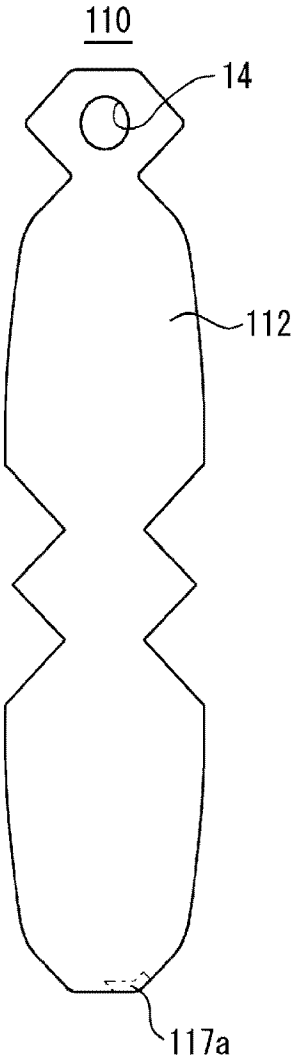
Figure 25C:
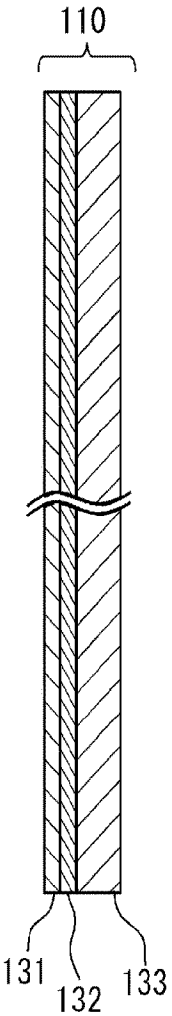

FIG. 25(*a*) and FIG. 25(*b*) are plan views illustrating an inner container-forming sheet member 110 that composes the inner container 10, wherein FIG. 25(*a*) shows the surface of the inner container-forming sheet member 110 which serves as an interior face (inner surface 111) of the inner container 10, meanwhile FIG. 25(*b*) shows the surface of the inner container-forming sheet member 110 which serves as an exterior face (outer surface 112) of the inner container 10. FIG. 25(*c*) is a cross-sectional view illustrating the inner container-forming sheet member 110.

In this embodiment, the inner container 10 is formed into a form illustrated in FIG. 24, by folding the inner container-forming sheet member 110 and by attaching the peripheral parts thereof to each other to form sealed parts 15.

The parts of the inner container-forming sheet member 110 are attached to each other at the sealed part 15 which is the boundary between the top gusset 12 and the trunk 11, at the sealed part 15 of the inner container peripheral part 18*a* and the inner container peripheral part 18*b*, and at the sealed part 15 which is the boundary between the trunk 11 and the bottom gusset 13. With such design, the inner container 10 has formed therein the accommodating area 10*a* which is an inner space tightly closed except for the opening 14. The mutual attachment of the parts of the inner container-forming sheet member 110 is performed, for example, by heat sealing.

However, in the present invention, the inner container is not always necessarily composed of the sheet member, but may be formed by blow molding.

In this embodiment, the container body 20 and the inner container 10 are partially attached to each other (container body-forming sheet member 120 and the inner container-forming sheet member 110 are partially attached).

Since the inner container 10 is held by the container body 20, so that the inner container 10 may be prevented from creasing even if the inner container 10 (inner container-forming sheet member 110) is made thin, and the inner container 10 will more easily be collapsed or flattened. Hence, the article 96 will be prevented from remaining in the inner container 10.

The container body 20 and the inner container 10 are preferably attached at two or more places.

However, the present invention is not limited to the example above, wherein the container body 20 and the inner container 10 may be left unattached over the entire range (the container body 20 and the inner container 10 may be left unattached entirely). However, it is preferable also in this case that the inner container 10 is held by the container body 20 inside the container body 20.

With the inner container-forming sheet member 110 and the container body-forming sheet member 120 are left partially unattached, the sheet container 100 has an outer air introducing part 126 (FIG. 23) through which the outer air may be introduced inside the container body 20, that is, a space between the inner surface of the container body 20 and the outer surface of the inner container 10.

Portion of the sheet container 100 where the outer air introducing part 126 is formed is not specifically limited. In this embodiment, the outer air introducing part 126 may be formed, for example, between the upper end part of the second main surface part 21*b* of the trunk 21 (the boundary part of the second main surface part 21*b*, which is faced to the top gusset 22), and the upper end part of the second main surface part 11*b* of the trunk 11 (the boundary part of the second main surface part 11*b*, which is faced to the top gusset 12).

In this embodiment, the outer air introducing part 126 is formed between the container body 20 and the inner container 10. However, the present invention is not limited to this example. The outer air introducing part 126 may solely be owned by the container body 20.

In this embodiment, the sheet container 100 has a single outer air introducing part 126. That is, the sheet container 100 has the outer air introducing part 126 formed therein only at one place. However, the present invention is not limited to this example. The sheet container 100 may alternatively have a plurality of outer air introducing parts 126.

The outer air introducing part may be formed by the parts of the container body-forming sheet member 120 partially being unattached to each other, or may be formed as a result of provision of a through-hole to the container body-forming sheet 120 so as to extend through the container body-forming sheet 120 (a through-hole is formed in the container body 20 so as to penetrate inside and outside container body 20).

Next, an exemplary layer structure of the inner container-forming sheet member 110 will be explained.

As illustrated in FIG. 25(*c*), the inner container-forming sheet member 110 is, for example, composed of a first layer 131, a second layer 132, and a third layer 133 laminated in this order.

The first layer 131 is, for example, composed of linear low-density polyethylene.

The second layer 132 is, for example, a transparent evaporated oriented nylon layer that is composed of an oriented nylon film, and silica and alumina are vapor-deposited on one surface thereof (the surface on the side of the first layer 131).

The third layer 133 is, for example, composed of linear low-density polyethylene.

Although the thickness of these layers is not specifically limited, the first layer 131 may be 25 μm thick, the second layer 132 may be 15 μm thick, and the third layer 133 may be 40 μm thick, for example.

An exemplary major function of the first layer 131 is to enhance heat sealability with the container body-forming sheet member 120.

An exemplary major function of the second layer 132 is to enhance gas barrier performance and pinhole resistance.

An exemplary major function of the third layer 133 is to enhance heat sealability between the parts of the inner container-forming sheet member 110.

The layer structure of the inner container-forming sheet member 110 is not limited to the one described above.

The first layer 131 is disposed on the outer surface side of the inner container 10 (that is, on the container body 20 side), meanwhile the third layer 133 is disposed on the inner surface side of the inner container 10 (that is, on the accommodating area 10*a* side).

The inner container 10 is formed by folding the inner container-forming sheet member 110 into the above-described shape with the trunk 11, the top gusset 12 and the bottom gusset 13, and then by attaching the peripheral parts of the third layer 133 of the inner container-forming sheet member 110 to each other.

The parts of the third layer 133 are not mutually attached in the region inside the peripheral part of the inner container-forming sheet member 110. In this way, the region where the parts of the inner container-forming sheet member 110 are left unattached, that is, the accommodating area 10*a*, is formed inside the inner container 10.

As shown in FIG. 25(*a*) and FIG. 25(*b*), the inner container-forming sheet member 110 has the opening 14 which is formed in an area for composing the top gusset 12. The opening 14 is, for example, formed into the same size with the opening 24, and is disposed so as to overlap the opening 24. The opening 14 is slightly smaller than the opening 24*a*.

When the inner container-forming sheet member 110 and the container body-forming sheet member 120 are attached as explained below, the inner container-forming sheet member 110 and the container body-forming sheet member 120 are left partially unattached in the introducing part-forming part 117*a* illustrated in FIG. 25(*b*), and thereby a non-attached region 124 (FIG. 27) which serves as the outer air introducing part 126 (FIG. 23) is formed.

An area where the inner container-forming sheet member 110 and the container body-forming sheet member 120 are mutually attached is referred to as a sealed part 25. That is, the sealed part 25 constitutes an attached region of the container body 20 and the inner container 10 (attached region of the container body-forming sheet member 120 and the inner container-forming sheet member 110).

Figure 26:
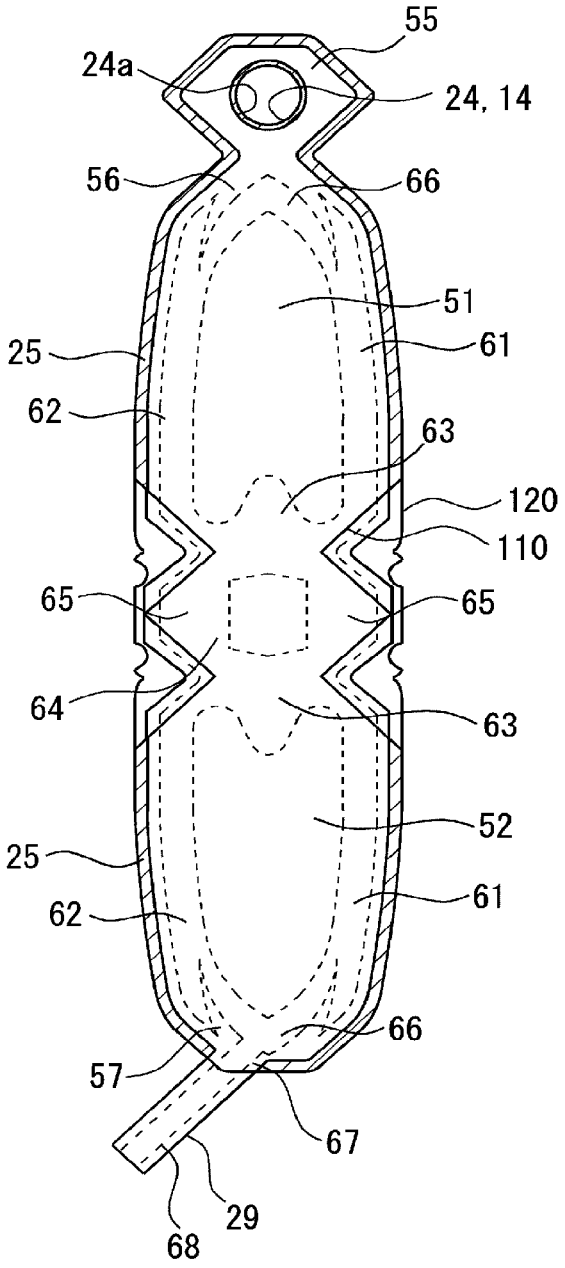
FIG. 26 is a plan view illustrating the container-forming sheet that composes the container of the third embodiment, with a portion later formed into an accommodating area for accommodating an article, directed to the top.

As illustrated in FIG. 26, the container body-forming sheet member 120 and the inner container-forming sheet member 110 are laminated, and partially attached. In FIG. 26, an area where the container body-forming sheet member 120 and the inner container-forming sheet member 110 are mutually attached (sealed part 25) is hatched.

In this embodiment, a sheet member which is composed of the container body-forming sheet member 120 and the inner container-forming sheet member 110, and is equipped with the spout 30 (FIG. 27), will be referred to as the container-forming sheet 400.

In this embodiment, the base part 31 of the spout 30 is fixed by adhesion to the inner container-forming sheet member 110 at around the circumference of the opening 14.

In more details, the base part 31 of the spout 30 is fixed by adhesion to the inner container-forming sheet member 110 on the surface thereof which composes the inner surface of the inner container 10. However, the present invention is not limited to this example, wherein the base part 31 may be disposed between the first film layer 121 and the second film layer 122 that compose the container body 20, and may be fixed by adhesion to at least one of the first film layer 121 or the second film layer 122. Alternatively, the base part 31 may be disposed between the outer surface of the inner container 10 and the inner surface of the container body 20, and may be fixed by adhesion to at least one of the outer surface of the inner container 10 or the inner surface of the container body 20.

In this embodiment, the first main surface sheet part 51 composes the first main surface part 11*a* of the inner container 10, and the first main surface part 21*a* of the container body 20.

The second main surface sheet part 52 composes the second main surface part 11*b* of the inner container 10, and the second main surface part 21*b* of the container body 20.

The first bottom gusset sheet part 53 and the second bottom gusset sheet part 54 compose the bottom gusset 13 of the inner container 10, and the bottom gusset 23 of the container body 20.

The top gusset sheet part 55 composes the top gusset 22 of the inner container 10, and the bottom gusset 23 of the container body 20.

In this embodiment, the sheet for container is formed by folding the container-forming sheet 400, and by attaching the peripheral parts of the inner container-forming sheet member 110 to each other (for example by heat sealing).

That is, by heat sealing the container-forming sheet 400, the sealed part 15 as well as the inner container 10 are formed, and, the sealed part 27 as well as the container body 20 that covers the inner container 10 are formed.

The peripheral part of the top gusset 22 and the peripheral part of the top gusset 12 are attached to each other; the boundary part of the first main surface part 21*a* between the first main surface part 21*a* and the top gusset 22, and, the boundary part of the first main surface part 11*a* between the first main surface part 11*a* and the top gusset 12, are attached to each other; the boundary part of the second main surface part 21*b* between the second main surface part 21*b* and the top gusset 22, and, the boundary part of the second main surface part 11*b* between the second main surface part 11*b* and the top gusset 12, are attached to each other; each of the left and right side edge parts of the first main surface part 21*a* (except for the lower end part), and, each of the left and right side edge parts of the first main surface part 11*a,* are attached to each other; each of the left and right side edge parts of the second main surface part 21*b* (except for the lower end part), and, each of the left and right side edge parts of the second main surface part 11*b,* are attached to each other; and at each of the left and right side edge parts of the lower end part of the trunk 21, the parts of the container body-forming sheet member 120 that compose the container body 20 are attached.

As described above, the sealed part 25 contains a region where the peripheral part of the top gusset 12 and the peripheral part of the top gusset 22 are attached to each other, a portion where the peripheral part of the first main surface part 11*a* and the peripheral part of the first main surface part 21*a* are attached to each other, and a portion where the peripheral part of the second main surface part 11*b* and the peripheral part of the second main surface part 21*b* are attached to each other.

The sealed part 27 is disposed at the lower end part of each of the first peripheral part 28*a* and the second peripheral part 28*b*.

In this embodiment, the top gusset 22 covers the top face side of the top gusset 12.

The trunk 21 covers the periphery of the trunk 11. That is, the first main surface part 21*a* covers the front face side of the first main surface part 11*a,* and the second main surface part 21*b* covers the rear face side of the second main surface part 11*b*.

The bottom gusset 23 covers the bottom face side of the bottom gusset 13.

Each of FIG. 28(*a*) and FIG. 28(*b*) is a cross sectional view taken along line A-A in FIG. 15, wherein FIG. 28(*b*) illustrates a less volume of article remaining in the accommodating area 10*a,* as compared with the volume illustrated in FIG. 28(*a*).

In this embodiment, as described above, the sheet container 100 has the outer air introducing part 126.

With such design, when the residual content of the article 96 becomes less in the accommodating area 10*a,* air will be introduced through the outer air introducing part 126 into the space between the container body 20 and the inner container 10, so that the inner container 10 will more easily be collapsible independent of the container body 20 (see FIG. 28(*b*)). Hence, the article 96 will be suppressed from remaining in the inner container 10.

The present invention is not limited to the embodiments and the individual Modified Examples described above, instead including various alterations and modifications so long as the purpose of the present invention is attainable.

For example, while the explanation above dealt with the case where each of the first adjoining part 84 and the second adjoining part 85 is arranged to lie across the boundary part 151, the first adjoining part 84 and the second adjoining part 85 need not always be laid across the boundary part 151. That is, each of the first adjoining part 84 and the second adjoining part 85 may be arranged only in the first surface-like part (first main surface part 21*a*), or only in the third surface-like part (second main surface part 21*b*).

Each of the first adjoining part 84 and the second adjoining part 85 maybe arranged only in the second surface-like part (bottom gusset 23), rather than in the first surface-like part and the third surface-like part. In this case, the container bodies of the sheet container and the sheet for container may be manufactured by using, for example, the container body-forming sheet member illustrated in FIG. 29. A first adjoining part-forming part 631 and a second adjoining part-forming part 632 of the container body-forming sheet member illustrated in FIG. 29 are arranged in the first bottom gusset sheet part 53 and the second bottom gusset sheet part 54, but not in the first main surface sheet part 51 and the second main surface sheet part 52.

The sealed part 15 of the bottom gusset 13 of the inner container 10 may be attached to the bottom of the container body 20.

Figure 27:
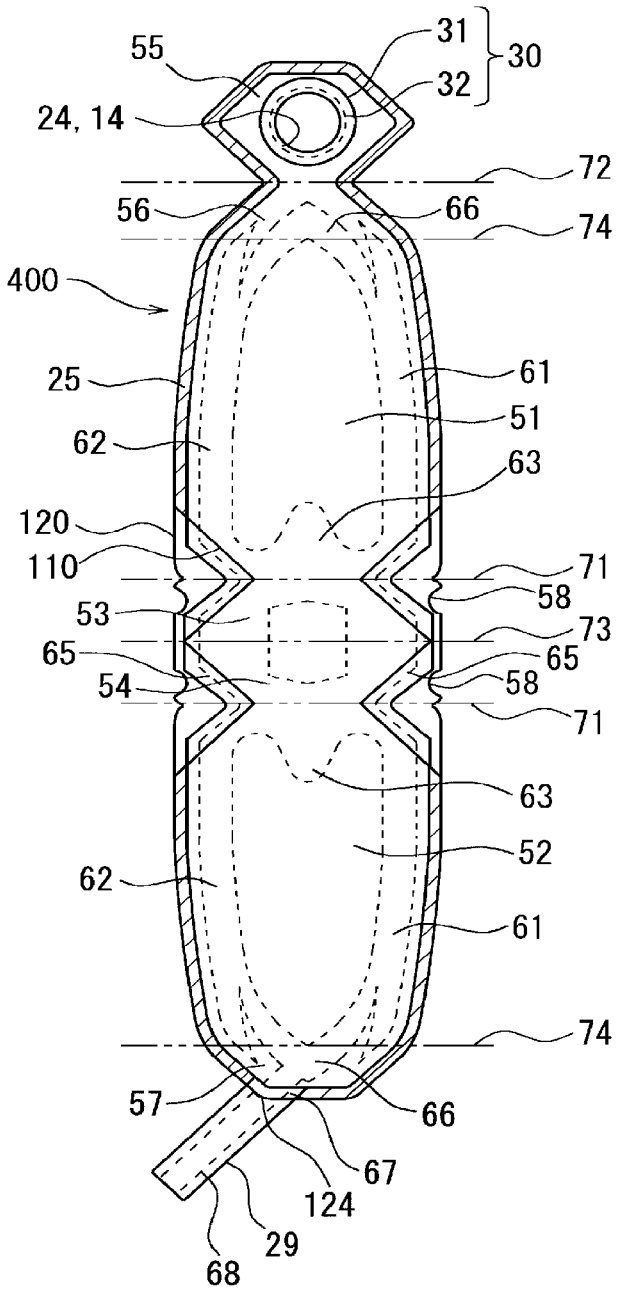
FIG. 27 is a plan view illustrating the container-forming sheet (with a spout) that composes the container of the third embodiment, with a portion later formed into an accommodating area for accommodating an article, directed to the top.

In order to materialize a structure in which the sealed part 15 of the bottom gusset 13 is attached to the bottom of the container body 20, for example, the inner container-forming sheet member 110 and the container body-forming sheet member 120, seen in the container-forming sheet 400 in FIG. 27, are formed into the same shape unlike the shape illustrated in FIG. 27, then the inner container-forming sheet member 110 and the container body-forming sheet member 120 are stacked so as to align the outer contour of the inner container-forming sheet member 110 and the outer contour of the container body-forming sheet member 120, and the peripheral part of the inner container-forming sheet member 110 and the peripheral part of the container body-forming sheet member 120 are mutually attached.

In this case, the inner container-forming sheet member 110 and the container body-forming sheet member 120 maybe punched out using a common cutting blade, and this facilitates the manufacturing process of the sheet container 100.

For example, in the first embodiment and so forth described above, an example has been described, in which the pumping cap 90 is attached to the cylinder part 32 of the spout 30. The cylinder part 32 of the spout 30 may alternatively have a simple screw cap, dispenser or the like (trigger dispenser, for example) attached thereto.

In the first embodiment or so, described was the case where the sheet container 100 had the filler introducing part 29 including the non-attached part 68 already cut off. The sheet container 100 may alternatively have the filler introducing part 29 remained thereon, with the non-attached part 68 filled with the filler. In this case, when the sheet container 100 is discarded, the filler introducing part 29 may be broken to allow the inside of the non-attached part 68 to communicate with the outer air, and the filler (air, for example) in each of the filler enclosing parts may be discharged through the non-attached part 68 to the outside, allowing the sheet container 100 to be flattened and thinned.

The embodiments encompass the technical spirits below.

<1> A sheet container comprising a container body that surrounds an accommodating area for accommodating an article, the container body being composed of a sheet member given by lamination of a plurality of film layers, and having a plurality of surface-like parts, the plurality of surface-like parts including a first surface-like part and a second surface-like part that adjoin and cross each other, the sheet member having a film region in which the plurality of film layers are attached to each other, and a filler enclosing part in which a filler is enclosed between the plurality of film layers, the filler enclosing part comprising:

an intermediate extending part laid across the first surface-like part and the second surface-like part, and extend from a boundary part between the first surface-like part and the second surface-like part towards the side of an opposite end opposite to the boundary part side at the first surface-like part; and a first adjoining part and a second adjoining part that individually adjoin both sides, in the direction along the boundary part, of the intermediate extending part, and, the intermediate extending part extending more further from the second surface-like part than the first adjoining part and the second adjoining part, and, the film regions are individually disposed adjoining both sides of an end part of the intermediate extending part in the extending direction thereof.

<2> The sheet container according to <1>, wherein, in the first surface-like part, there is no filler enclosing part formed in a region thereof which falls between an end in the extending direction of the intermediate extending part and the opposite end.

<3> The sheet container according to <1>, wherein the first surface-like part has a first peripheral part and a second peripheral part, each extending from the boundary part side towards the opposite end side, and being arranged side by side, the first adjoining part is disposed between the intermediate extending part and the first peripheral part, the second adjoining part is disposed between the intermediate extending part and the second peripheral part, the filler enclosing part comprises:

a first peripheral enclosing part that extends from one end on the first peripheral part side of the first adjoining part towards the opposite end, along the first peripheral part;

a second peripheral enclosing part that extends from one end on the second peripheral part side of the second adjoining part towards the opposite end, along the second peripheral part; and a transverse direction enclosing part that extends, in a region of the first surface-like part on the opposite end side, from the first peripheral part towards the second peripheral part, so as to mutually connect the first peripheral enclosing part and the second peripheral enclosing part, and, the transverse direction enclosing part is thinner than the first peripheral enclosing part, in the crossing part of the first peripheral enclosing part and the transverse direction enclosing part.

<4> The sheet container according to any one of <1> to <3>, wherein the distance, from the second surface-like part to the end of the intermediate extending part in the extending direction of the intermediate extending part, is equal to or less than a half of the distance from the second surface-like part to the opposite end.

<5> The sheet container according to any one of <1> to <5>, wherein, a portion of the filler enclosing part, which falls on the first surface-like part, comprises:

a base part that is disposed along the boundary part, and laid across the first adjoining part, the intermediate extending part and the second adjoining part; and, a projection part, which is a part of the intermediate extending part, and protrudes out from the base part and away from the second surface-like part, and, the width dimension of the projection part in the direction parallel to the boundary part is maximized at the end part on the base part side of the projection part.

<6> The sheet container according to <5>, wherein the projection part is formed into a chevron shape in which the width dimension of the projection part in the direction parallel to the boundary part becomes narrower as being farther from the base part.

<7> The sheet container according to any one of <1> to <6>, wherein the first surface-like part has a first peripheral part and a second peripheral part, each extending from the boundary part side towards the opposite end side, and being arranged side by side, the first adjoining part is disposed between the intermediate extending part and the first peripheral part, the second adjoining part is disposed between the intermediate extending part and the second peripheral part, the filler enclosing part comprises:

a first peripheral enclosing part that extends from one end on the first peripheral part side of the first adjoining part towards the opposite end, along the first peripheral part; and a second peripheral enclosing part that extends from one end on the second peripheral part side of the second adjoining part towards the opposite end, along the second peripheral part, and, the shortest distance from the opposite end to the end of the intermediate extending part on the opposite end side is longer than the shortest distance from the opposite end to the ends of the first peripheral enclosing part and the second peripheral enclosing part on the opposite end side.

<8> The sheet container according to any one of <1> to <6>, wherein the first surface-like part has a first peripheral part and a second peripheral part, each extending from the boundary part side towards the opposite end side, and being arranged side by side, the first adjoining part is disposed between the intermediate extending part and the first peripheral part, the second adjoining part is disposed between the intermediate extending part and the second peripheral part, the filler enclosing part comprises:

a first peripheral enclosing part that extends from one end on the first peripheral part side of the first adjoining part towards the opposite end, along the first peripheral part; and a second peripheral enclosing part that extends from one end on the second peripheral part side of the second adjoining part towards the opposite end, along the second peripheral part, and, when viewed in a cross section which lies parallel to the second surface-like part, and is taken across the ends on the opposite end side of the first peripheral enclosing part, the second peripheral enclosing part and the intermediate extending part, the intermediate extending part has a cross sectional area smaller than the cross sectional areas of the first peripheral enclosing part and the second peripheral enclosing part.

<9> The sheet container according to any one of <1> to <8>, wherein the plurality of surface-like parts include a third surface-like part which is opposed to the first surface-like part while placing the accommodating area in between, the container body has a trunk that includes the first surface-like part and the third surface-like part, and a bottom composed of the second surface-like part, the trunk has a first peripheral part and a second peripheral part, each extending from the boundary part side towards the opposite end side, and being arranged side by side, the first surface-like part and the third surface-like part are mutually connected at each of the first peripheral part and the second peripheral part, a portion of the filler enclosing part, located in the first surface-like part, is formed symmetrically about a portion of the filler enclosing part located in the third surface-like part, a portion of the filler enclosing part, located in a half area on the first surface-like part side of the bottom, is formed symmetrically about a portion of the filler enclosing part, located in a half area on the third surface-like part side, and, a central part of the first surface-like part, which falls between the first peripheral part and the second peripheral part, and a central part of the third surface-like part, which falls between the first peripheral part and the second peripheral part, are bulged in opposite directions to each other.

<10> The sheet container according to <9>, wherein the plurality of surface-like parts include a third surface-like part which is opposed to the first surface-like part while placing the accommodating area in between, the container body has a trunk that includes the first surface-like part and the third surface-like part, and a bottom composed of the second surface-like part, the trunk has a first peripheral part and a second peripheral part, each extending from the boundary part side towards the opposite end side, and being arranged side by side, the first surface-like part and the third surface-like part are mutually connected at each of the first peripheral part and the second peripheral part, the bottom is formed into a shape having a first bottom peripheral part, a second bottom peripheral part opposed to the first bottom peripheral part, a third bottom peripheral part disposed between one end of the first bottom peripheral part and one end of the second bottom peripheral part, and a fourth bottom peripheral part opposed to the third bottom peripheral part, the filler enclosing part comprises:

the intermediate extending part laid across the first bottom peripheral part and the first surface-like part;

a second intermediate extending part that is disposed symmetrically to the intermediate extending part, and laid across the second bottom peripheral part and the third surface-like part;

a first side bottom enclosing part laid across the third bottom peripheral part and the trunk; and a second side bottom enclosing part laid across the fourth bottom peripheral part and the trunk, and is opposed to the first side bottom enclosing part.

<11> A packed article in sheet container comprising:

the sheet container described in any one of <1> to <10>; and an article that is accommodated in the accommodating area.

<12> A sheet for container comprising a container body that surrounds an accommodating area for accommodating an article, the container body being composed of a sheet member given by lamination of a plurality of film layers, the sheet member having a film region in which the plurality of film layers are attached to each other, and a non-attached region in which the plurality of film layers are left unattached to each other, when a filler is enclosed between the plurality of film layers in the non-attached region of the sheet member to form a filler enclosing part, the container body will be a shape with a plurality of surface-like parts, the plurality of surface-like parts including a first surface-like part and a second surface-like part that adjoin and cross each other, the filler enclosing part comprising:

an intermediate extending part laid across the first surface-like part and the second surface-like part, and extend from a boundary part between the first surface-like part and the second surface-like part towards the side of an opposite end opposite to the boundary part side at the first surface-like part; and a first adjoining part and a second adjoining part that individually adjoin both sides, in the direction along the boundary part, of the intermediate extending part, and, the intermediate extending part extending more further from the second surface-like part than the first adjoining part and the second adjoining part, and, the film regions are individually disposed adjoining both sides of an end part of the intermediate extending part in the extending direction thereof.

<13> A container-forming sheet comprising a sheet member that composes a container body, given by lamination of a plurality of film layers, the sheet member having a film region in which the plurality of film layers are attached to each other, and a non-attached region in which the plurality of film layers are left unattached to each other, when the container body is formed by folding the sheet member, and by enclosing a filler between the plurality of film layers in the non-attached region to form a filler enclosing part, the container body will be a shape with a plurality of surface-like parts, the plurality of surface-like parts will include a first surface-like part and a second surface-like part that adjoin and cross each other, the filler enclosing part comprising:

an intermediate extending part that will be disposed across the first surface-like part and the second surface-like part, and extend from a boundary part between the first surface-like part and the second surface-like part, towards the side of an opposite end opposite to the boundary part side at the first surface-like part; and a first adjoining part and a second adjoining part that will individually adjoin both sides, in the direction along the boundary part, of the intermediate extending part, and, the intermediate extending part extending more further from the second surface-like part than the first adjoining part and the second adjoining part, and, the film regions are individually disposed adjoining both sides of an end part of the intermediate extending part in the extending direction thereof.

<14> The sheet container according to any of the preceding items, wherein an edge part on the opposite end side of the projection part has a convex shape toward the opposite end side, and the transverse direction enclosing part has a convex curved shape toward the opposite end side.

<15> The sheet container according to any of the preceding items, wherein each of the first peripheral enclosing part and the second peripheral enclosing part extends upward beyond the connection part between each of the first peripheral enclosing part and the second peripheral enclosing part, with the transverse direction enclosing part.

<16> The sheet container according to any of the preceding items, wherein the container body has an opening through which the article can be discharged, the sheet container has a pumping cap that is attached to a marginal part of the opening of the container body, the pumping cap has an operation part which accepts a pushing operation, and can discharge the article to the outside by the pushing operation on the operation part.

<17> The sheet for container according to any one of the preceding items, wherein, even when the filler enclosing part is formed by enclosing the filler between the plurality of film layers in the non-attached region of the sheet member, a region of the first surface-like part, which falls between an end in the extending direction of the intermediate extending part and the opposite end, will have no filler enclosing part formed therein.

<18> The sheet for container according to any one of the preceding items, wherein the first surface-like part has a first peripheral part and a second peripheral part, each extending from the boundary part side towards the opposite end side, and being arranged side by side, when a filler is enclosed between the plurality of film layers in the non-attached region of the sheet member to form a filler enclosing part, the first adjoining part is disposed between the intermediate extending part and the first peripheral part, the second adjoining part is disposed between the intermediate extending part and the second peripheral part, the filler enclosing part comprises:

a first peripheral enclosing part that extends from one end on the first peripheral part side of the first adjoining part towards the opposite end, along the first peripheral part;

a second peripheral enclosing part that extends from one end on the second peripheral part side of the second adjoining part towards the opposite end, along the second peripheral part; and a transverse direction enclosing part that extends, in a region of the first surface-like part on the opposite end side, from the first peripheral part towards the second peripheral part, so as to mutually connect the first peripheral enclosing part and the second peripheral enclosing part, and, the transverse direction enclosing part is thinner than the first peripheral enclosing part, in the connection part of the first peripheral enclosing part and the transverse direction enclosing part.

<19> The sheet for container according to any one of the preceding items, wherein when a filler is enclosed between the plurality of film layers in the non-attached region of the sheet member to form a filler enclosing part, the distance, from the second surface-like part to the end of the intermediate extending part in the extending direction of the intermediate extending part, is equal to or less than a half of the distance from the second surface-like part to the opposite end.

<20> The sheet for container according to any one of the preceding items, wherein when a filler is enclosed between the plurality of film layers in the non-attached region of the sheet member to form a filler enclosing part, a portion of the filler enclosing part, which falls on the first surface-like part, comprises:

a base part that is disposed along the boundary part, and laid across the first adjoining part, the intermediate extending part and the second adjoining part; and, a projection part, which is a part of the intermediate extending part, and protrudes out from the base part and away from the boundary part, and, the width dimension of the projection part in the direction parallel to the boundary part is maximized at the end part on the base part side of the projection part.

<21> The sheet for container according to any one of the preceding items, wherein when a filler is enclosed between the plurality of film layers in the non-attached region of the sheet member to form a filler enclosing part, the projection part is formed into a chevron shape in which the width dimension of the projection part in the direction parallel to the boundary part becomes narrower as being farther from the base part.

<22> The sheet for container according to any one of the preceding items, wherein the first surface-like part has a first peripheral part and a second peripheral part, each extending from the boundary part side towards the opposite end side, and being arranged side by side, when a filler is enclosed between the plurality of film layers in the non-attached region of the sheet member to form a filler enclosing part, the first adjoining part is disposed between the intermediate extending part and the first peripheral part, the second adjoining part is disposed between the intermediate extending part and the second peripheral part, the filler enclosing part comprises:

a first peripheral enclosing part that extends from one end on the first peripheral part side of the first adjoining part towards the opposite end, along the first peripheral part; and a second peripheral enclosing part that extends from one end on the second peripheral part side of the second adjoining part towards the opposite end, along the second peripheral part, and, the shortest distance from the opposite end to the end of the intermediate extending part on the opposite end side is longer than the shortest distance from the opposite end to the ends of the first peripheral enclosing part and the second peripheral enclosing part on the opposite end side.

<23> The sheet for container according to any one of the preceding items, wherein the first surface-like part has a first peripheral part and a second peripheral part, each extending from the boundary part side towards the opposite end side, and being arranged side by side, when a filler is enclosed between the plurality of film layers in the non-attached region of the sheet member to form a filler enclosing part, the first adjoining part is disposed between the intermediate extending part and the first peripheral part, the second adjoining part is disposed between the intermediate extending part and the second peripheral part, the filler enclosing part comprises:

a first peripheral enclosing part that extends from one end on the first peripheral part side of the first adjoining part towards the opposite end, along the first peripheral part; and a second peripheral enclosing part that extends from one end on the second peripheral part side of the second adjoining part towards the opposite end, along the second peripheral part, and, when viewed in a cross section which lies parallel to the second surface-like part, and is taken across the ends on the opposite end side of the first peripheral enclosing part, the second peripheral enclosing part and the intermediate extending part, the intermediate extending part has a cross sectional area smaller than the cross sectional areas of the first peripheral enclosing part and the second peripheral enclosing part.

<24> The sheet for container according to any one of the preceding items, wherein when a filler is enclosed between the plurality of film layers in the non-attached region of the sheet member to form a filler enclosing part, the plurality of surface-like parts include a third surface-like part which is opposed to the first surface-like part while placing the accommodating area in between, the container body has a trunk that includes the first surface-like part and the third surface-like part, and a bottom composed of the second surface-like part, the trunk has a first peripheral part and a second peripheral part, each extending from the boundary part side towards the opposite end side, and being arranged side by side, the first surface-like part and the third surface-like part are mutually connected at each of the first peripheral part and the second peripheral part, a portion of the filler enclosing part, located in the first surface-like part, is formed symmetrically about a portion of the filler enclosing part located in the third surface-like part, a portion of the filler enclosing part, located in a half area on the first surface-like part side of the bottom, is formed symmetrically about a portion of the filler enclosing part, located in a half area on the third surface-like part side, and, a central part of the first surface-like part, which falls between the first peripheral part and the second peripheral part, and a central part of the third surface-like part, which falls between the first peripheral part and the second peripheral part, are bulged in opposite directions to each other.

<25> The sheet for container according to any one of the preceding items, wherein when a filler is enclosed between the plurality of film layers in the non-attached region of the sheet member to form a filler enclosing part, the plurality of surface-like parts include a third surface-like part which is opposed to the first surface-like part while placing the accommodating area in between, the container body has a trunk that includes the first surface-like part and the third surface-like part, and a bottom composed of the second surface-like part, the trunk has a first peripheral part and a second peripheral part, each extending from the boundary part side towards the opposite end side, and being arranged side by side, the first surface-like part and the third surface-like part are mutually connected at each of the first peripheral part and the second peripheral part, the bottom is formed into a shape having a first bottom peripheral part, a second bottom peripheral part opposed to the first peripheral part, a third bottom peripheral part disposed between one end of the first bottom peripheral part and one end of the second bottom peripheral part, and a fourth bottom peripheral part opposed to the third bottom peripheral part, the filler enclosing part comprises:

the intermediate extending part laid across the first bottom peripheral part and the first surface-like part;

a second intermediate extending part that is disposed symmetrically to the intermediate extending part, and laid across the second bottom peripheral part and the third surface-like part;

a first side bottom enclosing part laid across the third bottom peripheral part and the trunk; and a second side bottom enclosing part laid across the fourth bottom peripheral part and the trunk, and is opposed to the first side bottom enclosing part.

EXPLANATION OF REFERENCE CHARACTERS

10 inner container
10*a* accommodating area
11 trunk
11*a* first main surface part
11*b* second main surface part
12 top gusset
13 bottom gusset
13*a* folding guideline
14 opening
15 sealed part
16 turnaround part
17 folded part
17*a* folding guideline
18*a* inner container peripheral part
18*b* inner container peripheral part
20 container body
20*a* accommodating area
21 trunk
21*a* first main surface part (first surface-like part)
21*b* second main surface part (third surface-like part)
22 top gusset
23 bottom gusset (second surface-like part)
23*a* bulge
24 opening
25 sealed part
26 closure part
27 sealed part
28*a* first peripheral part
28*b* second peripheral part
29 filler introducing part
30 spout
31 base part
32 cylinder part
41 first peripheral enclosing part
41*a* lower part
42 second peripheral enclosing part
42*a* lower part
43 filler enclosing part
45 filler enclosing part
451 first part
452 second part
46 transverse direction enclosing part
46*a* connection part
47 filler enclosing part
48 filler enclosing part
51 first main surface sheet part
52 second main surface sheet part
53 first bottom gusset sheet part
54 second bottom gusset sheet part
55 top gusset sheet part
56 top gusset attaching part
57 top gusset attaching part
58 notched part
61 non-attached part

62 non-attached part
63 non-attached part
630 intermediate extending part-forming part
631 first adjoining part-forming part
632 second adjoining part-forming part
65 non-attached part
66 non-attached part
67 non-attached part
68 non-attached part
71 folding line
72 folding line
73 folding line
74 folding line
80 specific enclosing part
800 second specific enclosing part
81 first part
81*a* base part
81*b* projection part
82 second part
83 intermediate extending part
831 second intermediate extending part
83*a*, 831*a* end
84 first adjoining part
85 second adjoining part
90 pumping cap
91 cap
92 upright cylinder
93 depressable part
94 nozzle
95 liquid feeding tube
96 article
100 sheet container
110 inner container-forming sheet member
111 inner surface
112 outer surface
117*a* introducing part-forming part
120 container body-forming sheet member (sheet member)
121 first film layer
122 second film layer
123 non-attaching part
124 non-attached region
125*a* first non-attached part
125*b* second non-attached part
126 outer air introducing part
131 first layer
132 second layer
133 third layer
141 first layer
142 second layer
143 third layer
143 fourth layer
151 boundary part
152 the opposite end
200 sheet for container
201 central part
202 central part
231 first bottom peripheral part
232 second bottom peripheral part
233 third bottom peripheral part
234 fourth bottom peripheral part
300 a packed article in sheet container
400 container-forming sheet

The invention claimed is:

1. A sheet container comprising a container body that surrounds an accommodating area for accommodating an article, the container body being composed of a sheet member given by lamination of a plurality of film layers, and having a plurality of surface-like parts, the plurality of surface-like parts including a first surface-like part and a second surface-like part that adjoin and cross each other, the sheet member having a film region in which the plurality of film layers are attached to each other, and a filler enclosing part in which a filler is enclosed between the plurality of film layers, the filler enclosing part comprising:

an intermediate extending part laid across the first surface-like part and the second surface-like part, and extend from a boundary part between the first surface-like part and the second surface-like part towards the side of an opposite end opposite to the boundary part side at the first surface-like part; and a first adjoining part and a second adjoining part that individually adjoin both sides, in the direction along the boundary part, of the intermediate extending part.

2. The sheet container according to claim 1, wherein, in the first surface-like part, there is no filler enclosing part formed in a region thereof which falls between an end in the extending direction of the intermediate extending part and the opposite end.

3. The sheet container according to claim 1, wherein the first surface-like part has a first peripheral part and a second peripheral part, each extending from the boundary part side towards the opposite end side, and being arranged side by side, the first adjoining part is disposed between the intermediate extending part and the first peripheral part, the second adjoining part is disposed between the intermediate extending part and the second peripheral part, the filler enclosing part comprises:

a first peripheral enclosing part that extends from one end on the first peripheral part side of the first adjoining part towards the opposite end, along the first peripheral part;

a second peripheral enclosing part that extends from one end on the second peripheral part side of the second adjoining part towards the opposite end, along the second peripheral part; and a transverse direction enclosing part that extends, in a region of the first surface-like part on the opposite end side, from the first peripheral part towards the second peripheral part, so as to mutually connect the first peripheral enclosing part and the second peripheral enclosing part, and the transverse direction enclosing part is thinner than the first peripheral enclosing part, in the connection part of the first peripheral enclosing part and the transverse direction enclosing part.

4. The sheet container according to claim 1, wherein the distance, from the second surface-like part to the end of the intermediate extending part in the extending direction of the intermediate extending part, is equal to or less than a half of the distance from the second surface-like part to the opposite end.

5. The sheet container according to claim 1, wherein, a portion of the filler enclosing part, which falls on the first surface-like part, comprises:

a base part that is disposed along the boundary part, and laid across the first adjoining part, the intermediate extending part and the second adjoining part; and, a projection part, which is a part of the intermediate extending part, and protrudes out from the base part and away from the second surface-like part, and the width dimension of the projection part in the direction parallel to the boundary part is maximized at the end part on the base part side of the projection part.

6. The sheet container according to claim 5, wherein the projection part is formed into a chevron shape in which the width dimension of the projection part in the direction parallel to the boundary part becomes narrower as being farther from the base part.

7. The sheet container according to claim 1, wherein the first surface-like part has a first peripheral part and a second peripheral part, each extending from the boundary part side towards the opposite end side, and being arranged side by side, the first adjoining part is disposed between the intermediate extending part and the first peripheral part, the second adjoining part is disposed between the intermediate extending part and the second peripheral part, the filler enclosing part comprises:

a first peripheral enclosing part that extends from one end on the first peripheral part side of the first adjoining part towards the opposite end, along the first peripheral part; and a second peripheral enclosing part that extends from one end on the second peripheral part side of the second adjoining part towards the opposite end, along the second peripheral part, and the shortest distance from the opposite end to the end of the intermediate extending part on the opposite end side is longer than the shortest distance from the opposite end to the ends of the first peripheral enclosing part and the second peripheral enclosing part on the opposite end side.

8. The sheet container according to claim 1, wherein the first surface-like part has a first peripheral part and a second peripheral part, each extending from the boundary part side towards the opposite end side, and being arranged side by side, the first adjoining part is disposed between the intermediate extending part and the first peripheral part, the second adjoining part is disposed between the intermediate extending part and the second peripheral part, the filler enclosing part comprises:

a first peripheral enclosing part that extends from one end on the first peripheral part side of the first adjoining part towards the opposite end, along the first peripheral part; and a second peripheral enclosing part that extends from one end on the second peripheral part side of the second adjoining part towards the opposite end, along the second peripheral part, and when viewed in a cross section which lies parallel to the second surface-like part, and is taken across the ends on the opposite end side of the first peripheral enclosing part, the second peripheral enclosing part and the intermediate extending part, the intermediate extending part has a cross sectional area smaller than the cross sectional areas of the first peripheral enclosing part and the second peripheral enclosing part.

9. The sheet container according to claim 1, wherein the plurality of surface-like parts include a third surface-like part which is opposed to the first surface-like part while placing the accommodating area in between, the container body has a trunk that includes the first surface-like part and the third surface-like part, and a bottom composed of the second surface-like part, the trunk has a first peripheral part and a second peripheral part, each extending from the boundary part side towards the opposite end side, and being arranged side by side, the first surface-like part and the third surface-like part are mutually connected at each of the first peripheral part and the second peripheral part, a portion of the filler enclosing part, located in the first surface-like part, is formed symmetrically about a portion of the filler enclosing part located in the third surface-like part, a portion of the filler enclosing part, located in a half area on the first surface-like part side of the bottom, is formed symmetrically about a portion of the filler enclosing part, located in a half area on the third surface-like part side, and a central part of the first surface-like part, which falls between the first peripheral part and the second peripheral part, and a central part of the third surface-like part, which falls between the first peripheral part and the second peripheral part, are bulged in opposite directions to each other.

10. The sheet container according to claim 9, wherein the plurality of surface-like parts include a third surface-like part which is opposed to the first surface-like part while placing the accommodating area in between, the container body has a trunk that includes the first surface-like part and the third surface-like part, and a bottom composed of the second surface-like part, the trunk has a first peripheral part and a second peripheral part, each extending from the boundary part side towards the opposite end side, and being arranged side by side, the first surface-like part and the third surface-like part are mutually connected at each of the first peripheral part and the second peripheral part, the bottom is formed into a shape having a first bottom peripheral part, a second bottom peripheral part opposed to the first bottom peripheral part, a third bottom peripheral part disposed between one end of the first bottom peripheral part and one end of the second bottom peripheral part, and a fourth bottom peripheral part opposed to the third bottom peripheral part, the filler enclosing part comprises:

the intermediate extending part laid across the first bottom peripheral part and the first surface-like part;

a second intermediate extending part that is disposed symmetrically to the intermediate extending part, and laid across the second bottom peripheral part and the third surface-like part;

a first side bottom enclosing part laid across the third bottom peripheral part and the trunk; and a second side bottom enclosing part laid across the fourth bottom peripheral part and the trunk, and is opposed to the first side bottom enclosing part.

11. A packed article in sheet container comprising:

the sheet container described in claim 1; and an article that is accommodated in the accommodating area.

12. A sheet for container comprising a container body that surrounds an accommodating area for accommodating an article, the container body being composed of a sheet member given by lamination of a plurality of film layers, the sheet member having a film region in which the plurality of film layers are attached to each other, and a non-attached region in which the plurality of film layers are left unattached to each other, when a filler is enclosed between the plurality of film layers in the non-attached region of the sheet member to form a filler enclosing part, the container body will be a shape with a plurality of surface-like parts, and the plurality of surface-like parts including a first surface-like part and a second surface-like part that adjoin and cross each other, the filler enclosing part comprising:

an intermediate extending part laid across the first surface-like part and the second surface-like part, and extend from a boundary part between the first surface-like part and the second surface-like part towards the side of an opposite end opposite to the boundary part side at the first surface-like part; and a first adjoining part and a second adjoining part that individually adjoin both sides, in the direction along the boundary part, of the intermediate extending part.

13. A container-forming sheet comprising a sheet member that composes a container body, given by lamination of a plurality of film layers, the sheet member having a film region in which the plurality of film layers are attached to each other, and a non-attached region in which the plurality of film layers are left unattached to each other, when the container body is formed by folding the sheet member, and by enclosing a filler between the plurality of film layers in the non-attached region to form a filler enclosing part, the container body will be a shape with a plurality of surface-like parts, and the plurality of surface-like parts will include a first surface-like part and a second surface-like part that adjoin and cross each other, the filler enclosing part comprising:

an intermediate extending part that will be disposed across the first surface-like part and the second surface-like part, and extend from a boundary part between the first surface-like part and the second surface-like part, towards the side of an opposite end opposite to the boundary part side at the first surface-like part; and a first adjoining part and a second adjoining part that will individually adjoin both sides, in the direction along the boundary part, of the intermediate extending part.

14. The sheet container according to claim 1, wherein the intermediate extending part extends more from the second surface-like part than the first adjoining part and the second adjoining part extend, and the film regions are individually disposed adjoining both sides of an end part of the intermediate extending part in the extending direction thereof.

15. The sheet container according to claim 1, wherein the intermediate extending part extends more from the second surface-like part than the first adjoining part and the second adjoining part extend, and the film regions are individually disposed adjoining both sides of an end part of the intermediate extending part in the extending direction thereof, and, the film region is also disposed at a position adjoining to the end part on the extending direction side, and the end part is terminated at the film region.

* * * * *